US009395658B2

(12) United States Patent
Wada et al.

(10) Patent No.: US 9,395,658 B2
(45) Date of Patent: Jul. 19, 2016

(54) IMAGE FORMING APPARATUS

(71) Applicants: Yuuji Wada, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP); Kenji Sugiura, Kanagawa (JP); Takehide Mizutani, Tokyo (JP); Tatsuya Ohsugi, Kanagawa (JP); Hiroyoshi Haga, Kanagawa (JP); Hirokazu Ishii, Tokyo (JP)

(72) Inventors: Yuuji Wada, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP); Kenji Sugiura, Kanagawa (JP); Takehide Mizutani, Tokyo (JP); Tatsuya Ohsugi, Kanagawa (JP); Hiroyoshi Haga, Kanagawa (JP); Hirokazu Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/962,062

(22) Filed: Dec. 8, 2015

(65) Prior Publication Data

US 2016/0161888 A1 Jun. 9, 2016

(30) Foreign Application Priority Data

Dec. 9, 2014 (JP) ..... 2014-248960
Mar. 20, 2015 (JP) ..... 2015-058377

(51) Int. Cl.
*G03G 15/16* (2006.01)

(52) U.S. Cl.
CPC ..... *G03G 15/1665* (2013.01); *G03G 15/161* (2013.01)

(58) Field of Classification Search
USPC ..... 399/38–42, 66, 107, 110, 121, 162
See application file for complete search history.

(56) References Cited

U.S. PATENT DOCUMENTS 5,812,919 A 9/1998 Takano et al.
6,282,386 B1 8/2001 Ishii (Continued)

FOREIGN PATENT DOCUMENTS

JP 2000-347517 12/2000
JP 2009-198562 9/2009

(Continued)

OTHER PUBLICATIONS

U.S. Appl. No. 14/802,374, filed Jul. 17, 2015.

(Continued)

*Primary Examiner* — Hoan Tran
(74) *Attorney, Agent, or Firm* — Oblon, McClelland, Maier & Neustadt, L.L.P.

(57) ABSTRACT

An image forming apparatus includes a belt-shaped image bearer; a transfer device disposed opposing to the image bearer; an opposed device disposed opposing to the transfer device; and a transfer bias power source. The image bearer is disposed along an outer circumferential surface of the transfer device at least one of an upstream side and a downstream side of the transfer portion in a direction of conveyance of the recording medium. The transfer bias power source cyclically alternates the transfer bias applied to the transfer portion, between a transfer directional bias in a transfer direction to transfer the toner image from the image bearer onto the recording medium and a reverse directional bias in a reverse direction of the transfer direction. The transfer bias power source applies the reverse directional bias during a time period longer than 50% of one cycle of the applied transfer bias in the one cycle.

19 Claims, 28 Drawing Sheets

(56) References Cited

U.S. PATENT DOCUMENTS

| | | | | |
|---|---|---|---|---|
| 8,824,004 | B2 * | 9/2014 | Kyung | H04N 1/506 358/1.9 |
| 2003/0035658 | A1 | 2/2003 | Ishii | |
| 2007/0212139 | A1 | 9/2007 | Sugiura et al. | |
| 2008/0187352 | A1 * | 8/2008 | Takeuchi | G03G 15/161 399/101 |
| 2008/0310897 | A1 | 12/2008 | Naruse et al. | |
| 2009/0208257 | A1 | 8/2009 | Matsumoto | |
| 2010/0008706 | A1 | 1/2010 | Sugiura et al. | |
| 2010/0040386 | A1 | 2/2010 | Mizutani et al. | |
| 2010/0068643 | A1 * | 3/2010 | Iwazaki | G03G 9/0804 430/108.21 |
| 2011/0103822 | A1 | 5/2011 | Sugiura et al. | |
| 2011/0158677 | A1 | 6/2011 | Kikuchi et al. | |
| 2011/0229187 | A1 | 9/2011 | Hozumi et al. | |
| 2012/0008973 | A1 | 1/2012 | Sakakibara et al. | |
| 2012/0237271 | A1 | 9/2012 | Sengoku et al. | |
| 2012/0308250 | A1 | 12/2012 | Shimizu et al. | |
| 2012/0315058 | A1 | 12/2012 | Shimizu et al. | |
| 2013/0004190 | A1 | 1/2013 | Sengoku et al. | |
| 2013/0011155 | A1 | 1/2013 | Ogiyama et al. | |
| 2013/0089363 | A1 | 4/2013 | Mimbu et al. | |
| 2013/0136468 | A1 | 5/2013 | Shimizu et al. | |
| 2013/0136477 | A1 | 5/2013 | Ogiyama et al. | |
| 2013/0177329 | A1 | 7/2013 | Tanaka et al. | |
| 2013/0236201 | A1 | 9/2013 | Mizutani et al. | |
| 2013/0308968 | A1 | 11/2013 | Tanaka et al. | |
| 2014/0029988 | A1 | 1/2014 | Shimizu et al. | |
| 2014/0064769 | A1 | 3/2014 | Sugiura | |
| 2014/0241744 | A1 | 8/2014 | Ichikawa et al. | |
| 2014/0270819 | A1 | 9/2014 | Wada et al. | |
| 2014/0314435 | A1 | 10/2014 | Kato et al. | |

FOREIGN PATENT DOCUMENTS

| | | |
|---|---|---|
| JP | 2011-013241 | 1/2011 |
| JP | 2011-133664 | 7/2011 |
| JP | 2014-010383 | 1/2014 |
| JP | 2014-211476 | 11/2014 |

OTHER PUBLICATIONS

U.S. Appl. No. 14/881,611, filed Oct. 13, 2015.

* cited by examiner

FIG. 6

| INTERMEDIATE TRANSFER BELT | PRENIP AMOUNT | PAPER TYPE | SECONDARY TRANSFER CURRENT [-uA] | | | | | |
|---|---|---|---|---|---|---|---|---|
| | | | 60 | 80 | 100 | 120 | 140 | 160 |
| ELASTIC BELT | 0 mm | THIN | POOR | POOR | POOR | POOR | POOR | POOR |
| | | PLAIN | POOR | POOR | POOR | POOR | POOR | POOR |
| | 1 mm | THIN | POOR | POOR | POOR | POOR | POOR | POOR |
| | | PLAIN | GOOD | FAIR | POOR | POOR | POOR | POOR |
| | 2 mm | THIN | GOOD | FAIR | POOR | POOR | POOR | POOR |
| | | PLAIN | GOOD | GOOD | GOOD | POOR | POOR | POOR |
| | 3 mm | THIN | GOOD | GOOD | FAIR | POOR | POOR | POOR |
| | | PLAIN | GOOD | GOOD | GOOD | GOOD | GOOD | FAIR |
| | 4 mm | THIN | GOOD | GOOD | GOOD | GOOD | FAIR | POOR |
| | | PLAIN | GOOD | GOOD | GOOD | GOOD | GOOD | GOOD |
| | 5 mm | THIN | GOOD | GOOD | GOOD | GOOD | GOOD | FAIR |
| | | PLAIN | GOOD | GOOD | GOOD | GOOD | GOOD | GOOD |
| PI BELT | 0 mm | THIN | FAIR | POOR | POOR | POOR | POOR | POOR |
| | | PLAIN | GOOD | FAIR | POOR | POOR | POOR | POOR |
| | 1 mm | THIN | GOOD | GOOD | POOR | POOR | POOR | POOR |
| | | PLAIN | GOOD | GOOD | GOOD | GOOD | POOR | POOR |
| | 2 mm | THIN | GOOD | GOOD | GOOD | GOOD | POOR | POOR |
| | | PLAIN | GOOD | GOOD | GOOD | GOOD | GOOD | GOOD |
| | 3 mm | THIN | GOOD | GOOD | GOOD | GOOD | GOOD | GOOD |
| | | PLAIN | GOOD | GOOD | GOOD | GOOD | GOOD | GOOD |
| | 4 mm | THIN | GOOD | GOOD | GOOD | GOOD | GOOD | GOOD |
| | | PLAIN | GOOD | GOOD | GOOD | GOOD | GOOD | GOOD |
| | 5 mm | THIN | GOOD | GOOD | GOOD | GOOD | GOOD | GOOD |
| | | PLAIN | GOOD | GOOD | GOOD | GOOD | GOOD | GOOD |

FIG. 15

| Duty [%] | 90 | 70 | 50 | 30 | 10 |
|---|---|---|---|---|---|
| EVALUATION | 5 | 5 | 3 | 1 | 1 |

FIG. 16

| IMAGE AREA RATIO | TRANSFER CURRENT [%] |
|---|---|
| 0≦W<10 | 40 |
| 10≦W<30 | 60 |
| 30≦W<50 | 70 |
| 50≦W<80 | 80 |
| 80≦W<100 | 90 |
| 100≦W<150 | 100 |
| 150≦W<200 | 130 |
| 200≦W<250 | 150 |
| 250≦W | 175 |

FIG. 17

| ABSOLUTE HUMIDITY | TRANSFER CURRENT [%] |
|---|---|
| x ≦ 5 | 109 |
| 5 < x ≦12 | 100 |
| 12 < x ≦18 | 100 |
| 18 ≦ x | 86 |

FIG. 19

| ABSOLUTE HUMIDITY | SECTION 1 | SECTION 2 | SECTION 3 | SECTION 4 | SECTION 5 |
|---|---|---|---|---|---|
| $x \leqq 3$ | $x < 2kV$ | $2kV \leqq x < 4kV$ | $4kV \leqq x < 5kV$ | $5kV \leqq x < 6kV$ | $6kV \leqq x$ |
| $3 < x \leqq 12$ | $x < 2kV$ | $2kV \leqq x < 3kV$ | $3kV \leqq x < 4kV$ | $4kV \leqq x < 5kV$ | $5kV \leqq x$ |
| $12 < x \leqq 18$ | $x < 1.5kV$ | $1.5kV \leqq x \leqq 2kV$ | $2kV \leqq x < 3.5kV$ | $3.5kV \leqq x < 4.5kV$ | $4.5kV \leqq x$ |
| $18 \leqq x$ | $x < 1kV$ | $1kV \leqq x < 1.5kV$ | $1.5kV \leqq x \leqq 2kV$ | $2kV \leqq x < 2.5kV$ | $2.5kV \leqq x$ |

FIG. 20

| DETECTION RESULT | TRANSFER CURRENT [%] |
|---|---|
| SECTION 1 | 120 |
| SECTION 2 | 110 |
| SECTION 3 | 100 |
| SECTION 4 | 90 |
| SECTION 5 | 70 |

IMAGE FORMING APPARATUS

CROSS-REFERENCE TO RELATED APPLICATIONS

This patent application is based on and claims priority pursuant to 35 U.S.C. §119(a) to Japanese Patent Application No. 2015-058377 filed on Mar. 20, 2015 and Japanese Patent Application No. 2014-248960 filed on Dec. 9, 2014 in the Japan Patent Office, the entire disclosure of which is hereby incorporated by reference herein.

BACKGROUND

1. Technical Field

Exemplary aspects of the present disclosure generally relate to an image forming apparatus, such as a copier, a facsimile machine, a printer, or a multi-functional system including a combination thereof.

2. Related Art

In an image forming apparatus that employs an electrophotographic method, a belt-shaped image bearer bearing an image contacts a transfer device, which is disposed opposing to the image bearer, to form a transfer nip serving as a transfer portion, thereby transferring the image onto a recording medium in the transfer nip. In such a system, the recording medium, which has been conveyed to the transfer nip, contacts the image bearer to generate an electrical discharge due to the potential difference therebetween. To prevent such an electrical discharge, for example, the transfer device is disposed offset to the upstream side in a direction of conveyance of the recording medium.

SUMMARY

In an aspect of this disclosure, there is provided an improved image forming apparatus including a belt-shaped image bearer to bear a toner image; a transfer device disposed opposing to the image bearer; an opposed device disposed opposing to the transfer device via the image bearer; and a transfer bias power source to apply a transfer bias to a transfer portion where the transfer device contacts the opposed device via the image bearer so as to transfer the toner image onto a recording medium. The image bearer is disposed along an outer circumferential surface of the transfer device at least one of an upstream side and a downstream side of the transfer portion in a direction of conveyance of the recording medium. The transfer bias power source cyclically alternates the transfer bias applied to the transfer portion, between a transfer directional bias in a transfer direction to transfer the toner image from the image bearer onto the recording medium and a reverse directional bias in a reverse direction of the transfer direction. The transfer bias power source applies the reverse directional bias during a time period longer than 50% of one cycle of the applied transfer bias in the one cycle.

BRIEF DESCRIPTION OF THE DRAWINGS

The aforementioned and other aspects, features, and advantages of the present disclosure will be better understood by reference to the following detailed description when considered in connection with the accompanying drawings, wherein:

FIG. 3A is a partially enlarged cross-sectional view of an image bearer formed into an elastic belt including a coating layer;

FIG. 3B is a partially enlarged cross-sectional view of an image bearer formed into an elastic belt including particles;

FIG. 3C is a partially enlarged plan view of the image bearer of FIG. 3B as seen from above;

FIG. 6 is a table of evaluation results of prenip electrical discharge with different offset amounts of a transfer device relative to belt-shaped image bearers having different materials;

FIG. 15 is a table of test results using output waveforms illustrated in FIGS. 14A through 14E;

FIG. 16 is a table of relations between image area ratios and transfer currents of secondary transfer bias;

FIG. 17 is a table for correction, indicating correction factors for different absolute humidities;

FIG. 19 is a determination table of sections of second transfer bias selected according to the results of the process of detecting and correcting resistance value;

FIG. 20 is a correction factor table of sections of correction factor to correct the secondary transfer bias determined based on the determination table of FIG. 19;

Figure 1:
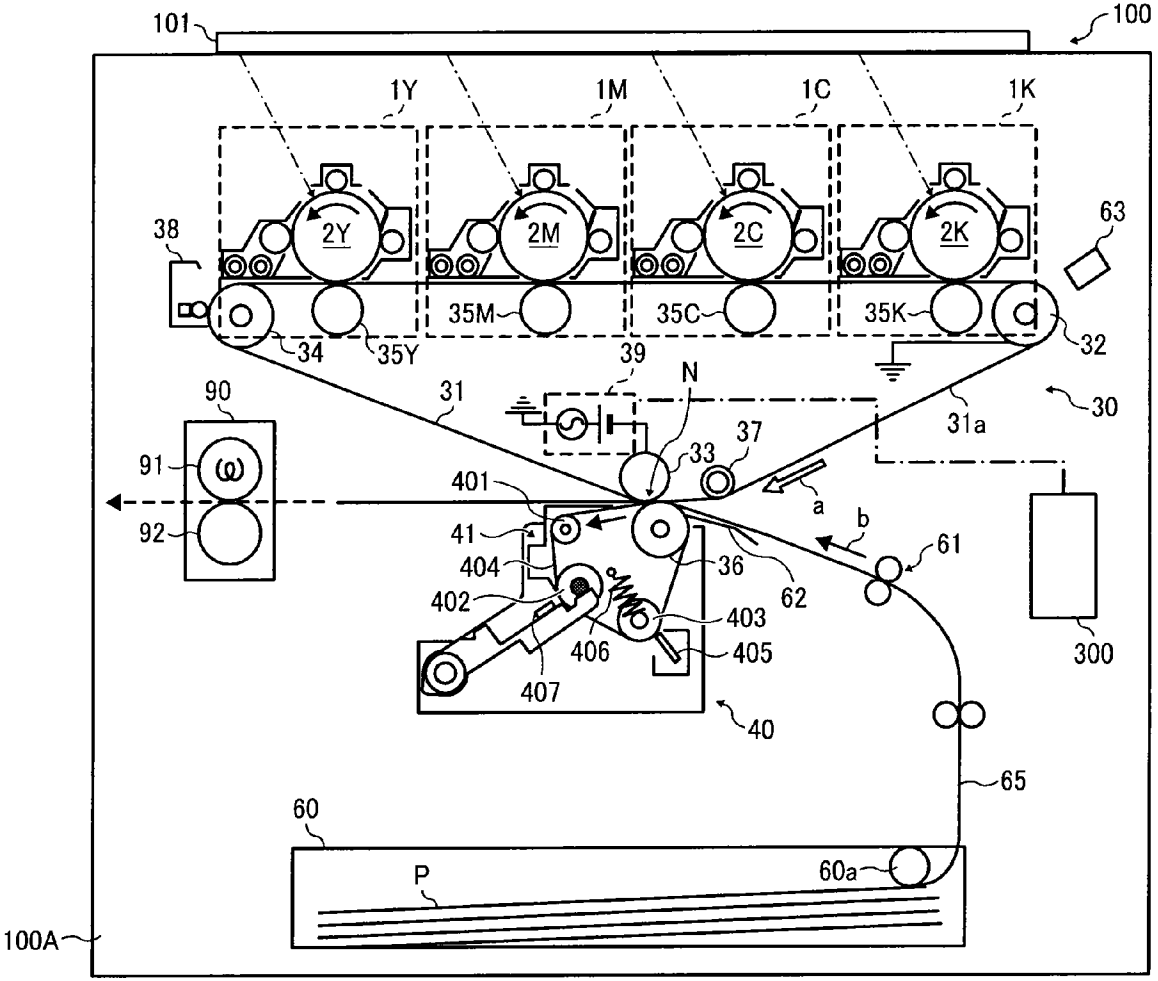
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

With reference to FIG. 1, a description is provided of the image forming apparatus according to an embodiment of the present disclosure. The same reference numerals will be given to constituent elements, such as parts and materials having the same functions, and the descriptions thereof will be omitted. In some Figures, portions of configurations are partially omitted to better understand the configurations. It is to be noted that suffixes Y, M, C, and K denote colors yellow, magenta, cyan, and black, respectively. These suffixes may be omitted unless otherwise specified.

With reference to FIG. 1, a description is provided of an electrophotographic color printer (hereinafter referred to as a printer) as an example of an image forming apparatus 100 according to an embodiment of the present disclosure. A description is provided of a basic configuration of an image forming apparatus 100, illustrated as an electrophotographic color printer, according to an embodiment of the present disclosure. FIG. 1 is a schematic diagram illustrating the relevant sections of the image forming apparatus 100 according to the present embodiment. As illustrated in FIG. 1, the image forming apparatus 100 includes four image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 100 includes a transfer unit 30 serving as a transfer device, a paper cassette 60 to store a recording medium P, a fixing device 90, and a controller 300. The image forming units 1Y, 1M, 1C, and 1K all have the same configuration as all the others, differing only in the color of toner employed as a powder-form developing agent. The image forming units 1Y, 1M, 1C, and 1K are replaced upon reaching their product life cycles. According to the embodiment, the image forming units 1Y, 1M, 1C, and 1K are detachably attachable relative to an apparatus body 100A of the image forming apparatus 100 and replaceable.

Figure 2:
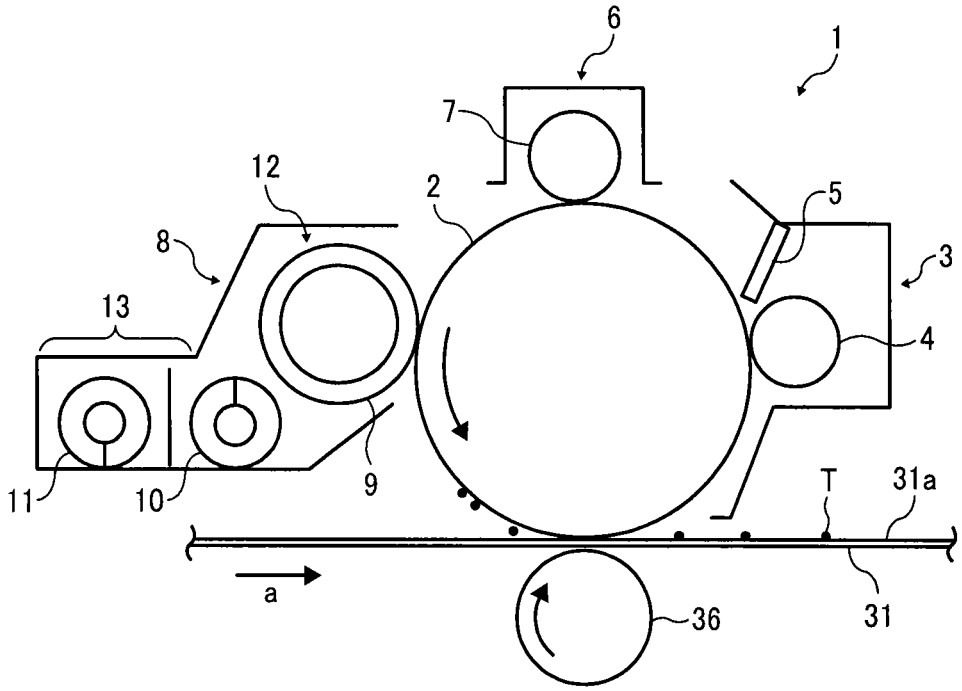
FIG. 2 is a schematic view of an image forming unit employed in the image forming apparatus of FIG. 1.

FIG. 2 is an enlarged diagram schematically illustrating one of the image forming units 1Y, 1M, 1C, and 1K as a representative example. The image forming units 1Y, 1M, 1C, and 1K all have the same configuration as all the others, differing only in the color of toner employed. Thus, the description is provided without the suffixes Y, M, C, and K indicating colors unless differentiation of the color is necessary. The image forming units 1Y, 1M, 1C, and 1K are referred to collectively as an image forming unit 1. The image forming unit 1 includes a drum-shaped photoconductor 2 serving as an image bearer, a photoconductor cleaner 3, a static eliminator, a charging device 6, a developing device 8, and so forth. These devices are held in a common casing so that they are detachably installable and replaceable all together relative to the apparatus body 100A, thereby constituting a process cartridge. The image forming unit 1 is replaceable independently.

The photoconductor 2 comprises a drum-shaped base on which an organic photosensitive layer is disposed. The photoconductor 2 is rotated in a clockwise direction indicated by arrow by a driving device such as a motor. The charging device 6 includes a charging roller 7 to which a charging bias is applied. The charging roller 7 contacts or approaches the photoconductor 2 to generate an electrical discharge therebetween, thereby charging uniformly the surface of the photoconductor 2. Instead of using the charging roller 7 or the like that contacts or disposed close to the photoconductor 2, a corona charger or the like that does not contact the photoconductor 2 may be employed.

The uniformly charged surface of the photoconductor 2 by the charging roller 7 is scanned by exposure light, such as a light beam projected from the optical writing unit 101, thereby forming an electrostatic latent image for each color on the surface of the photoconductor 2. The electrostatic latent image on the photoconductor 2 is developed with toner of each color by the developing device 8. Accordingly, a visible image, also known as a toner image, is formed. The toner image formed on the photoconductor 2 is transferred primarily onto an intermediate transfer belt 31 formed into an endless loop.

The photoconductor cleaner 3 removes residual toner remaining on the surface of the photoconductor 2 after a primary transfer process, that is, after the photoconductor 2 passes through a primary transfer nip between the intermediate transfer belt 31 and the photoconductor 2. The photoconductor cleaner 3 further includes a photoconductor brush roller 4 and a photoconductor cleaning blade 5. The photoconductor brush roller 4 rotates and brushes off the residual toner from the surface of the photoconductor 2 while the photoconductor cleaning blade 5 scraping off the residual toner from the surface. The static eliminator may employ a known static eliminating device and removes residual charge remaining on the photoconductor 2 after the surface thereof is cleaned by the photoconductor cleaner 3. The surface of the photoconductor 2 is initialized in preparation for the subsequent imaging cycle.

The developing device 8 includes a developing portion 12 and a developer conveyor 13. The developing portion 12 includes a developing roller 9 serving as a developer bearer inside thereof. The developer conveyor 13 stirs and transports the developing agent. The developer conveyor 13 includes a first chamber equipped with a first screw 10 and a second chamber equipped with a second screw 11. The first screw 10 and the second screw 11 are rotatably supported by a casing or the like of the developing device 8. The first screw 10 and the second screw 11 are rotated to deliver the developing agent to the developing roller 9 while circulating the developing agent.

As illustrated in FIG. 1, the optical writing unit 101 for writing a latent image on the photoconductors 2 is disposed above the image forming units 1Y, 1M, 1C, and 1K. Based on image information received from an external device, such as a personal computer (PC), the optical writing unit 101 scans optically the photoconductors 2Y, 2M, 2C, and 2K with a light beam projected from a laser diode of the optical writing unit 101. Accordingly, the electrostatic latent images of yellow, magenta, cyan, and black are formed on the photoconductors 2Y, 2M, 2C, and 2K, respectively.

Referring back to FIG. 1, a description is provided of the transfer unit 30. The transfer unit 30 is disposed substantially below the image forming units 1Y, 1M, 1C, and 1K. The transfer unit 30 includes the intermediate transfer belt 31 serving as an image bearer formed into an endless loop and rotated in the clockwise direction indicated by arrow a in the Figure (that is, a direction a of movement of the belt). The transfer unit 30 also includes a plurality of rollers: a drive roller 32, a secondary-transfer back surface roller 33, a cleaning auxiliary roller 34, four primary transfer rollers 35Y, 35M, 35C, and 35K (which may be referred to collectively as primary transfer rollers 35), and a pre-transfer roller 37 serving as a depressing device. The primary transfer rollers 35Y, 35M, 35C, and 35K are disposed opposite the photoconductors 2Y, 2M, 2C, and 2K, respectively, via the intermediate transfer belt 31. The transfer unit 30 is detachably attachable (replaceable) relative to the apparatus body 100A.

The intermediate transfer belt 31 is looped around and stretched taut between the plurality of rollers. i.e., the drive roller 32, the secondary-transfer back surface roller 33, the cleaning auxiliary roller 34, the four primary transfer rollers 35Y, 35M, 35C, and 35K, and the pre-transfer roller 37. The drive roller 32 is rotated in the clockwise direction by a motor or the like, and rotation of the drive roller 32 enables the intermediate transfer belt 31 to rotate in the same direction. In the transfer unit 30, the intermediate transfer belt 31 is looped around the plurality of rollers, thereby delivering the recording medium P.

Figure 4A:
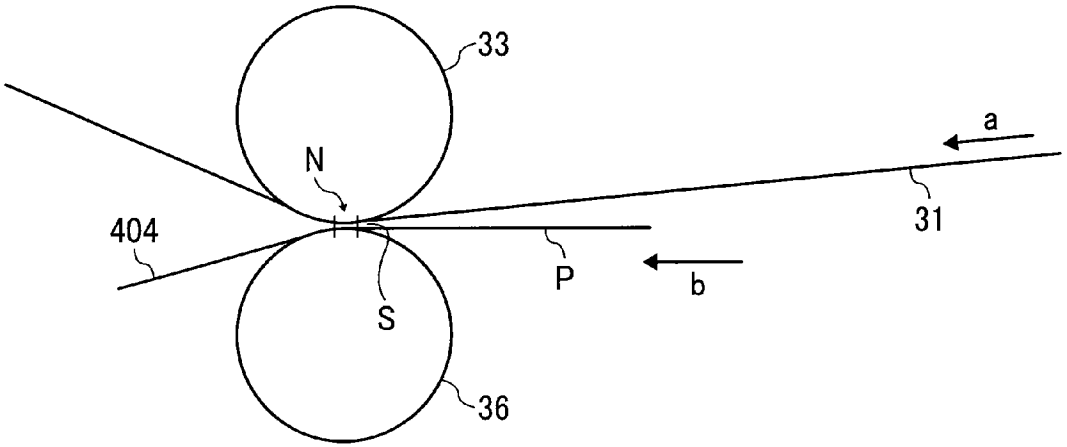
FIGS. 4A and 4B are an illustration of electrical discharge before transfer nip.

The intermediate transfer belt 31 according to the present embodiment is an endless looped belt having at least a base layer 310, an elastic layer 311, and a surface coating layer 312. As illustrated in FIGS. 4A and B, the intermediate transfer belt 31 includes the base layer 310 and the elastic layer 311. The base layer 310 formed into an endless looped belt is formed of a material having a high stiffness, but having some flexibility. The elastic layer 311 disposed on the front surface of the base layer 310 is formed of an elastic material with high elasticity. Examples of materials used for the elastic layer of the intermediate transfer belt 31 include, but are not limited to elastic members, such as elastic material rubber and elastomer. More specifically, one or more materials selected from the following group can be used. The materials include, but are not limited to, butyl rubber, fluorine-based rubber, acrylic rubber, Ethylene Propylene Diene Monomer (EPDM), NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrin-based rubber, polysulfide rubber, polynorbornene rubber, thermoplastic elastomers (e.g., polystyrene-based, polyolefin-based, polyvinyl chloride-based, polyurethane-based, polyamide-based, polyurea-based, polyester-based, and fluororesin-based thermoplastic elastomers) and the like can be used.

The thickness of the elastic layer 311 is preferably in a range of from 0.07 mm to 0.8 mm depending on the hardness and the layer structure of the elastic layer. More preferably, the thickness of the elastic layer 311 is in a range of from 0.25 mm to 0.5 mm. When the thickness of the intermediate transfer belt 31 is small such as 0.07 mm or less, the pressure to the toner on the intermediate transfer belt 31 increases in the secondary transfer nip, and image defects, such as toner dropouts, occur easily during transfer. Consequently, the transferability of the toner is degraded. That is, a thickness of 0.7 mm is not appropriate for the elastic layer 311. Preferably, the hardness of the elastic layer is $10° \leq HS \leq 65°$ in accordance with Japanese Industrial Standards (JIS-A). The optimum hardness differs with the layer thickness of the intermediate transfer belt 31. When the hardness is lower than 10° JIS-A, toner dropouts occur easily during transfer. By contrast, when the hardness is higher than 65° JIS-A, the belt is difficult to entrain around the rollers. Furthermore, the durability of such a belt with the hardness higher than 65° JIS-A is poor because the belt is stretched taught for an extended period of time, causing frequent replacement of the belt.

The base layer 310 of the intermediate transfer belt 31 is formed of relatively inelastic resin. More specifically, examples of materials used for the base layer 310 includes, but not limited to, polycarbonate, fluorine resin, such as polytetrafluoroethylene resin (ETFE) and polyvinylidene fluoride (PVDF), polystyrene, and chloropolystyrene. To prevent overstretching of the elastic layer 311 made of a rubber material that easily stretches, a core layer made of a material, such as canvas, may be provided between the base layer 310 and the elastic layer 311.

The surface coating layer 312 of the intermediate transfer belt 31 is a smooth layer that covers the surface of the elastic layer 311. Any material can be used for the surface coating layer 312. However, materials that can enhance the transferability of the secondary transfer through reducing the adhesion force of the toner onto the front surface 31*a* of the intermediate transfer belt 31 are generally used. Examples of materials used for the coating layer 312 include, but are not limited to, polyurethane resin, polyester resin, epoxy resin, and combinations of two or more of the above-described materials. Alternatively, a material that reduces surface energy to improve lubricating property, such as fluorocarbon resin grains and fluorine compound grains with or without the grain size being varied may be used alone or in combination. However, these materials are not limited thereto.

In order to adjust resistance, each of the base layer 310, the elastic layer 311, and the surface coating layer 312 may be formed of metal powder, such as carbon black, graphite, aluminum, and nickel, or conductive metal oxides. However, these materials are not limited thereto.

Figure 3A:
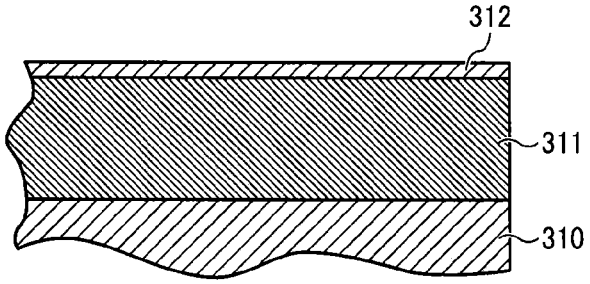
FIGS. 3A, 3B, and 3C are illustrations of an image bearer formed into an endless loop.
Figure 3B:
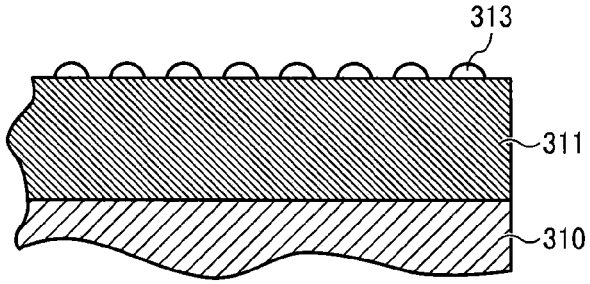
Figure 3C:
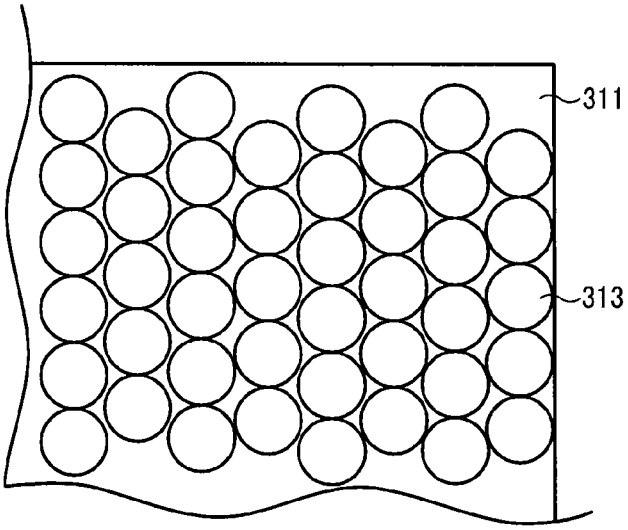

A lubricant may be applied to the front surface 31*a* of the intermediate transfer belt 31 to protect the front surface 31*a* of the intermediate transfer belt 31 depending on the material of the toner and the intermediate transfer belt employed and the surface friction coefficient of the intermediate transfer belt 31. The materials of the lubricant includes zinc stéarate. A brush roller of a lubricant applicator contacts and scrapes a block (solid) luburicant, such as a block of zinc stearate, while rotating. The lubricant in powder form thus obtained is applied to the surface 31*a* of the intermediate transfer belt 31. In some embodiments, a belt including a laminate of the base layer 310 and the elastic layer 311 with a large numbers of particles 313 dispersed in the elastic layer 311 can be used as the intermediate transfer belt 31, as illustrated in FIG. 3B. While a portion of the particles 313 projects from the elastic layer 311, the particles 313 are arranged concentratedly in a belt surface direction as illustrated in FIG. 3C. With these particles 313, an uneven surface of the belt with multiple bumps is formed on the front surface 31*a* of the intermediate transfer belt 31.

The particles 313 to be dispersed in the elastic material of the elastic layer 311 are spherical resin particles having an average particle diameter of equal to or less than 100 μm and are insoluble in an organic solvent. Furthermore, the 3% thermal decomposition temperature of these resin particles is equal to or greater than 200° C. The resin material of the particle 313 is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle, the more preferred. Preferably, the volume average particle diameter of the particles 313 is in a range from 1.0 μm to 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than ±(Average particle diameter× 0.5 μm). With the particle diameter of the particle 313 less than 1.0 μm, enhancement of transferability by the particle 313 cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general, the particle 313 made of resin material has a relatively high insulation property. Thus, if the particle diameter is too large, accumulation of electrical charges of the particle diameter 313 during continuous printing causes image defect easily.

Either commercially-available products or laboratory-derived products may be used as the particle 313. The thus-obtained particle 313 is directly applied to the elastic layer 311 and evened out, thereby evenly distributing the particle 313 with ease. With this configuration, an overlap of the particles 313 in the belt thickness direction is reduced, if not prevented entirely. Preferably, the cross-sectional diameter of the plurality of particles 313 in the surface direction of the elastic layer 311 is as uniform as possible. More specifically, the distribution width thereof is equal to or less than ±(Average particle diameter×0.5 μm). For this reason, preferably, powder including particles with a small particle diameter distribution is used as the particles 313. If the particles 313 having a specific particle diameter can be applied to the elastic layer 311 selectively, it is possible to use particles having a relatively large particle diameter distribution. It is to be noted that timing at which the particles 313 are applied to the surface of the elastic layer 311 is not particularly limited. The particles 313 can be applied before or after crosslinking of the elastic material of the elastic layer 311.

Preferably, a projected area ratio of a portion of the elastic layer 311 having the particles 313 relative to the elastic layer 311 with its surface being exposed is equal to or greater than 60% in the surface direction of the elastic layer 311. In a case in which the projected area ratio is less than 60%, the frequency of direct contact between toner and the pure surface of the elastic layer 313 increases, thereby degrading transferability of toner, cleaning performance of the belt surface from which toner is removed, and filming resistance. In some embodiments, a belt without the particles 313 dispersed in the elastic layer 311 can be used as the intermediate transfer belt 31.

The intermediate transfer belt 31 is interposed between the primary transfer rollers 35Y, 35M, 35C, and 35K, and photoconductors 2Y, 2M, 2C, and 2K, thereby forming primary transfer nips serving as transfer sections for each color between the front surface or the image bearing surface of the intermediate transfer belt 31 and the photoconductors 2Y, 2M, 2C, and 2K. A primary transfer bias is applied to the primary transfer rollers 35Y, 35M, 35C, and 35K by a well-known transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K.

A yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electric field and the nip pressure. The intermediate transfer belt 31, on which the yellow toner image has been transferred, passes sequentially through the primary transfer nips of magenta, cyan, and black. Subsequently, a magenta toner image, a cyan toner image, and a black toner image on the photoconductors 2M, 2C, and 2K, respectively, are superimposed on the yellow toner image which has been transferred on the intermediate transfer belt 31, one atop the other in the primary transfer process. Accordingly, a composite toner image, in which the toner images of four different colors are superimposed on one atop the other, is formed on the surface of the intermediate transfer belt 31 in the primary transfer process. According to the present embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device. The present embodiment was described assuming that a full-color image, in which toner images of four different colors are superimposed one atop the other, is formed. Alternatively, a single-color toner image with any one of an yellow toner, a magenta toner, a cyan toner, and a black toner, or a toner image with at least two of these color toner may be formed to be transferred onto the intermediate transfer belt 31 in the primary image forming process.

Outside the loop formed by the intermediate transfer belt 31 serving as an image bearer, a secondary transfer unit 41 is disposed. The secondary transfer unit 41 includes a secondary transfer belt 404 as a secondary transfer device. The intermediate transfer belt 31 is interposed between the secondary-transfer back surface roller 33 and the secondary transfer roller 36, thereby forming a secondary transfer nip N at which the front surface 31*a* of the intermediate transfer belt 31 contacts the secondary transfer belt 404. A secondary transfer bias is applied to the secondary-transfer back surface roller 33 by a power source 39. With this configuration, a secondary-transfer electrical field is formed between the secondary-transfer back surface roller 33 and the secondary transfer belt 404 so that the toner having a negative polarity is moved electrostatically from the secondary-transfer back surface roller 33 to the secondary transfer belt 404. The first support assembly 40 detachably supports the secondary transfer unit 41. The secondary transfer unit 41 is replaceable independently. The secondary transfer unit 41 includes a secondary transfer roller 36 serving as a secondary transfer device disposed opposite to the secondary-transfer back surface roller 33 via the intermediate transfer belt 31. The secondary transfer unit 41 includes three rollers 401, 402, and 403, the secondary transfer roller 36, and the secondary transfer belt 404 looped around the three rollers 401, 402, and 403. The secondary transfer unit 41 is a belt conveyor unit in which the secondary transfer belt 404 is an endless looped belt serving as a transfer device, and is looped around the plurality of rollers, i.e., the secondary transfer roller 36, and the rollers 401, 402, and 403. The secondary transfer roller 36 can also be referred to as a nip forming roller.

The secondary transfer roller 36 secondarily transfers the toner image on the front surface 31*a* of the intermediate transfer belt 31 onto the recording medium P. The secondary transfer roller 36 is disposed inside the belt loop of the secondary transfer belt 404, facing the secondary-transfer back surface roller 33. The intermediate transfer belt 31 and the secondary transfer belt 404 are interposed between the secondary transfer roller 36 and the secondary-transfer back surface roller 33. The secondary transfer roller 36 is biased against the secondary transfer belt 404 so as to pressingly contact the intermediate transfer belt 31, thereby forming the secondary transfer nip N between the intermediate transfer belt 31 and the secondary transfer belt 404. The material for the secondary transfer belt 404 may be selected from resin, such as polyimide (PI) resin, polyamide imide (PAI) resin, and polyvinylidene (PVDF) resin. The secondary transfer belt 404 are not limited to those described above, but may employ a belt made of an elastic material. According to the present embodiment, a belt made of polyimide resin (PI), having a thickness of 80 μm is employed.

The roller 401 is to strip the recording medium P electrostatically attracted to the secondary transfer belt 404 from the secondary transfer belt 404 by self stripping. The roller 403 serves as a tension roller that presses the secondary transfer belt 404 from the inside of the loop of the secondary transfer belt 404 towards the outside by a tension spring 406 serving as a biasing device. It is to be noted that a cleaning blade 405 is disposed outside of the loop of the secondary transfer belt 404, contacting the roller 403 to remove toner with a cleaning blade 405 that contacts the front surface (outer circumferential surface) of the secondary transfer belt 404. Hence, the roller 403 serves as a cleaning blade opposed roller. In the secondary transfer unit 41, a pattern detector 407 serving as a density detector is disposed outside of the loop of the secondary transfer belt 404, facing the roller 402. The pattern detector 407 adjusts an image density. The secondary transfer unit 41 that employs a belt scheme has advantageous effects from the viewpoint of reliably separating the recording medium P from the intermediate transfer belt 31. This is because a greater attracting force from the secondary transfer belt 404 acts on the recording medium P than the intermediate transfer belt 31 when the recording medium P passes through the secondary transfer nip N. Therefore, the image forming device according to the present embodiment that employs the belt scheme accommodate a separation of thin paper as well. According to the present embodiment, a bias (a secondary transfer bias) is applied to the secondary-transfer back surface roller 33 or to the secondary transfer roller 36 from the power source 39. In a case in which the secondary transfer bias is applied to the secondary transfer roller 36, the secondary transfer bias having a polarity opposite that of the toner is applied thereto. In a case in which the secondary transfer bias is applied to the secondary-transfer back surface roller 33, the secondary transfer bias having the same polarity as that of the toner is applied thereto. In the present embodiment, the power source 39 outputs the secondary transfer bias to transfer a toner image onto the recording material P in the secondary transfer nip N. The secondary transfer bias, which is applied from the power source 39 to the secondary-transfer back surface roller 33, includes two types: a direct current and a superimposed bias in which an alternating current, that is, an alternating current component is superimposed on a direct current, that is, a direct current component. More particularly, the power source 39 alternates a voltage in a transfer direction to transfer a toner image from the image bearer side to the recording medium side and a voltage in a returning direction having a polarity opposite that of the voltage in the transfer direction when supplying a voltage to the secondary-transfer back surface roller 33 to transfer a toner image at least on the image bearer onto the recording medium P. In this case, the power source 39 applies the voltage in the returning direction during a time period longer than 50% of one cycle of the secondary transfer bias applied. A description is provided later of the secondary transfer bias according to an embodiment of the present disclosure.

As illustrated in FIG. 1, the paper cassette 60 storing a sheaf of recording media P, such as paper sheets and resin sheets, is disposed below the transfer unit 41. The paper cassette 60 is equipped with a feed roller 60*a* to contact the top sheet of recording media P in the paper cassette 60. As the feed roller 60*a* is rotated at a predetermined speed, the feed roller 60*a* picks up and sends the top sheet of the recording media P to a delivery path 65 formed between the paper cassette 60 and the secondary transfer nip N. Through the delivery path, a pair of conveyance rollers, a pair of registration rollers 61, and a lower guide 62 is disposed. The pair of registration rollers 61 starts to rotate again to feed the recording medium P, which has been fed from the paper cassette 60, to the secondary transfer nip N in appropriate timing such that the recording medium P is aligned with the composite toner image formed on the front surface 31*a* of the intermediate transfer belt 31 in the secondary transfer nip N.

In the secondary transfer nip N, the composite toner image on the intermediate transfer belt 31 is transferred onto the recording medium P by the secondary transfer electric field and the nip pressure applied thereto in the secondary transfer nip N, thereby forming a full color image on the front surface 31*a* of the white recording medium P. After the intermediate transfer belt 31 passes through the secondary transfer nip N, the toner residue not having been transferred onto the recording medium P remains on the intermediate transfer belt 31. The residual toner is removed from the intermediate transfer belt 31 by the belt cleaner 38 which contacts the front surface 31*a* of the intermediate transfer belt 31. The cleaning auxiliary roller 34 disposed inside the loop formed by the intermediate transfer belt 31 supports the cleaning operation performed by the belt cleaner 38.

The fixing device 90 is disposed downstream from the secondary transfer nip N in the direction b of conveyance of the recording sheet P. After the secondary transfer, the recording medium P, onto which the composite color toner image is transferred, is transported to the fixing device 90. The fixing device 90 includes a fixing roller 91 including a heat source inside thereof and a pressing roller 92. The fixing roller 91 and the pressing roller 92 contact to form the fixing nip where heat and pressure are applied. The composite toner image is softened and fixed on the recording medium P as the recording medium P passes through the fixing nip. After the toner image is fixed to the recording medium P, the recording medium P is output from the fixing device 90. Subsequently, the recording medium P is delivered outside the image forming apparatus 100.

According to the present embodiment, a bias (a secondary transfer bias) is applied to the secondary-transfer back surface roller 33 from the power source 39. According to the present embodiment, the secondary-transfer back surface roller 33, to which the power source 39 applies a bias, is sometimes called a repulsive roller because a transfer bias having a negative polarity is applied to a negative-charged toner so that the toner applied with the transfer bias is transferred with a repulsive force. The second transfer bias output from the power source 39 may be applied to the secondary transfer roller 36 instead of to the secondary-transfer back surface roller 33. In a case in which the secondary transfer bias is applied to the secondary transfer roller 36, the secondary transfer bias having a polarity opposite that of the toner is applied thereto. In a case in which the secondary transfer bias is applied to the secondary-transfer back surface roller 33, the secondary transfer bias having the same polarity as that of the toner is applied thereto.

While the secondary transfer bias is applied to the secondary-transfer back surface roller 33, an electrical discharge occurs between the front surface 31*a* of the intermediate transfer belt 31 entrained about and stretched taut around the secondary-transfer back surface roller 33 and the recording medium P entering a secondary transfer nip N where the secondary-transfer back surface roller 33 contacts the secondary transfer roller 36. Such an electrical discharge is referred to as a prenip electrical discharge. As illustrated in FIG. 4A, the secondary transfer roller 36 is not offset from a position, at which the secondary transfer roller 36 faces the secondary-transfer back surface roller 33, to the upstream side (i.e., the right side) in a direction b of conveyance of the recording medium. In this case, toward the right side of the entrance of the secondary transfer nip, a space S is formed between the intermediate transfer belt 31 and the recording medium P, thereby generating the electrical discharge in the space S. In contrast, referring to FIG. 4B, the secondary transfer roller 36 is offset to the upstream side in the direction b of conveyance of the recording medium. In this case, the recording medium P comes into contact with the intermediate transfer belt 31 before the recording medium P enters the secondary transfer nip N where a toner image on the intermediate transfer belt 31 is secondarily transferred onto the secondary transfer belt 404. With this configuration, the space S is small at a portion (the secondary transfer nip N) where the secondary transfer bias is applied to the secondary-transfer back surface roller 33 to generate a high electric field. Thus, the electrical discharge can be prevented in the space S. The present inventor's experiment has revealed the following: The likeliness of the occurrence of the prenip electrical discharge varies with the voltage applied to the secondary-transfer back surface roller 33; the resistances and materials of the intermediate transfer belt 31, the secondary-transfer back surface roller 33, the secondary transfer roller 36, and the secondary transfer belt 404; the type of the recording medium P; and conveyance conditions. Further, the prenip electrical discharge easily occurs on the intermediate transfer belt 31 made of an elastic material. Therefore, increasing the amount of offset of the secondary transfer roller 36 toward the upstream side in the direction b of conveyance of the recording medium prevents the electrical discharge in the secondary transfer nip N.

Figure 5A:
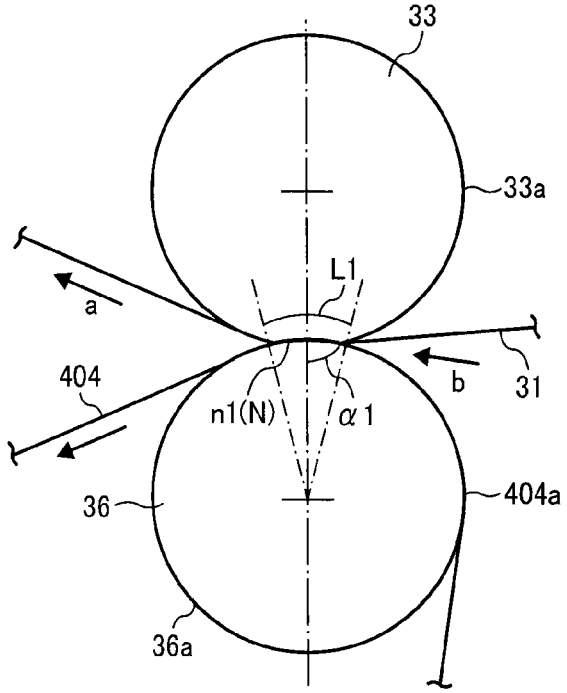
FIG. 5A is an illustration of a transfer nip.
Figure 5B:
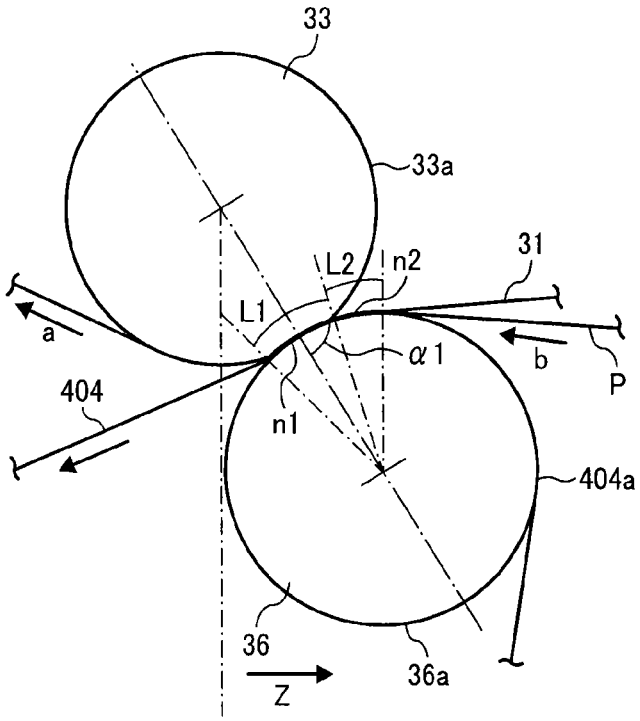
FIG. 5B is an illustration of a prenip.

Next, referring to FIGS. 5A and 5B, a description is provided of the secondary transfer nip according to the present embodiment. In FIG. 5A, the intermediate transfer belt 31 and the secondary transfer belt 404 are pressed between the secondary transfer roller 36 and the secondary-transfer back surface roller 33 with a constant pressure. In this case, the secondary transfer roller 36 is not offset. In FIG. 5B, the intermediate transfer belt 31 and the secondary transfer belt 404 are pressed between the secondary transfer roller 36 and the secondary-transfer back surface roller 33 with a constant pressure. In this case, the secondary transfer roller 36 is offset toward a direction indicated by arrow Z, that is, the upstream side in the direction of conveyance of the recording medium. Assuming that the distance between the center of the secondary-transfer back surface roller 33 and the center of the secondary transfer roller 36, and the manner in which the secondary transfer belt 404 is deformed by the rollers 33 and 36 are the same, the form of a nip is geometrically defined. As illustrated in FIGS. 5A and 5B, the lengths L1 of a nip n1 interposed between the secondary-transfer back surface roller 33 and the secondary transfer roller 36 are the same between FIG. 5A and FIG. 5B. The nip n1 is hereinafter referred to as a main nip n1. In the case of FIG. 5B with the roller 36 offset in the direction Z, a prenip n2 indicates a portion of the intermediate transfer belt 31 contacting only the circumferential surface 36*a* of the secondary transfer roller 36 via the secondary transfer belt 404. The length of the prenip n2 is the length L2. The presence of the prenip n2 is determined by an angle $\alpha$1 formed between a straight line connecting the shaft center of the secondary-transfer back surface roller 33 and the shaft center of the secondary transfer roller 36 and the direction of the intermediate transfer belt 31 stretched taut toward the upstream side of the main nip. The straight line is indicated by a broken line in the Figures. As illustrated in FIG. 5A, when the angle $\alpha$1 is greater than or equal to 90 degrees, the prenip n2 does not exist. In contrast, as illustrated in FIG. 5B, when the angle $\alpha$1 is less than 90 degree, the prenip n2 exists. In the present embodiment, the secondary transfer belt 404 is employed as a transfer device. In the case of the roller transfer method in which the secondary transfer roller 36 is used alone as the transfer device, the length L2 of a portion of the intermediate transfer belt 31, which is directly wound only around the circumferential surface 36*a* of the secondary transfer roller 36, corresponds to the prenip n2. When the secondary transfer roller 36 is not offset as in FIG. 5A, the width L of the secondary transfer nip N refers to the length L1 of the main nip n1. In contrast, when the secondary transfer roller 36 is offset as in FIG. 5B, the width L of the secondary transfer nip N refers to the sum of the length L1 of the main nip n1 and the length L2 of the prenip n2. In the configuration including the prenip n2, when the recording medium P is in the main nip n1 interposed between the secondary-transfer back surface roller 33 and the secondary transfer roller 36, the back surface of the recording medium P contacts the circumferential surface 36*a* of the secondary transfer roller 36 in the prenip n2. The front surface Pa of the recording medium P contacts the circumferential surface 33*a* of the secondary-transfer back surface roller 33 via the intermediate transfer belt 31 in the main nip n1. Accordingly, the transfer current of the secondary transfer bias flows spreading in the plane direction of the recording medium P (interface). In this case, the toner is more likely to be overcharged than the configuration without shifting the offset secondary transfer roller 36.

Figure 7:
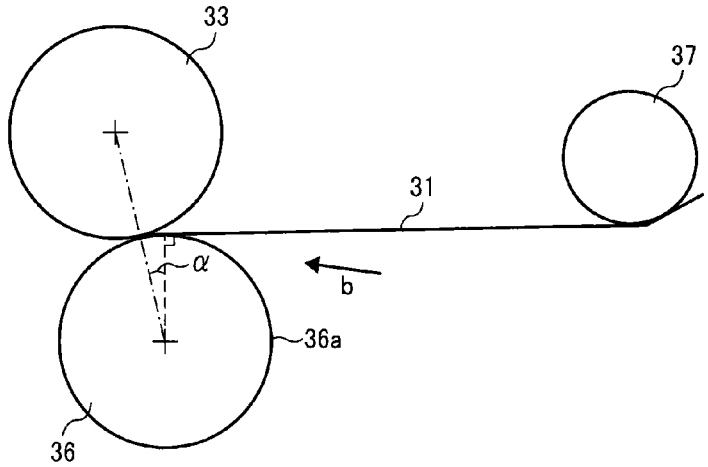
FIG. 7 is an illustration of the amount of prenip.

The electrical discharge in the upstream from the secondary transfer nip N in the direction b of conveyance of the recording medium and the degree of margin in the electrical discharge differ with the type of intermediate transfer belt 31. For example, FIG. 6 indicates test results regarding the presence of the prenip electrical discharge in different type of secondary transfer belts with the amount of offset of the secondary transfer roller 36 changed. It should be noted that the amount of prenip in FIG. 6 refers to the length of the front surface of the intermediate transfer belt 31 contacting only the secondary transfer belt 404 via the recording medium P. When factors, such as the hardness and the trajectory of the intermediate transfer belt 31 to the nip N, and the diameter of the secondary transfer roller, other than the position of the secondary transfer roller 36 are fixed, the amounts of offset correspond to the amounts of prenip, respectively. This is because the prenip is formed by shifting the secondary transfer roller. Now, a description is provided of the amount of prenip in the test of present disclosure referring to FIG. 7. FIG. 7 is a view of the secondary-transfer back surface roller 33, the secondary transfer roller 36, the intermediate transfer belt 31 made of an elastic material, and the pre-transfer roller 37. The angle $\alpha$ is formed between the broken line connecting the center of the secondary-transfer back surface roller 33 and the center of the secondary transfer roller 36 and the vertical line from the center of the secondary transfer roller 36 to the intermediate transfer belt 31. The amount of prenip is defined by $2\pi\times$(the radius of the secondary transfer roller 36)$\times\alpha/360$ degree. The term "prenip" refers to a portion, which is wound around the circumferential surface 36*a* of the secondary transfer roller 36, of the intermediate transfer belt 31. Accordingly, the amount of prenip varies with the diameter of the secondary transfer roller 36 and the trajectory of the intermediate transfer belt 31. With the variable factors fixed, the amount of prenip is determined by the amount of offset of the secondary transfer roller 36. In FIG. 6 indicating the relations between the amount of prenip and the electrical discharge, the amount of prenip varies with the changes in the amount of offset.

In FIG. 6, the degree of margin in the electrical discharge is determined by various factors: belt types, the amount of prenip, paper types, and the amount of the secondary transfer current. The belt has two types, such as an elastic belt and a polyimide (PI) belt. The amount of prenip is changed by shifting the secondary transfer roller 36 toward the upstream side in the direction of conveyance. Ordinary paper and thin paper are used. the amount of the secondary transfer current is changed as the secondary transfer bias. In FIG. 6, the term "GOOD" indicates that no image failure due to the electrical discharge was found. The term "FAIR" indicates that the electrical discharge slightly occurred. The term "POOR" indicates that image failure was easily found. According to FIG. 6, higher the secondary transfer current, higher the secondary transfer voltage. That is, as the secondary transfer current is high, the electrical discharge easily occurs. If no electrical discharge occurs in a wider range of current, that is, even when high secondary transfer current is applied, the degree of margin in the electrical discharge is high. In the present embodiment, to provide favorable transferability, the target current A1 is set −120 μA, at which it is necessary not to generate the electrical discharge. In view of the transferability, it is necessary that the amount of prenip in the elastic belt is greater than or equal to 4 mm, and greater than or equal to 2 mm in the PI belt. It should be noted that the test result (numerical values) indicated in FIG. 6 vary with the factors, such as the film thickness, hardness, and process linear velocity of belt, and the diameter of the secondary transfer roller. That is, a necessary amount of prenip varies with an image forming apparatus. When compared in the same configuration, the degree of margin in electrical discharge is higher than the PI belt does. The amount of the main nip n1, which is illustrated in FIGS. 5A and 5B, is typically set from 2 mm to 5 mm.

Figure 4B:
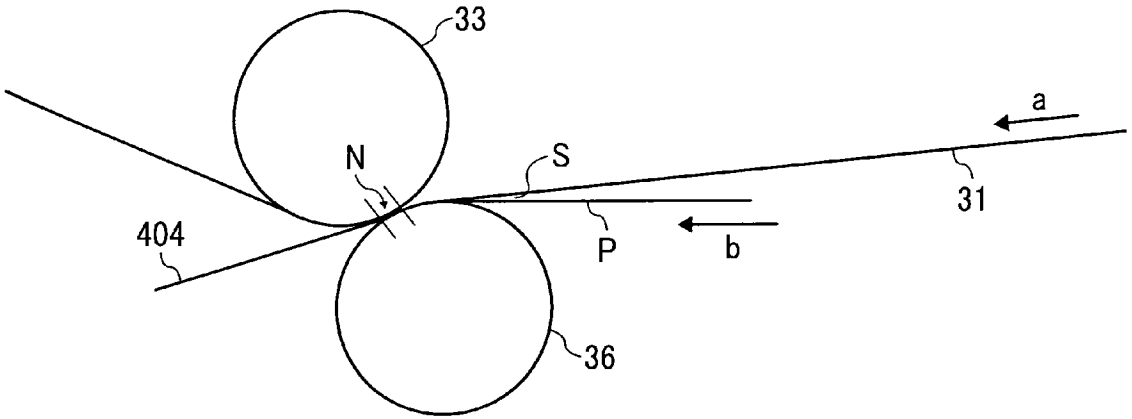

Next, a more detailed description is provided of the present embodiment. In the configuration of FIG. 7, the secondary-transfer back surface roller 33 and the secondary transfer roller 36 have the same diameters. The secondary transfer roller 36 has a hardness of 70 HS in accordance with Japanese Industrial Standards (JIS-A), and the secondary-transfer back surface roller 33 has 50° on Asker C hardness scale. When the secondary transfer roller 36 is harder, the intermediate transfer belt 31 favorably exhibits the property of rubber. However, the combination of hardness of the secondary transfer roller 36 and the secondary-transfer back surface roller 33 and the magnitude relation between the secondary transfer roller 36 and the secondary-transfer back surface roller 33 are not limited to those described above, and various numerical values and relations are available. Further, irrespective of the relation between the diameter of the secondary-transfer back surface roller 33 and that of the secondary transfer roller 36 and the magnitude relation of the rollers 33 and 36, the image forming apparatus according to the present embodiment exhibits advantageous effects. In the present embodiment, as illustrated in FIG. 7, the secondary transfer roller 36 is offset toward the upstream side in the direction b of conveyance of the recording medium, causing the recording medium P, which is advancing forward, to contact the intermediate transfer belt 31 at the upstream from the secondary transfer nip N. Accordingly, no space S as illustrated in FIG. 4B is formed between the intermediate transfer belt 31 and the recording medium P before the secondary transfer nip N, thereby preventing the electrical discharge. Now, a description is provided of the advantageous effects of the present embodiment from the viewpoint of the electric field. In the distribution of the transfer electric field, the strongest electric field is generated in the secondary transfer nip N, becoming weaker toward the upstream side in the direction of conveyance. When the recording medium P comes to contact with the intermediate transfer belt 31 at the strong electric field, with a space S between the recording medium P and the intermediate transfer belt 31 at the upstream of the strong electric field, the electrical discharge occurs in the space S. Therefore, contacting the recording medium P with the intermediate transfer belt 31 at the upstream side of the weak electric field (the nip N) prevents the electrical discharge. In the present embodiment, the secondary transfer bias is output from the power source 39 under constant current control to provide a constant transfer voltage (transfer electric field) irrespective of the resistances of the intermediate transfer belt 31 and the recording medium P.

Figure 8A:
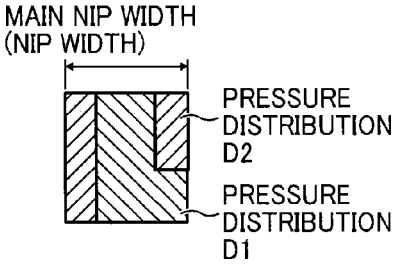
FIGS. 8A through 8D are illustrations of a process for measuring the amount of prenip.
Figure 8C:
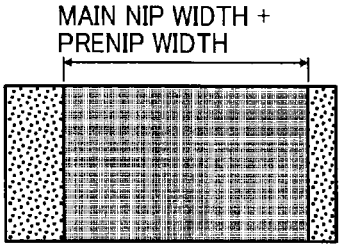
Figure 8B:
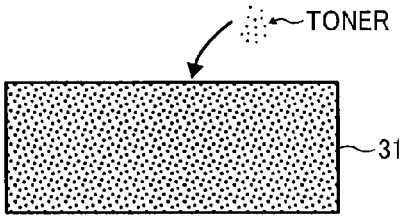
Figure 8D:
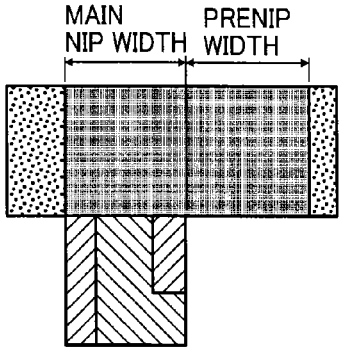

Next, a description is provided of different methods for measuring the amount of prenip with reference to FIGS. 8A through 8D and 9. In a method 1 for measuring the amount of prenip as illustrated in FIGS. 8A through 8D, the width of a main nip is first measured as illustrated in FIG. 8A. To measure the width of the main nip, a surface pressure sensor (i.e., I-SCAN (registered trademark), manufactured by Nitta Corporation) is used to specify a portion under pressure. More specifically, a pressure distribution D1 and a pressure distribution D2 indicated by differently hatched patterns are obtained, and the width of a portion under a pressure greater than a threshold is defined as the width of the main nip. Next, the width of the main nip and a prenip is measure as illustrated in FIG. 8B. In this measurement, toner is caused to be adhered onto the intermediate transfer belt 31 over a certain degree of width, e.g., approximately 10 mm which is sufficiently wider than the width of the secondary transfer nip N. Subsequently, a secondary transfer device is repeatedly moved to contact and separate from the intermediate transfer belt 31 with toner adhered onto. In the present embodiment, the secondary transfer unit 41 is moved to contact and separate from the secondary-transfer back surface roller 33. During such an operation, the secondary transfer unit 41 is drawn out to be cleaned as needed. After cleaned, the secondary transfer unit 41 is repeatedly moved again. When the secondary transfer roller 36 is used as the transfer device instead of the secondary transfer belt 404, the secondary transfer roller 36 is moved to contact and separate from the secondary-transfer back surface roller 33. Through such an operation of contact and separation, a portion of toner adhered onto the intermediate transfer belt 31 is repeatedly pressed by the secondary transfer device, so that the thickness of the portion becomes thin. This thin portion corresponds to a contact portion (the main nip and the prenip) where the secondary transfer device contacts the intermediate transfer belt 31. Referring to FIG. 8D, the width of the contact portion (the main nip and the prenip) is measured. Then, the width of the main nip is subtracted from this measured width to obtain the width of the prenip, which is the amount of the prenip.

Figure 9A:
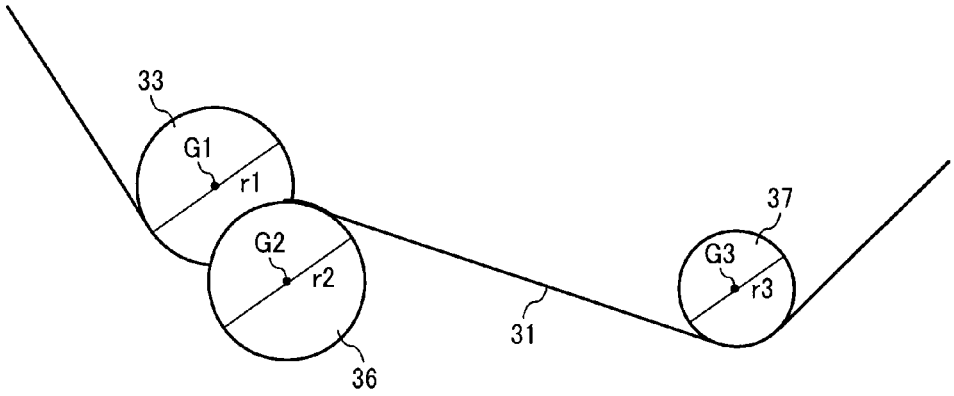
FIGS. 9A and 9B are illustrations of another process for measuring the amount of prenip.
Figure 9B:
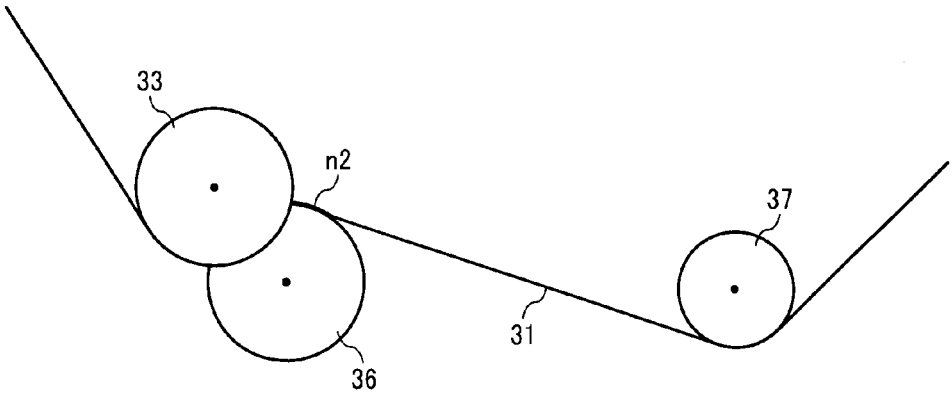

In a method 2 of FIGS. 9A and 9B, the coordinates of the shaft centers G1, G2, and G3 are first specified as illustrated in FIG. 9A. G1, G2, and G3 are the shaft centers of the secondary transfer roller 36, the secondary-transfer back surface roller 33, and the pre-transfer roller 37, respectively. Then, the outer diameters r1 and r2 and hardnesses of the secondary transfer roller 36 and the secondary-transfer back surface roller 33, and the outer diameter r3 of the pre-transfer roller 37 are measured. Subsequently, the three rollers 33, 36, and 37 are outlined as illustrated in FIG. 9B. In this case, based on the measured hardnesses of the rollers 33 and 36, it is assumed that only either one having a lower hardness is deformed. Referring to the outline, a portion of the intermediate transfer belt 31 is wound around only the secondary transfer roller 36. This portion is defined as a prenip n2. Using the two methods as described above can specify the prenip n2. It should be noted that the prenip refers to a portion in which the secondary-transfer back surface roller 33 and the secondary transfer roller 36 do not contact with each other, and an image bearer formed into a belt (the intermediate transfer belt 31) is wound around only the circumferential surface 36*a* of the secondary transfer roller 36 via the secondary transfer belt 404. The length of this portion is approximately 2 to 5 mm. This length of the portion is referred to as the amount of the prenip. The secondary-transfer back surface roller 33 and the secondary transfer roller 36 contact with each other to form a nip (which is referred to as a main nip). The length (amount) of the nip is approximately 2 to 5 mm.

Embodiment 1

Figure 12A:
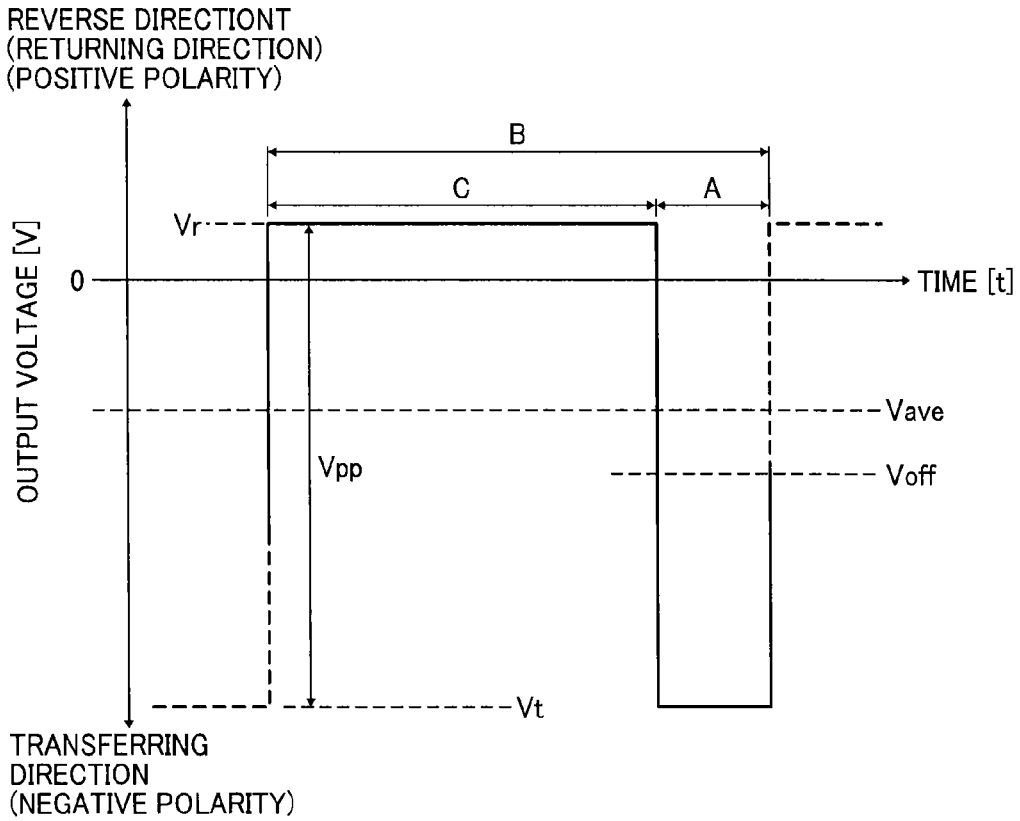
FIG. 12A is a graph of an example of an ideal waveform of a bias with a high duty output from a power source according to an embodiment of the present disclosure.

As described above, forming a prenip n2 prevents an electrical discharge. However, forming the prenip n2 leads to an increase in the total amount of a secondary transfer nip N as illustrated in FIG. 5B, which causes a transfer current to laterally flow along the surface of the recording medium P toward the secondary transfer roller 36 that is grounded. This may overcharge toner, resulting in a transfer failure during the secondary transfer. Therefore, in the present embodiment, a power source 39 applies a superimposed bias, in which an alternating voltage, that is, an alternating current component is superimposed on a direct voltage, that is, a direct current component, to a secondary-transfer back surface roller 33, as a secondary transfer bias. The power source 39 further applies the secondary transfer bias having a waveform with a high duty. In the present embodiment, a high-duty bias refers to a bias with a duty of 50% or greater. Referring to FIG. 12A, in a waveform with a high duty, a duration A of a peak voltage Vt (a transfer direction) that transfers a toner image from an intermediate transfer belt 31 (an image bearer) side to a recording medium P side is less than 50% in one cycle of the alternating voltage applied. Further, a duration C of a voltage smaller than the peak voltage Vt or of a peak voltage Vr (the opposite direction from the transfer direction), whose polarity is opposite to that of the peak voltage Vt is greater than 50% in the one cycle of the alternating voltage applied. Thus, while applying the peak voltage Vt to transfer toner onto the recording medium P, the power source 39 applies the voltage smaller than the peak voltage Vt or the peak voltage Vr having a opposite polarity from that of the peak voltage Vt for a longer period of time than the peak voltage Vt does. This configuration prevents the toner from being overcharged while the toner image passes through the secondary transfer nip N.

Figure 10:
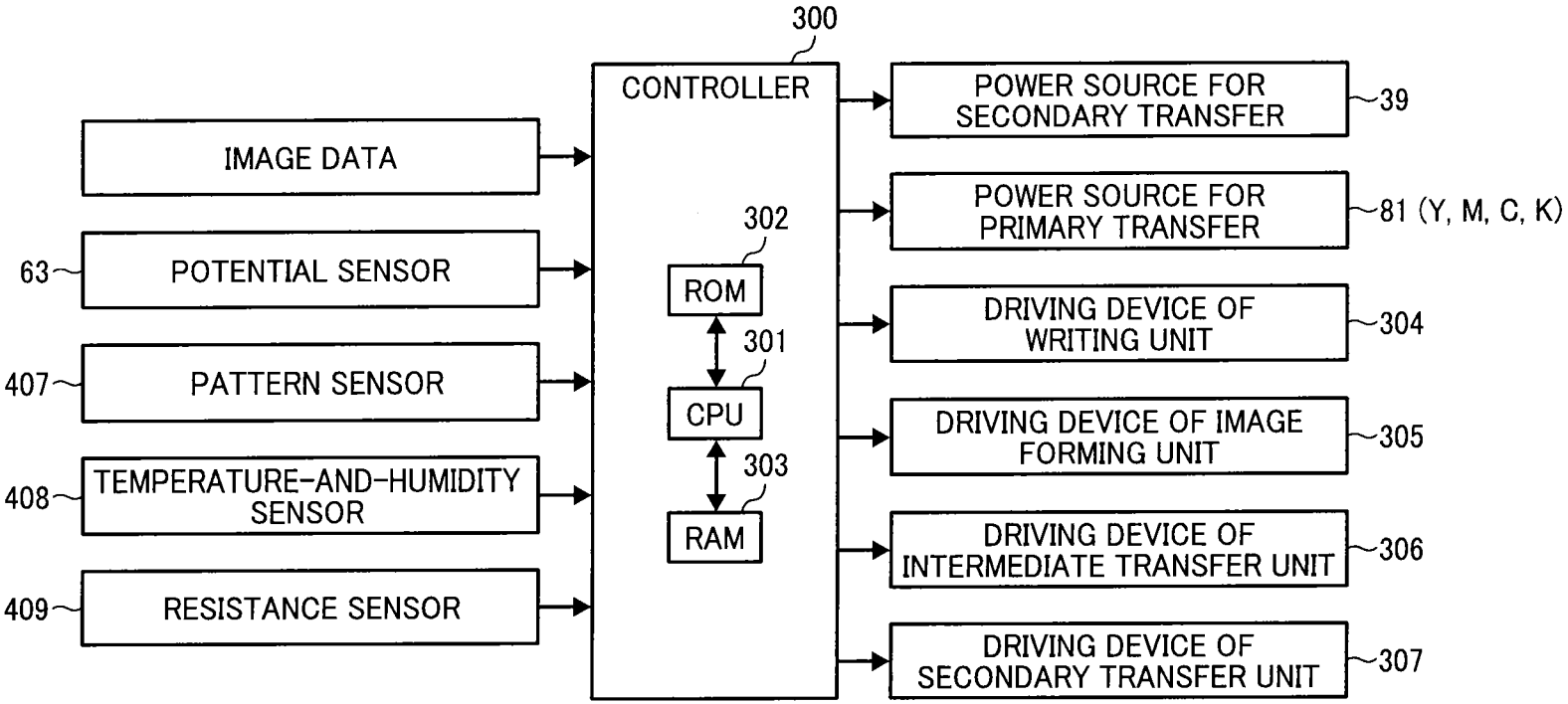
FIG. 10 is a block diagram of a control system according to an embodiment of the present disclosure.
Figure 11:
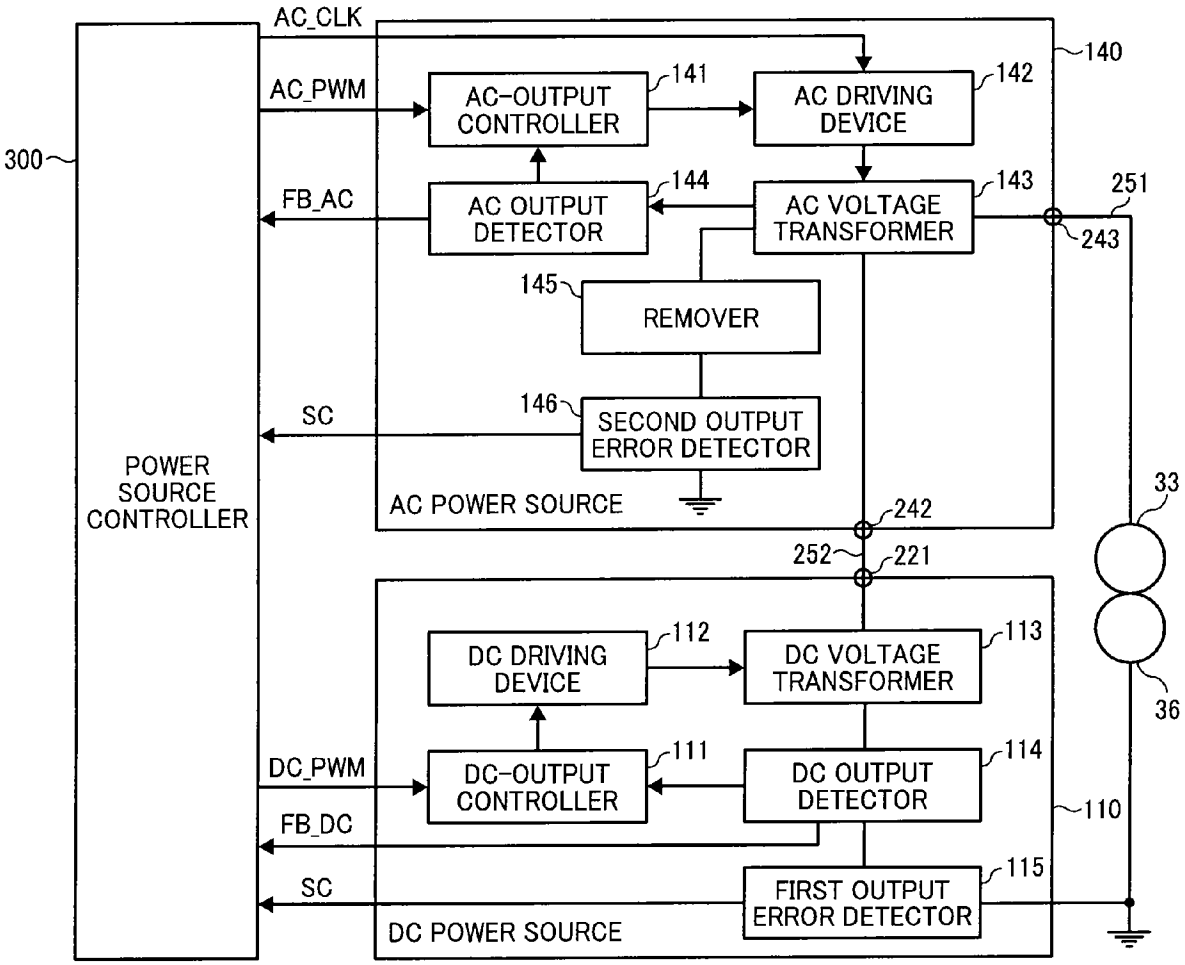
FIG. 11 is a block diagram of a part of an electric circuit of a power source and constitutional elements according to an embodiment of the present disclosure.

Next, a description is provided of the image forming apparatus 100, referring to FIGS. 10 and 11. As illustrated in FIG. 10, a controller 300 includes a central processing unit (CPU) 301 serving as a computing device, a read only memory (ROM) 302 serving as a nonvolatile memory, and a random access memory (RAM) 303 serving as a temporary storage device. The controller 300 typically includes various constitutional components and sensors communicably connected thereto via signal lines to control the entirety of the image forming apparatus. FIG. 10 merely illustrates representative components and sensors of the image forming apparatus 100. It should be noted that FIG. 10 also illustrates the components and sensors employed in the present embodiments, and the components and sensors serve as the controller 300.

The controller 300 includes a potential sensor 63, a pattern sensor 407, and a temperature-and-humidity sensor 408 serving as a temperature-and-humidity detector, which are connected to each other via signal lines, on an input side. The controller further includes a power source 39 for secondary transfer, power sources for primary transfer 81Y, 81M, 81C, and 81K for the colors yellow, magenta, cyan, and black, a driving device 304 of a writing unit, a driving device 305 of an image forming unit, a driving device 306 of an intermediate transfer unit, and a driving device 307 of a secondary transfer unit, which are connected to each other via signal lines, on an output side. The power sources for primary transfer 81Y, 81M, 81C, and 81K apply a primary transfer bias to primary transfer rollers 35Y, 35M, 35C, and 35K. The power source 39 applies a secondary transfer bias to a secondary-transfer back surface roller 33. The controller 300 controls the output from the power source 39. Alternatively, in some embodiments, another controller 300 controls the output of the power source 39, independently of the controller that controls the entirety of the image forming apparatus.

The controller 300 of the image forming apparatus 100 includes an image adjustment mode to adjust the density of an image density. The controller 300 compares the value detected by the potential sensor 63 with a predetermined value to determine whether it is an image adjustment timing. When the detection value is less than the predetermined value, an affirmative determination is made to initiate the image adjustment mode. In the present embodiment, the image forming apparatus 100 includes an image adjustment mode to adjust image formation conditions. In the image forming apparatus 100, to adjust the image formation conditions with the image adjustment mode, a developing bias and a charging bias are changed to form a test pattern with toner, known as a density adjustment pattern. Then, the formed test pattern is transferred onto the secondary transfer belt 404, and the density of the test pattern is detected by the pattern sensor 407. The detected result (value) is used to adjust the image formation conditions. These operations are performed by the controller 300. According to the present embodiment, the density of the test pattern is detected on the secondary transfer belt 404. Alternatively, in some embodiment, the density is detected on the intermediate transfer belt 31. In response to the initiation of the image adjustment mode, the controller 300 drives the driving device 304 of the writing unit and the driving device 305 of the image forming unit so as to form test patterns on the respective photoconductors. Subsequently, the controller 300 drives the power sources 81Y, 81M, 81C, and 81K for primary transfer and a motor of the intermediate transfer unit to transfer the test patterns (toner images) onto the intermediate transfer belt 31. The controller 300 also drives the power source 39 for secondary transfer and the driving device 307 of the secondary transfer unit to transfer the test patterns from intermediate transfer belt 31 onto the secondary transfer belt 404.

FIG. 11 is a block diagram illustrating a main portion of an electrical circuit of a secondary transfer power source together with a secondary-transfer back surface roller 33 and a secondary transfer roller 36. The power source 39 includes a direct current power source (hereinafter, referred to as a DC power source) 110 and an alternating current power source (hereinafter, referred to as an AC power source) 140. The power source 39 is connected with a controller 300 to control the output from the power source 39. In some embodiments, the power source 39 includes another controller. The DC power source 110 outputs a DC voltage to apply an electrostatic force to toner on the front surface 31*a* of the intermediate transfer belt 31 so that the toner moves from the belt side to the recording sheet P side in the secondary transfer nip N. The DC power source 110 includes a DC output controller 111, a DC driving device 112, a DC voltage transformer 113, a DC output detector 114, a first output error detector 115, an electrical connector 221, and so forth. The AC power source 140 outputs an AC voltage to form an alternating electric field in the secondary transfer nip N. The AC power source 140 includes an AC output controller 141, an AC driving device 142, an AC voltage transformer 143, an AC output detector 144, a remover 145, a second output error detector 146, electrical connectors 242 and 243, and so forth.

The controller 300 inputs an DC_PWM signal and an output value of the DC voltage transformer 113 detected by the DC output detector 114 to the DC output controller 111. The DC_PWM signal controls an output level of the DC voltage. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer back surface roller 33 are electrically connected by a harness 251 so that the DC voltage transformer 113 outputs (applies) a DC voltage to the secondary-transfer back surface roller 33 via the harness 251. In a case in which the AC power source 140 is connected, the electrical connector 221 and the electrical connector 242 are electrically connected by a harness 252 so that the DC voltage transformer 113 outputs a DC voltage to the AC power source 140 via the harness 252.

The DC output detector 114 detects and outputs an output value of the DC high voltage from the DC voltage transformer 113 to the DC output controller 111. The DC output detector 114 outputs the detected output value as a FB_DC signal (feedback signal) to the power source controller 300 to control the duty of the DC_PWM signal in the power source controller 300 so as not to impair transferability due to environment and load. Thus, an impedance in the output path of the high voltage output is different between when the AC power source 140 is connected and when the AC power source 140 is not connected because the AC power source 140 is removably attached to the body of the power source 39. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer back surface roller 33 varies, causing the transferability to vary depending on the presence of the AC power source 140.

In view of the above, according to the present embodiment, the DC power source 110 outputs the DC voltage under constant current control, and the output voltage is changed depending on the presence of the AC power source 140. With this configuration, even when the impedance in the output path changes, the high voltage to be applied to the secondary-transfer back surface roller 33 is kept constant, thereby maintaining reliably the transferability irrespective of the presence of the AC power source 140. Furthermore, the AC power source 140 can be detached and attached without changing the DC_PWM signal value. According to the present embodiment, the DC power source 110 is under constant-current control. Alternatively, in some embodiments, the DC power source 110 can be under constant voltage control as long as the high voltage to be applied to the secondary-transfer back surface roller 33 is kept constant by changing the DC_PWM signal value upon detachment and attachment of the AC power source 140 or the like. The first output error detector 115 is disposed on an output line of the DC power source 110. When an output error occurs due to a ground fault or other problems in an electrical system, the first output error detector 115 outputs an SC signal indicating the output error, such as leakage. With this configuration, the power source controller 300 can stop the DC power source 110 to output the high voltage.

The power source controller 300 inputs an AC_PWM signal and an output value of the AC voltage transformer 143 detected by the AC output detector 144 to the AC output controller 141. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal. An AC_CLK signal to control the output frequency of the AC voltage is input to the AC driving device 142. The AC driving device 142 drives the AC voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer back surface roller 33 are electrically connected by the harness 251, the AC voltage transformer 143 outputs (applies) the thus-obtained superimposed voltage to the secondary-transfer back surface roller 33 via the harness 251. In a case in which the AC voltage transformer 143 does not generate the AC voltage, the AC voltage transformer 143 outputs (applies) the DC high voltage output from the DC voltage transformer 113 to the secondary-transfer back surface roller 33 via the harness 251. Subsequently, the voltage (the superimposed voltage or the DC voltage) provided to the secondary-transfer back surface roller 33 returns to the DC power source 110 via the secondary transfer roller 36. The AC output detector 144 detects and outputs an output value of the AC voltage from the AC voltage transformer 143 to the AC output controller 141. The AC output detector 144 outputs the detected output value as a FB_AC signal (feedback signal) to the power source controller 300 to control the duty of the AC_PWM signal in the power source controller 300 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) is either a sine wave or a square wave. The AC voltage having a short-pulse square wave can enhance image quality.

Figure 12B:
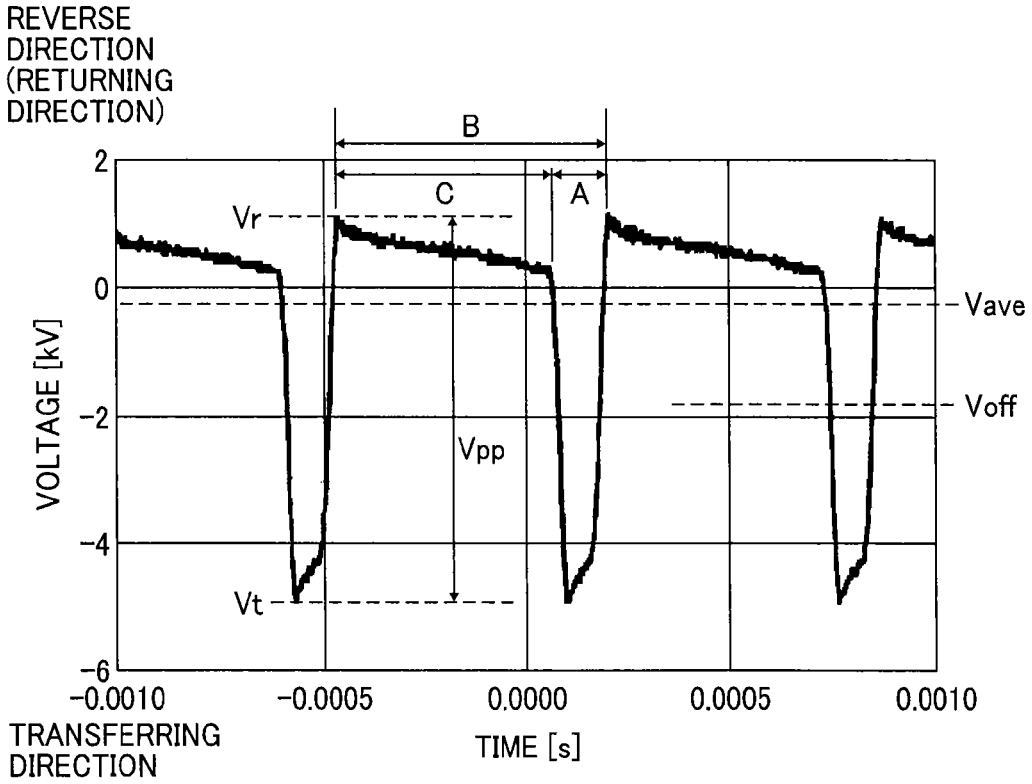
FIG. 12B is a graph of an example of an actual waveform of the bias with a high duty of FIG. 12A.

A description is provided later of the secondary transfer bias according to an embodiment of the present disclosure. FIGS. 12A and 12B are waveform charts showing a waveform of a secondary transfer bias output from the power source 39 according to an embodiment of the present disclosure. To transfer a toner image onto the recording medium P, a constant amount of voltage is applied to the secondary transfer nip N. However, continuing to apply the voltage leads to overcharging of toner, which generates transfer failure. FIG. 12A illustrates an ideal waveform for transferring a halftone image output. In the waveform of FIG. 12A, a requisite amount of voltage with a high duty greater than 50% is applied as the secondary transfer bias, so that a duration of the applied voltage is short and the overcharge of toner is prevented. The symbols in FIG. 12A are as follows: Vr is a peak value of a positive voltage (a peak value of a voltage having an opposite polarity/a peak value of a voltage in a returning direction); Vt is a peak value of a negative voltage (a peak value of a voltage in a transfer direction); Voff (a peak-to-peak value) is (Vr+Vt)/2; Vpp is Vr−Vt; Vave is Vr×Duty/100+Vt×(1−Duty)/100; A is a duration of Vt; B is a time period of one cycle of voltage waveform; Duty is (B−A)/B×100%; and C is a duration of Vr. The term "duty" refers to a ratio of a duration of Vt (a time period of voltage applied in the transfer direction) to a duration of Vr (a time period of voltage in the returning direction) in one cycle of an alternating voltage waveform. When a ratio of a value obtained by subtracting A from B with respect to B is greater (higher) than 50%, or C is greater than A by 50% it is called a high duty. FIG. 12 B illustrates a waveform of a voltage actually applied to obtain the ideal waveform of FIG. 12 A. The conditions for the alternating voltage applied are as follows: Vt is −4.8 kV; Vr is 1.2 kV; Voff is −1.8 kV; Vave is 0.08 kV; Vpp is 6.0 kV; a duration A of Vt peak is 0.10 ms; a cycle B of a waveform is 0.66 ms; and Duty is 85%. That is, when the secondary transfer bias has the positive-polarity peak value Vt, electrostatic migration of the toner from the intermediate transfer belt 31 side to the recording medium P side is inhibited. When the secondary transfer bias has the negative-polarity peak value Vt, electrostatic migration of the toner from the intermediate transfer belt 31 side to the recording sheet P side is accelerated. That is, the duty is greater than 50%. With such a secondary transfer bias, the time period, during which electrical charges having the positive polarity opposite to the normal charging polarity of the toner may possibly be injected to the toner in the cycle T, is shortened. Accordingly, inadequate image density caused by a decrease in the transferability due to a reduction in the tone charge amount can be suppressed, if not prevented entirely.

Figure 13A:
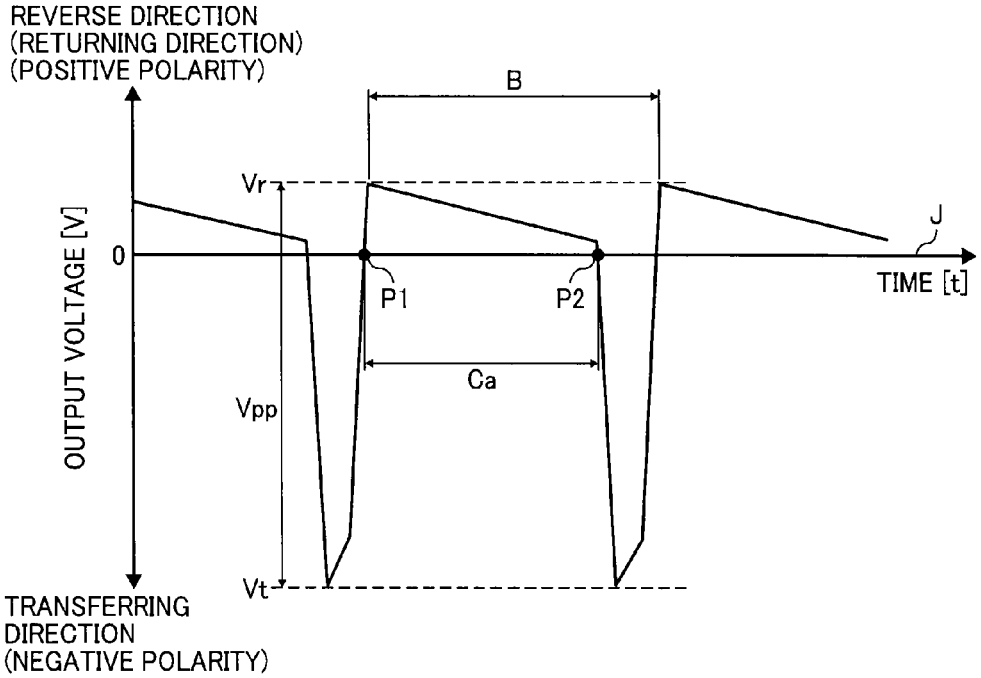
FIGS. 13A through 13C are schematic graphs of the waveform of FIG. 12A to describe a duty.
Figure 13B:
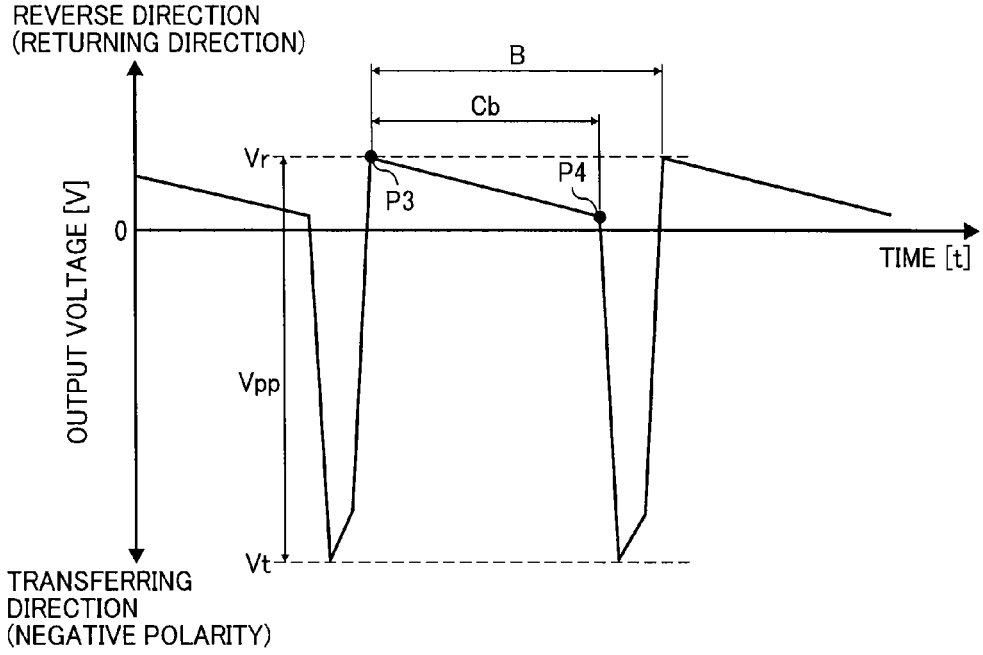
Figure 13C:
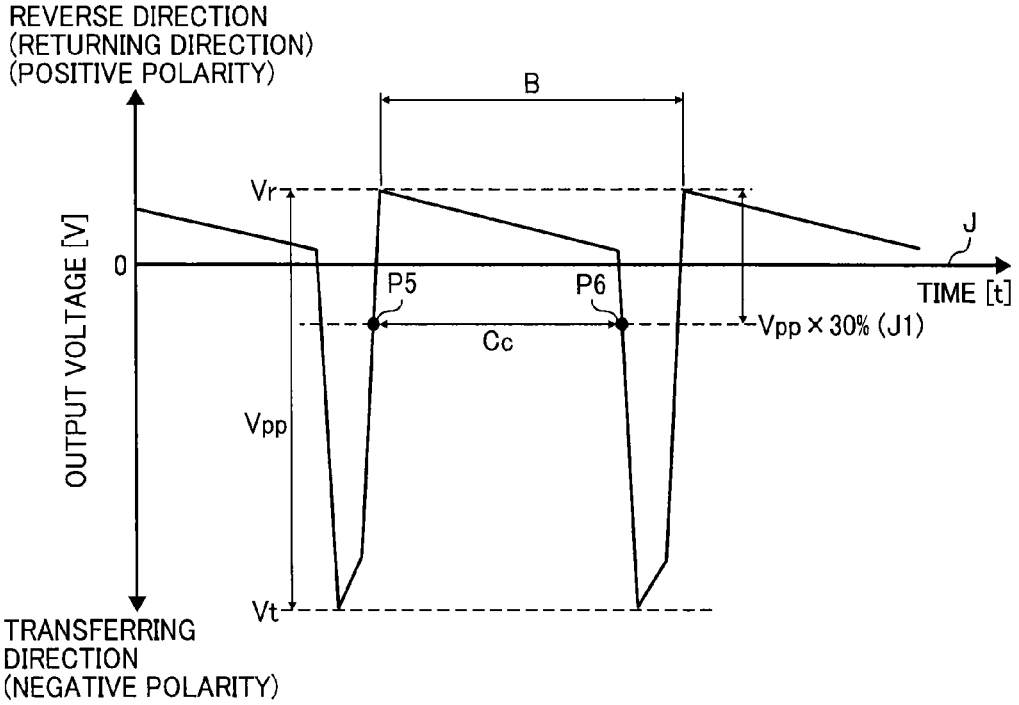

As described above, the secondary transfer bias includes the bias in a transfer direction that transfers a toner image from the image bearer side onto the recording medium side and the AC bias that clinically alternates between the transfer directional bias and the reverse directional bias. Further, a ratio of a time period of application of the reverse directional bias with respect to one cycle of the secondary transfer bias applied is defined as a duty. A bias with a duty greater than 50% is defined as a high-duty bias. FIGS. 13A through 13C, and FIG. 12B are schematic graphs of waveforms. A description is provided of a duty referring to the Drawings. The alternating bias which is the AC component in the second transfer bias alternates between the bias that flows toward the transfer direction and the bias that flows toward the reverse direction of the transfer direction. In the present embodiment, the bias that flows toward the "transfer direction" refers to a transfer directional bias in the transfer direction, having a negative polarity, and the bias that flows toward the "reverse direction" refers to a reverse directional bias in the reverse direction of the transfer direction, having a positive polarity. The transfer directional bias in the transfer direction and the reverse directional bias in the reverse direction have different polarities from each other across a polarity switching baseline J, at which the voltage is 0 V. The time period, during which the reverse directional bias is applied within one cycle, refers to a time period Ca from P1 to P2, during which the bias having a positive polarity (i.e. a polarity to move toner from the secondary transfer belt 404 to the intermediate transfer belt 31) is applied, as illustrated in FIG. 13A. Referring to FIG. 13B, the time period, during which the reverse directional bias is applied within one cycle, refers to a time period Cb from P3 to P4. P3 is when the bias reaches the peak voltage Vr in the reverse direction, and P4 is when the bias starts to rise toward the peak voltage Vt in the transfer direction. Referring to FIG. 13C, the time period, during which the reverse directional bias is applied within one cycle, is a time period Cc from P5 to P6, during which the reverse directional bias side of a baseline J1 is applied. This baseline J1 refers to a line which is shifted from a line of the peak voltage Vr in the reverse direction toward a line of the peak voltage Vt in the transfer direction by an amount of 30% of Vpp.

Next, a description is provided of experiments performed by the present inventors. Test conditions are as follows:

Environment condition: 27° C./80%;

Type of recording sheet: Coated sheet, i.e., Mohawk Color Copy Gloss 270 gsm (457 mm×305 mm);

Process linear velocity: 630 mm/s;

Output image: Black half tone; and

Width of secondary transfer nip; 4 mm.

In some embodiments, the secondary transfer bias as described above may be applied for the transferring of ordinary paper and recycled paper.

FIGS. 14A through 14E are schematic graphs of waveforms, and FIG. 15 indicates a test result. FIGS. 14A through 14E are conditions for the waveform of FIG. 12A, respectively illustrating images of waveforms output with a duty of 90%, 70%, 50%, 30%, and 10%. FIG. 15 indicates results of sensory evaluations on halftone images output with these waveforms. The images were rated as follows. The evaluations were graded on a five point scale of 1 to 5, in which higher grade, higher evaluation. That is, grade 5 indicates that the density of a halftone test image was adequate. Grade 4 indicates that the density was slightly lower than that of Grade 5, but the density was good enough so as not to cause a problem. Grade 3 indicates that the density was lower than that of Grade 4, and desired image quality to satisfy users was not obtained. Grade 2 indicates that the density was slightly lower than that of Grade 3, and 1 indicates that the test image looked generally white or even whiter (less density). The acceptable image quality to satisfy users was 4 or above. According to the results of FIG. 15, with a duty of 90% and 70%, the image density was graded as Grade 5. With a duty of 50%, the image density was graded as Grade 3, and with 30% and 10%, graded as Grade 1.

As described for FIGS. 14A through 14E, with a low duty of 10% and 30%, a time period A of application of a negative voltage with a peak value is long, thereby overcharging the toner image, which degrades the transferability. In contrast, with a high duty of 70% and 90%, a time period A of application of a negative voltage with a peak value is short, thereby preventing the overcharge of the toner image, which upgrades the transferability. Further, reversing polarities of Vr and Vt in the waveforms reliably prevents the overcharge. This is because, in this configuration with crossing 0, even when the recording sheet P is charged the electric field is generated in a direction that prevents the injection of the charges. As described above, in the present embodiment, to prevent the prenip electrical discharge and transfer failure so as to provide favorable images, the secondary transfer roller 36 is caused to be offset toward the upstream side in direction of conveyance and the high-duty superimposed bias is employed as the secondary transfer bias. The high-duty bias refers to a bias with a duty greater than 50%, and more preferably greater than or equal to 70%.

The intermediate transfer belt 31 made of an elastic material can be employed as the elastic belt having particles 313 as illustrated in FIGS. 3B and 3C. As such an elastic belt with an upper most layer (i.e., the elastic layer 311) in which particles 313 are dispersed is used, a contact area of a belt surface with toner in the secondary transfer nip N is reduced. With this configuration, a contact area of the belt surface with the toner in the secondary transfer nip can be reduced, and hence the ability of separation of the toner from the belt surface can be enhanced. The transfer rate can be enhanced. However, when the secondary transfer current flows concentrically between the insulating particles 313 which are arranged regularly, the electrical charges having an opposite polarity get injected easily to the toner, which may overcharge the toner. As a result, even when the particles 313 are dispersed to enhance the transfer rate, the secondary transfer rate may decrease. In view of this, the secondary transfer bias with a high duty (with a duty greater than 50%) is applied to reliably enhance the secondary transfer rate by the particles 313.

As the particles 313, particles capable of getting oppositely charged to the normal charging polarity of the toner are employed. According to the present embodiment, the particles 313 are constituted of melamine resin particles having a positive charging property. With this configuration, electrical charges of the particles 313 suppress concentration of the secondary transfer current between the particles, hence further reducing the injection of opposite electrical charges to the toner. Alternatively, in some embodiments, particles having charge property of the same charge polarity as the normal charge polarity of the toner are used as the particles 313. For example, silicone resin particles having a negative charge property (i.e., Tospearl (registered trademark)) can be used.

Embodiment 2

In the present embodiment, to increase the degree of margin in discharge based on Embodiment 1, the secondary transfer bias is controlled as described below. In the configuration according to the second embodiment, an intermediate transfer belt 31 is made of an elastic belt, and a secondary transfer roller 36 according to the secondary transfer belt scheme is caused to be offset toward the upstream in a direction b of conveyance of a recording medium in the same manner as in the first embodiment. With this configuration, the degree of margin in a prenip electrical discharge increases as described above. Surely, the prenip electrical discharge is more likely to generate abnormal images as a larger amount of secondary transfer bias is applied. However, even if the electrical discharge occurs, abnormal images do not easily generate because toner having a large amount of electric charge conveys the electric charge by it's own or sufficiently adheres onto the intermediate transfer belt 31. Alternatively, for generating multicolor toner images including a large total amount of toner, the electrical discharge does not easily occur with the degree of margin in the electrical discharge. Further, the degree of margin in the electrical discharge depends on the properties of toner. For example, higher the resistance of toner, higher the degree of margin in the electrical discharge. In contrast, when the resistance of toner is lower, or conductive materials having a low resistance is used, the abnormal images are easily generated. For example, carbon black is often used as colorants of black toner. As carbon black contains the conductive materials, the resistance thereof is more likely to reduce. Even without the reduced resistance, in some cases, the degree of margin in the electrical discharge for the black color decreases as compared to the other colors.

In the present embodiment, to increase the degree of margin in the electrical discharge more than in Embodiment 1, the secondary transfer bias is controlled according to an image area ratio W. FIG. 16 is a table of relations between an image area ratio W and a transfer current of the secondary transfer bias. In the present embodiment, the image area ratio W is computed by a CPU 301 of a controller 300. For the obtained image area ratio W, a value of the secondary transfer current is corrected based on the values indicated by Table of FIG. 16. In this case, the secondary transfer current refers to a DC component included in the high-duty superimposed bias. Hereinafter, the secondary transfer current to be described below refers to the DC component. In the present embodiment, the secondary transfer current is output from the power source 39 under constant current control by the controller 300. More specifically, the controller 300 controls the target current of the power source 39 with a pulse width modulation (PWM) signal to output the secondary transfer current under constant current control. With the PWM signal varied according to the image area ratio W, the target current is controlled to be output under constant current control. In the present embodiment, the image area ratio W is computed at every 50 mm in a sub-scanning direction (a direction of rotation of the belt), and the transfer current is controlled for each obtained value based on the Table of FIG. 16. The values indicated in the Table of FIG. 16 are preliminarily stored in a read only memory (ROM) 302 of the controller 300, together with arithmetic expressions of the image area ratio W. Typically, narrower the computation interval, more reliable the obtained result. With an interval of 50 mm in the present embodiment, the obtained results are sufficiently reliable. Even with a wider interval, a certain degree of reliability is obtained.

FIG. 16 is further described in detail below. The image area ratio W defines a writable width in the width direction of the intermediate transfer belt 31. For example, an image area ratio of 100% refers to the writable width having a single-color solid printing over the entire surface. An image area ratio of 50% refers to the writable width printed at an interval of 1 dot. In a case of a multicolor composite image, ratios of the respective colors are merely added together. More specifically, in a case of a two-color composite image with a full solid printing, the image area ratio W is 200%. To print a full solid image with a single color, the controller 300 controls the power source 39 to output a transfer current of 100% as indicated in the Table of FIG. 16. The output of a transfer current of 100% refers to outputting a target current A1 as the reference current. For example, in this case, the target current A1 is −120 μA as indicated in FIG. 6. According to FIG. 16, when the image area ratio W is 5%, the ratio of the transfer current is 40%. That is, the value of transfer current, −48 μA is obtained by multiplying −120 μA by 40%. In short, in the present embodiment, the DC bias component is supplied under constant current control, and the target current A1 output under constant current control is adjusted according to an image area ratio. More specifically, as the image area ratio increases, a correction is made to increase the amount of the target current A. In contrast, as the image area ratio decreases, a correction is made to decrease the amount of the target current A decreases. The corrected target current A1 is output as the secondary transfer bias. Controlling the output of the power source 39 in such a manner as described above secures the transferability, increasing the degree of margin in the electrical discharge more than the first embodiment does. Preferably, the relations between the image area ratio W and the transfer current as indicated in FIG. 16 is formed for each image forming apparatus, and are not limited to the relations in FIG. 16. Alternatively, in some embodiments, the transfer current is controlled depending on colors of toner, in addition to a simple image area ratio. For example, if B toner needs less amount of current, a correction is made on the calculation of the image area ratio W to obtain an image area ratio of 80% with respect to a full solid image.

Embodiment 3

In the present embodiment, to optimize the transferability, securing the degree of margin in the electrical discharge based on the second embodiment, the environment conditions, such as temperature and humidity are detected, and a transfer current is corrected based on the detected temperature and humidity. FIG. 17 is a table for correction of the transfer current. The values indicated in the Table of FIG. 17 are preliminarily stored in the ROM 302 of the controller 300, together with formula 1. FIG. 17 indicates a correction factor for each absolute humidity. Additionally, the image forming apparatus according to the present embodiment includes a temperature-and-humidity sensor 408 serving as an environment information sensor, as illustrated in FIG. 10. The temperature and humidity sensor 408 is connected to the controller 300 via a signal line. The controller 300 detects a temperature-and-humidity based on the detection values output from the temperature and humidity sensor 408, and calculates the absolute humidity X by formula 1 (Teten's formula).

$$\text{Absolute Humidity}=217\times(6.11\times 10^{(7.5\times temperature/(temperature+237.3))})/(\text{temperature}+273.15\times\text{Relative Humidity}\times 0.01).$$

Then, a correction factor for each absolute humidity X is multiplied by a value of the secondary transfer current to output the adequate amount of the secondary transfer bias for the environment conditions, such as the temperature and humidity, thus securing the transferability. In the present embodiment, the values indicated in FIG. 17 are preliminarily set by considering combining the values with those for correction of resistance in the second embodiment. In the present embodiment, a correction is made on both the environment conditions and the resistance. With a correction of both the environment conditions and the resistance, more advantageous effects are obtain than either one of correction does.

In the present embodiment, as illustrated in FIG. 17, as the absolute humidity X is greater, less amount of the secondary transfer bias (the target current A) is output. This is because, when the humidity is higher, a charge amount of toner decreases, thereby reducing the requisite current. Further, that is also because, when the amount of the transfer current increases, tone is more likely to be discharged, thereby easily generating transfer failure. Therefore, the correction factors as indicated in the Table of FIG. 17 are used. In other words, the image forming apparatus 100 of the present embodiment includes the temperature-and-humidity sensor 408 to detect a temperature and humidity. The transfer bias includes the DC bias component that is supplied under constant current control. The DC bias is adjustable such that as the detection value from the temperature-and-humidity sensor 408 is higher, the amount of the target current A1 is corrected to be reduced, and that as the detection value of the temperature and humidity decreases, the amount of the target current A1 is corrected to be increased. The corrected value of the target current A1 is ultimately output as the secondary transfer bias. However, the values of the table for correction is preferably set according to the configuration of the image forming apparatus, and the correction factors for the respective absolute humidity X are not limited to those in FIG. 17. According to FIG. 17, when the absolute humidity X is higher than 18, a transfer current of 90% is output not from the viewpoint of the electrical discharge, but from the transferability. Thus, with the correction of the transfer bias from the viewpoint of both the electrical discharge and the transferability, a favorable transferability is exhibited on various type of recording media P.

Embodiment 4

Figure 18:
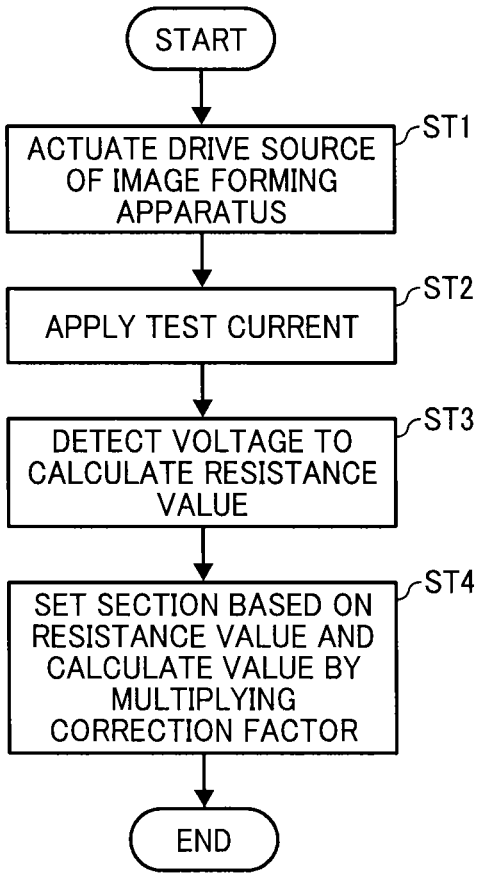
FIG. 18 is a flowchart of a process of detecting and correcting resistance value, which is performed by a controller, according to an embodiment of the present disclosure.
Figure 21:
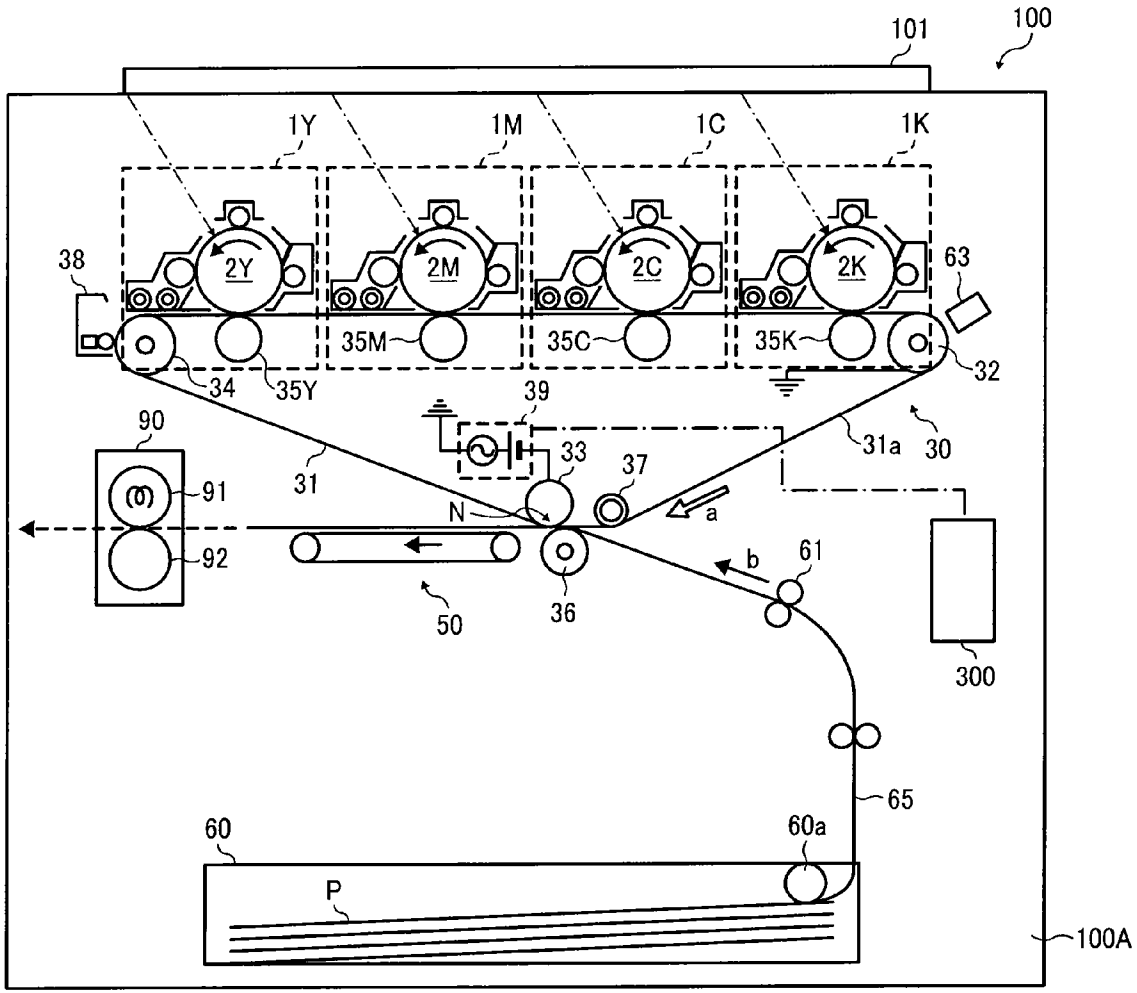
FIG. 21 is a schematic view of an image forming apparatus according to another embodiment of the present disclosure.

In the present embodiment, to increase the degree of margin in the electrical discharge more than in Embodiment 3, the value of resistance is detected in a secondary transfer nip N, and the secondary transfer bias is adjusted based on the detection value. In the present embodiment, a resistance sensor 409 serving as a resistance detector illustrated in FIG. 10 detects a value of resistance in the secondary transfer nip N. FIG. 18 is a schematic view of a resistance detection and correction process, and FIG. 19 is a determination table based on the detected resistance value. The table for determination includes five sections for the ranges of resistance values (voltage). The table of FIG. 19 also includes four types of ranges of the absolute humidity X. These values are set depending on the environment conditions under which the detection is made because the resistance values of devices vary with the environment conditions. Independently of the direct current applied for detection, the conditions for the DC component of the secondary transfer bias (the superimposed bias) is varied. FIG. 20 is a table indicating correction factors corresponding to the respective sections (voltage sections) selected from the resistance values obtained by the process in FIG. 18. The values indicated in the Table of FIG. 20 are preliminarily stored in the ROM 302 of the controller 300, together with the determination table in FIG. 19.

Next, a description is provided of a process of detecting resistance values and a process of determining correction sections by the controller 300. The controller 300 performs both the process of detecting resistance value and the process of determining the correction sections. The controller actuates a drive source of the image forming apparatus 100 in step ST1. In this case, only a driving device 306 of the intermediate transfer unit 30 and a driving device 307 of the secondary transfer unit 41 may be driven to rotate. After the driving device 306 and the driving device 307 reliably rotate, the controller 300 drives a power source 39 to apply a test current to a secondary-transfer back surface roller 33 in step ST2. In this case, the test current is a predetermined amount of current (hereinafter, referred to as a test current) for detecting the resistance, and any amount of current may be applied. In addition, the amount of the test current may be changed as appropriate according to the environment conditions and other factors. The test current may be either the AC bias or the DC bias. In a case of using the alternating bias as the test current, a sequence is provided to obtain an effective value and impedance. In contrast, when the DC bias is applied, a resistance value is obtain by dividing a voltage with an output current. That is, the resistance value is easily obtained by the voltage being fed back. Therefore, in the present embodiment, the DC bias is applied to the secondary-transfer back surface roller 33 as the test current. Further, in the present embodiment, the value of the test current is 120 μA which is common in every environment condition.

Then, after the test current is applied, the controller 300 waits for a predetermined period of time, e.g., 200 msec elapses before proceeding to step ST3. The controller 300 waits until the test current reliably flows, which needs the predetermined period of time. The controller 300 detects a voltage in step ST3. For example, the controller 300 samples a voltage for 200 msec in a cycle of 20 msec, by which 21 samples are taken. The obtained 21 samples are averaged out to obtain the average value. The obtained average value is defined as the average voltage. Then, a resistance value in the secondary transfer nip is calculated from the average value and the value of the output current. The controller 300 selects a section from the sections in the table of FIG. 19 based on the calculated resistance value in step ST4. In each section, the ranges of the value of the secondary transfer bias (the target current A1) are set according to the absolute humidity X. The controller 300 controls the secondary transfer bias (the target current A1) based on the determination criteria of the absolute humidity X of the section selected in step ST4. The operating time for the process of detecting and correcting resistance in FIG. 18 can be shortened if the process is carried out during the standby operation of the image forming apparatus 100 switched on or during rotation when starting image formation. In the present embodiment, the resistance value is obtained from the average voltage. Alternatively, sections 1 through 5 may be preliminarily set based on the voltage data and the value of the test current, and any one section is selected from the preliminarily set sections according to the table of FIG. 19. That is, a section can be selected without obtaining the resistance value.

The controller 300, then, selects a correction factor corresponding to the section selected in step ST4 from the correction factors in FIG. 20, and multiplies a basic secondary transfer bias (the target current A1), which is determined based on a section and the absolute humidity X, by the selected correction factor to obtain a value of the target current A1. The obtained value of the target current A1 is ultimately applied as the secondary transfer bias to the secondary-transfer back surface roller 33 under control of the power source 39. For example, when the section 4 is selected in the resistance detection process, the target current A1 is multiplied by 90% indicated in the section 4. When printing an image with an image area ratio of 5% under the condition 10° C., 50% RH, the power source 39 ultimately outputs a secondary transfer current of −34.6 μA, which has been obtained by the expression of −120 μA×40% (the correction factor relative to the image area ratio)×80% (the correction factor relative to the environment conditions)×90% (the correction factor relative to the resistance). That is, the output value is obtained by multiplying the target current A1 by correction factors relative to the image area ratio, the environment conditions, and the resistance. In other words, the image forming apparatus 100 of the present embodiment includes the resistance sensor 409 to detect the resistance of the secondary transfer nip N. The secondary transfer bias includes the DC bias component that is supplied under constant current control. Further, the DC bias component is adjustable such that as an adjustment amount increases according to the detection value of the resistance sensor 409, the target current A1 is corrected to be reduced, and such that as the detection value of the resistance sensor 409 decreases, the target current A is corrected to be increased. This corrected target current A1 is ultimately output as the secondary transfer bias. In the present embodiment, corrections are made on the DC bias component with respect to the image area ratio, the environment conditions, and the resistance value, which increases the degree of margin in the electrical discharge. As a result, the capability to accommodate various types of recording media P increases. In the present embodiment, the corrections are made with three correction factors related to the image area ratio, the environment conditions, and the resistance value. Alternatively, in some embodiment, a target voltage may be corrected with any one of the correction factors, so that the power source 39 outputs the corrected target voltage as the secondary transfer bias.

Embodiment 5

A description is provided of the fifth embodiment to decisive the first embodiment. The intermediate transfer belt 31 is made of an elastic material to secure the transferability of a recording medium P having an uneven surface. After the toner of the four colors are primarily transferred onto the intermediate transfer belt 31, the four-color composite toner image is transferred secondarily from the intermediate transfer belt 31 onto the recording medium P. The intermediate transfer belt 31 includes a base layer 310, an elastic layer 311, and a coating layer 312, which are laminated in this recited order from the inner side. The base layer is made of resins, such as polyimide and polyamide-imide with a thickness of 50 μm to 100 μm. The elastic layer 311 is made of a acrylic rubber. The coating layer 312 has releasability. The elastic layer 311 typically has a thickness of 100 μm to 1 mm. To prevent transfer failure, a pressing force adequate for the secondary transfer is applied to the intermediate transfer belt 31 according to the property of rubber of the intermediate transfer belt 31. This provides a favorable transferability of toner even in concave portions of the unevenness of the recording medium P.

When employing such an intermediate transfer belt 31 according to the above-described configuration, a transferring pressure force adequate for the transfer is applied to the elastic layer 311. That is, a certain amount of transfer pressure is applied to successfully perform the secondary transfer. For examples, a plurality of pressing devices serving as a secondary transfer pressing device are employed to vary a transfer pressure with the type of the recording medium P, such as the degree of an unevenness, and the thickness. However, applying an adequate amount of transfer pressure causes the recording medium P to have a high adhesion property relative to the intermediate transfer belt 31, thereby interfering with the separation of the recording medium P, which has passed through the secondary transfer nip N, from the intermediate transfer belt 31. That is, a separation failure occurs. Such a failure is pronounced in the roller scheme that employs a secondary transfer roller 36. Therefore, it is preferable for the image forming apparatus to combine with a secondary transfer unit 41 of the secondary transfer belt scheme according to the first embodiment to attain both the ability of separation of the recording medium P from the intermediate transfer belt 31 and the transferability of the toner images onto the recording medium P.

As it is apparent from the test that an elastic intermediate transfer belt 31 is weaker in the prenip electrical discharge than the PI belt. Accordingly, a prenip in the elastic intermediate transfer belt 31 is formed to be wider than the PI belt does. Thus, in the present embodiment, the length of the prenip is 5.2 mm, which is longer than those in the first embodiment through the fourth embodiment. In this case, the "length" refers to a length along the direction b of conveyance of the recording medium. As described above, as a large size of prenip is formed in the elastic intermediate transfer belt 31, the length of the secondary transfer nip N is increased. This causes toner to be easily overcharged. Therefore, a high-duty (with a duty greater than 50%) superimposed bias is preferably applied as the secondary transfer bias when an elastic belt is used for a secondary transfer belt 404. With this configuration, higher ability of separation of and transferability onto the recording medium P is secured, preventing abnormal images from being generated due to the overcharge of toner, as compared to using the PI belt for the intermediate transfer belt 31.

The intermediate transfer belt 31 made of an elastic material can be employed as the elastic belt having particles 313 as illustrated in FIGS. 3B and 3C. As such an elastic belt with an upper most layer (i.e., the elastic layer 311) in which particles 313 are dispersed is used, a contact area of a belt surface with toner in the secondary transfer nip N is reduced. With this configuration, a contact area of the belt surface with the toner in the secondary transfer nip can be reduced, and hence the ability of separation of the toner from the belt surface can be enhanced. The transfer rate can be enhanced. However, when the secondary transfer current flows concentrically between the insulating particles 313 which are arranged regularly, the electrical charges having an opposite polarity get injected easily to the toner, which may overcharge the toner. As a result, even when the particles 313 are dispersed to enhance the transfer rate, the secondary transfer rate may decrease. In view of this, the secondary transfer bias with a high duty (with a duty greater than 50%) is applied to reliably enhance the secondary transfer rate by the particles 313.

As the particles 313, particles capable of getting oppositely charged to the normal charging polarity of the toner are employed. According to the present embodiment, the particles 313 are constituted of melamine resin particles having a positive charging property. With this configuration, electrical charges of the particles 313 suppress concentration of the secondary transfer current between the particles, hence further reducing the injection of opposite electrical charges to the toner. Alternatively, in some embodiments, particles having charge property of the same charge polarity as the normal charge polarity of the toner are used as the particles 313. For example, silicone resin particles having a negative charge property (i.e., Tospearl (registered trademark)) can be used.

The image forming apparatus 100 of the present embodiments employs the secondary transfer belt unit 41 including the secondary transfer roller 36 and the secondary transfer belt 404. Alternatively, instead of the belt method, the image forming apparatus 100 may employ a roller method in which the secondary transfer roller 36 directly contacts and separates from the intermediate transfer belt 31. The secondary transfer roller 36 can be also referred to as a secondary-transfer opposed roller. The intermediate transfer belt 31 is interposed between the secondary-transfer back surface roller 33 and the secondary transfer roller 36, thereby forming a secondary transfer nip N. The secondary transfer nip N is referred to as a transfer portion. In this case as well, the secondary transfer bias is output from the power source 39 to the secondary-transfer back surface roller 33. Further, the secondary transfer roller 36 is connected to ground. With this configuration, a secondary transfer electrical field is formed in the secondary transfer nip N between the secondary-transfer back surface roller 33 and the secondary transfer roller 36 so that the toner having a negative polarity is transferred electrostatically from the secondary-transfer back surface roller 33 side to the secondary transfer roller 36 side. A transfer bias may be applied to the secondary transfer roller 36. A conveyor belt 50 is disposed between the secondary transfer roller 36 and the fixing device 90 so that the recording medium P is reliably conveyed to the fixing device 90 after the secondary transfer.

Figure 22:
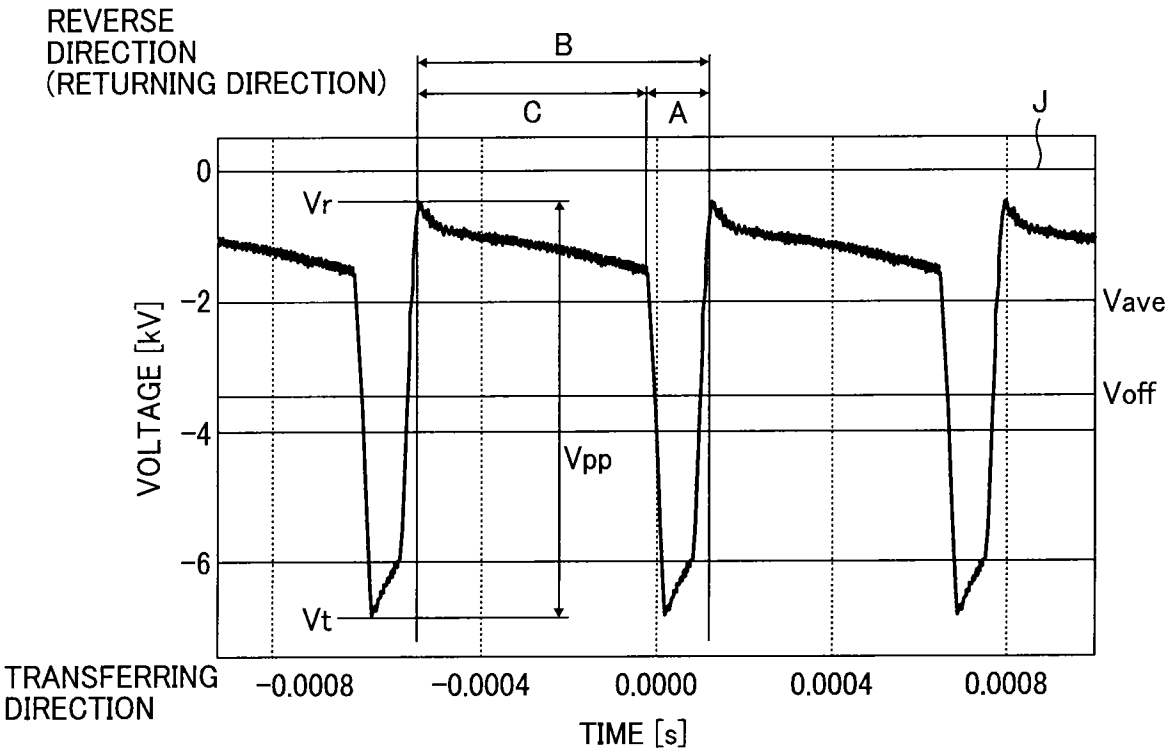
FIG. 22 is a graph of an example of a waveform of a bias with a high duty output from a power source according to an embodiment of the present disclosure.

According to the embodiments of the present disclosure, in the waveform of the secondary transfer bias output from the power source 39, the waveform rises and falls across 0 V between the peak value Vr side of a positive voltage and the peak value Vt of a negative voltage. However, the waveform is not limited to such a form. For example, as illustrated in FIG. 22, the peak value Vr of a bias in the returning direction is set toward the transfer direction side (a negative bias side) than 0 V. The waveform rises and falls between the peak value Vr and the peak value Vt in the negative voltage area. In this case, with the duty greater than 50%, overcharging the toner is prevented, thus preventing the generation of abnormal images. In the image forming apparatus that employs the belt transfer scheme, thin paper can easily separate from the belt. However, the electrical discharge is more likely to occur in thin paper. Therefore, the secondary transfer roller 36 is advantageously shifted toward the upstream side in the direction of convey of the recording medium to prevent the occurrence of the electrical discharge in thin paper as well. That is, when transferring a toner image from the intermediate transfer belt 31 onto the recording medium P, the power source 39 outputs the secondary transfer bias that alternates a voltage in the transfer direction and a voltage in the returning direction opposite to the transfer direction. With the voltage in the transfer direction, the toner image is transferred from the intermediate transfer belt 31 side to the recording medium P side. In the waveform of such a secondary transfer bias, the output voltage may alternate the voltage in the transfer direction and the voltage in the returning direction in the polarity of the returning direction side of 0 V when the voltage in the transfer direction is Vr and the voltage in the returning direction is Vt.

As described above, in the present embodiments, the amount of the secondary transfer nip N which is the transfer portion, is increased by forming a prenip at the upstream side in direction b of conveyance of the recording medium. Due to the increased secondary transfer nip N, toner is overcharged, thereby generating the electrical discharge. Such an electrical discharge also occurs in the secondary transfer nip N, which has expanded toward the downstream side in the direction b of conveyance of the recording medium. In this case, the intermediate transfer belt 31 is wound around a portion of the circumferential surface 36*a* of the secondary transfer roller 36 and a portion of the circumferential surface 404*a* the secondary transfer belt 404. In such a case as well, applying a transfer bias (the secondary transfer bias) with a duty greater than 50% prevents the overcharge of toner, thereby preventing the generation of abnormal images.

In the embodiments described above, a description was provided of an image forming apparatus that employs the intermediate transfer method by which an image is transferred from the intermediate transfer belt 31 onto the recording medium P. The configuration according to the present embodiments applies to an image forming apparatus that employs a direct transfer method in which an image is transferred from an image bearer, such as a photoconductive drum and a photoconductive belt, onto the recording medium P. In addition, a transfer device that employs a charging method in which no transfer nip is formed may be used. In the image forming apparatus according to the present embodiments described above, the recording medium P passes through the secondary transfer nip N (the transfer portion) in a horizontal direction. Alternatively, in some embodiments, the image forming apparatus includes a configuration in which the recording medium P passes through the transfer portion upward, downward, obliquely upward, or obliquely downward.

Although the embodiment of the present disclosure has been described above, the present disclosure is not limited to the foregoing embodiments, but a variety of modifications can naturally be made within the scope of the present disclosure.

Embodiment 6

Figure 34:
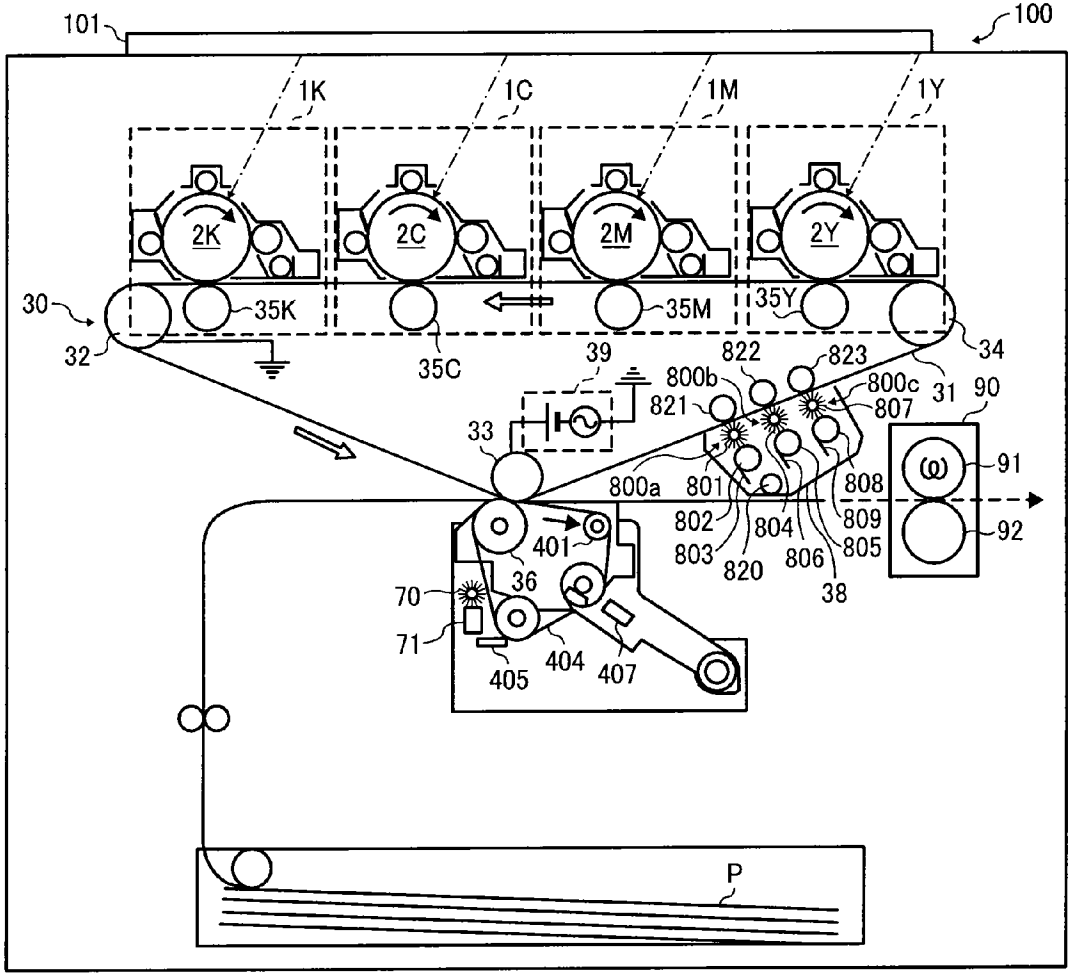
FIG. 34 is a schematic diagram illustrating a printer as an example of an image forming apparatus according to a sixth embodiment of the present disclosure.

A description is provided of an electrophotographic color printer as an example of an image forming apparatus according to a sixth embodiment of the present disclosure. FIG. 34 is a schematic diagram illustrating an image forming apparatus according to the sixth embodiment. A descriptions is omitted, of the parts same as those of the image forming apparatus in FIG. 1 according to the first embodiment through the fifth embodiment.

In the sixth embodiment, after an intermediate transfer belt 31 passes through a secondary transfer nip N, residual toner not having been transferred onto a recording sheet P remains on the intermediate transfer belt 31. The residual toner is removed from the intermediate transfer belt 31 by a belt cleaner 38 that contacts the surface of the intermediate transfer belt 31.

According to the present embodiment, the belt cleaner 38 includes a first cleaning device 800*a*, a second cleaning device 800*b*, and a third cleaning device 800*c*. The first cleaning device 800*a* is disposed at the most-upstream end in a direction of rotation of the intermediate transfer belt 31 to remove oppositely-charged toner having a polarity (positive polarity) opposite to normal charging polarity (negative polarity) of toner, from the intermediate transfer belt 31. The first cleaning device 800*a* is disposed at the most-upstream end in a direction of rotation of the intermediate transfer belt to electrostatically remove oppositely-charged toner having a polarity (positive polarity) opposite to normal charging polarity (negative polarity) of toner, from the intermediate transfer belt 31.

The cleaning devices 800*a*, 800*b*, and 800*c* respectively include collecting rollers 802, 805; and 808 and scraping blades 803, 806, and 809. Each collecting roller collects toner adhering to brush rollers 801, 804, and 807. Each scraping blade contacts each collecting roller to scrape toner off a surface of each roller. The brush rollers 801, 804, and 807 are disposed opposing to cleaning opposed rollers 821, 822, and 823 via the intermediate transfer belt 31.

The brush rollers 801, 804, and 807 are referred to respectively as a first brush roller 801, a second brush roller 804, and a third brush roller 807. The first brush roller 801 of the first cleaning device 800*a* receives a voltage having a negative polarity applied. The second brush roller 804 of the second cleaning device 800*b* and the third brush roller 807 of the third cleaning device 800*c* also receive a voltage having a negative polarity applied. In the present embodiment, a voltage of −1 kV is applied to the first brush roller 801. A voltage of +1 through +2 kV is applied to the second brush roller 804. A voltage of +1 through +4 kV is applied to the third brush roller 807.

The brush rollers 801, 804, and 807 respectively include rotatable shafts, which are made of metal, and brushes. The rotatable shafts are rotatably held by shaft bearings. Each brush includes a plurality of napped fibers on the circumferential surface thereof. The napped fibers have a sheath-core double-layered structure including conductive materials such as conductive carbon in the core part and insulating materials, such as polyester, on the surface part. With this configuration, the core parts of the fibers are charged with a potential same as the voltage applied to the brush roller, thereby electrostatically attracting toner to the surface of each fiber. That is, the voltage applied to the cleaning brushes electrostatically attracts the toner from the intermediate transfer belt 31 onto the fibers. Alternatively, in some embodiments, the fibers of the brush rollers are made conductive materials only. In addition, alternatively, fibers are implanted diagonally to the normal directions of the rotatable shafts.

The collecting rollers 802, 805, and 808 electrostatically attract and collect toner from the brush rollers 801, 804, and 807 under a potential gradient between the fibers and the collecting rollers 802, 805, and 808. The collecting rollers 802, 805, and 808 are supplied with a voltage with an amount sufficient to electrostatically attract the toner, which has removed by the brush rollers 801, 804, and 807, to the collecting rollers.

Next, a description is provided of a cleaning operation of the belt cleaner 38. Then, after the secondary transfer process in the secondary transfer nip, untransferred residual toner and toner image remaining on the intermediate transfer belt 31 travel forward to the first brush roller 801 with a rotation of the intermediate transfer belt 31. A voltage having a polarity same as the normal charging polarity (negative polarity) of the toner is applied to the first brush roller 801. The potential difference between the intermediate transfer belt 31 and the first brush roller 801 generates an electric field to electrostatically attract oppositely-charged toner having a polarity (positive polarity) opposite to the normal charging polarity (negative polarity) of toner, from the intermediate transfer belt 31. At this time, due to the charge injection and electrical discharge, a portion of toner, which has received a negative polarity from the first brush roller 801 and has been charged with the normal polarity a negative polarity, remains on the intermediate transfer belt 31.

The oppositely-charged toner having a positive polarity attracted on the first brush roller 801 is conveyed to a position where the first brush roller 801 contacts the first collecting roller 802. The first collecting roller 802 has a voltage having a negative polarity greater than the first brush roller 801 does. With the electric field formed by the potential difference between the first brush roller 801 and the first collecting roller 802, the toner is electrostatically attracted from the first brush roller 801 to the first collecting roller 802. The toner having a positive polarity, which has been attracted to the first collecting roller 802, is scraped from the first collecting roller 802 by the first scraping blade 803. Then, the scraped toner is discharged outside the apparatus through a conveying screw 820.

Residual toner not having been removed by the first brush roller 801 is conveyed by the intermediate transfer belt 31 to a position of the second brush roller 804. A voltage having a polarity (positive polarity) opposite to the normal charging polarity (negative polarity) of the toner is applied to the second collecting roller 802. The electric field generated by the potential difference between the intermediate transfer belt 31 and the second brush roller 804 electrostatically attracts the toner having the normal charging polarity (negative polarity), from the intermediate transfer belt 31 to the second brush roller 804.

The normally-charged toner on the second brush roller 804 is then conveyed to a position where the second brush roller 804 contacts the second collecting roller 805. The second collecting roller 805 has a voltage having a positive polarity greater than the second brush roller 804 does. With the electric field formed by the potential difference between the second brush roller 804 and the second collecting roller 805, the toner is electrostatically attracted from the second brush roller 804 to the second collecting roller 805. The toner having a positive polarity, which has been attracted to the second collecting roller 805, is scraped from the second collecting roller 805 by the second scraping blade 806.

Residual toner having been oppositely charged (a negative polarity) by the first brush roller 801 or not having been removed by the second brush roller 804 is conveyed by the intermediate transfer belt 31 to a position of the third brush roller 807. The toner conveyed to the third brush roller 807 has a negative polarity under control of the first brush roller 801. Most of the residual toner is removed from the intermediate transfer belt 31 by the first brush roller 801 and the second brush roller 804. Therefore, a small amount of the toner is conveyed to the third brush roller 807, most of the toner having the normal charging polarity, i.e., a negative polarity.

The third brush roller 807 is supplied with a voltage having a positive polarity opposite to the normal charging polarity of toner, electrostatically attracting the small amount of toner from the intermediate transfer belt 31. Then, the toner is electrostatically attracted to the third collecting roller 808, which is supplied with a voltage having a positive polarity greater than the third brush roller 807 does. The toner having collected by the third collecting roller 808 is scraped by the third scraping blade 809.

In the image forming apparatus 100 of the present embodiment, a pattern sensor 407 is disposed facing the surface of the secondary transfer belt 404. At the downstream from the pattern sensor 407 in the direction of rotation of the secondary transfer belt 404, a cleaning blade 405 is disposed. Further, a lubricant application roller 70 is disposed at the downstream from the cleaning blade 405 in the direction of rotation of the secondary transfer belt 404. The lubricant application roller 70 applies a lubricant 71 to the surface of the secondary transfer belt 404.

A toner pattern is formed on the surface of the photoconductor 2 to adjust an image quality based on the formed toner pattern. The formed toner pattern is primarily transferred from the photoconductor 2 onto the intermediate transfer belt 31, and then secondarily transferred from the intermediate transfer belt 31 onto the secondary transfer belt 404 during a paper sheet interval where no recording medium P is placed in the secondary transfer portion. The pattern sensor 407 detects the density ID of the toner pattern (an amount of toner) transferred onto the secondary transfer belt 404. After the toner pattern passes the front of the pattern sensor 407, a cleaning blade 405 removes the toner pattern from the secondary transfer belt 404. Then, the lubricant application roller 70 applies the lubricant 71 to the surface of the secondary transfer belt 404.

A description is provided of an image adjustment (process control). The process of the image adjustment includes forming a test pattern, detecting the density and position of the formed test pattern, and adjusting the density and positional deviation based on the detected density and position. More specifically, a predetermined pattern of latent image is developed to obtain a toner pattern for adjustment of density (a type of the toner pattern for image adjustment). Then, a toner amount (the density of the toner pattern) is detected. In response to the detected toner amount, changes are made to the density of the toner contained in a developer, the conditions, such as exposure power for the optical writing unit 101, the set values of the charging bias and developing bias. In the process of the adjustment of the positional deviation, each timing of writing the latent images of the colors is determined according to the detection of the toner pattern for adjustment of positional deviation (a type of the toner pattern for image adjustment).

The process of the image adjustment is typically carried out when the power source is turned ON, before a printing job (an image forming operation) starts, after the printing job is completed, or while the image forming operation, such as an image formation, on a predetermined number of sheets is not performed. However, in some embodiment, a pattern for image adjustment is formed in a non-image region between image regions (each refers to an image portion where a toner image is transferred onto a sheet of the recording medium), so that the formed pattern is detected to adjust the image quality. The non-image region is a region between a rear end of a recording medium advancing forward and a leading end of another recording medium following thereafter. This configuration allows more stable printed image quality.

The toner pattern for adjustment of density is formed on the secondary transfer belt 404, so that the density of the pattern is successfully detected. However, it is difficult to detect the density of a toner pattern on the photoconductor 2. This is because, when the photoconductor has a small diameter, there is not enough space to dispose an image density sensor. The toner pattern for adjustment of positional deviation can also be detected on the secondary transfer belt 404. Due to variations in the distance between the photoconductors for different colors and different timing of writing latent images of the different colors, the positional deviation occurs between the toner images primarily transferred onto the intermediate transfer belt 31, which is then secondarily transferred onto the secondary transfer belt 404. Thus, the positional deviation between the toner images of the different colors can be detected on the secondary transfer belt 404. Therefore, in the present embodiment, the pattern sensor 407 detects both the toner pattern for adjustment of density and the toner pattern for adjustment of positional deviation on the secondary transfer belt 404.

Further, the image forming apparatus 100 includes a refresh mode which forcibly consumes toner to remove degraded toner from the developing device 8 by forming a toner consumption pattern in a non-image region between images on the photoconductor 2 at a predetermined timing. This is because, when images having low image area ratios are continuously formed, an increasing amount of degraded toner remains within the developing device 8, thereby degrading a developing performance and transferability due to the deteriorated charging properties. As a result, image quality is degraded. However, with the refresh mode, fresh toner is supplied to the developing device 8 in which the density of toner is low as the degraded toner is removed. That is, the degraded toner is replaced with fresh toner.

Further, the formed toner consumption pattern is transferred from the photoconductor 2 onto the intermediate transfer belt 31, and is further transferred onto the secondary transfer belt 404. The cleaning blade 405 ultimately removes the toner consumption pattern from the secondary transfer belt 404.

The fixing device 90 is disposed downstream from the secondary transfer nip in the direction of conveyance of the recording sheet P. The fixing device 90 includes a fixing roller 91 and a pressing roller 92. The fixing roller 91 includes a heat source, such as a halogen lamp, inside the fixing roller 91. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is output outside the image forming apparatus from the fixing device 90 via a post-fixing delivery path after the fixing process.

According to the embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. In a state in which the intermediate transfer belt 31 contacts only the photoconductor 2K, only the image forming unit 1K for black among four image forming units is driven to form a black toner image on the photoconductor 2K. It is to be noted that the present disclosure can be applied to both an image forming apparatus for forming a color image and a monochrome image forming apparatus for forming a single-color image.

FIG. 3B is a partially enlarged cross-sectional view schematically illustrating a transverse plane of the intermediate transfer belt 31. The intermediate transfer belt 31 includes a base layer 310 and an elastic layer 311. The base layer 310 formed into an endless looped belt is formed of a material having a high stiffness, but having some flexibility. The elastic layer 311 disposed on the front surface of the base layer 310 is formed of an elastic material with high elasticity. Particles 313 are dispersed in the elastic layer 311. While a portion of the particles 313 projects from the elastic layer 311, the particles 313 are arranged concentratedly in a belt surface direction as illustrated in FIG. 3C. With these particles 313, an uneven surface of the belt with multiple bumps is formed on the intermediate transfer belt 31.

Examples of materials for the base layer 310 include, but are not limited to, a resin in which an electrical resistance adjusting material made of a filler or an additive is dispersed to adjust electrical resistance. Examples of the resin constituting the base layer 310 include, but are not limited to, fluorine-based resins, such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 310, as needed. The coating solution is a liquid resin before curing in which electrical resistance adjusting materials are dispersed. An amount of the electrical resistance adjusting materials to be dispersed in the base layer 310 of a seamless belt, i.e., the intermediate transfer belt 31 is preferably in a range from $1\times10^{8}$ to $1\times10^{13}$ Ω/sq in surface resistivity, and in a range from $1\times10^{6}$ to $10^{12}$ Ω·cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt 31) in which the electrical characteristics (i.e., the surface resistivity and the volume resistivity) and the mechanical strength are well balanced. The content of the electrical resistance adjusting material in the coating liquid when using carbon black is in a range from 10% to 25% by weight or preferably, from 15% to 20% by weight relative to the solid content. The content of the electrical resistance adjusting material in the coating liquid when using metal oxides is approximately 150% by weight or more preferably, in a range from 10% to 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 31 drops, which is undesirable in actual use.

The thickness of the base layer 310 is not limited to a particular thickness and can be selected as needed. The thickness of the base layer 310 is preferably in a range from 30 μm to 150 μm, more preferably in a range from 40 μm to 120 μm, even more preferably, in a range from 50 μm to 80 μm. The base layer 310 having a thickness of less than 30 μm cracks and gets torn easily. The base layer 310 having a thickness of greater than 150 μm cracks when it is bent. By contrast, if the thickness of the base layer 310 is in the above-described respective range, the durability is enhanced.

In order to increase the stability of traveling of the intermediate transfer belt 31, preferably, the thickness of the base layer 310 is uniform as much as possible. An adjustment method to adjust the thickness of the base layer 310 is not limited to a particular method, and can be selected as needed. For example, the thickness of the base layer 310 can be measured using a contact-type or an eddy-current thickness meter or a scanning electron microscope (SEM) which measures a cross-section of the film.

As described above, the elastic layer 311 of the intermediate transfer belt 31 includes an uneven surface formed with the particles 313 dispersed in the elastic layer 311. Examples of elastic materials for the elastic layer 311 include, but are not limited to, generally-used resins, elastomers, and rubbers. Preferably, elastic materials having good elasticity, such as elastomer materials and rubber materials, are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers, such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include, but are not limited to, chlorosulfonated polyethylenes, fluorocarbon rubbers, urethane rubbers, and hydrin rubbers. A material having desired characteristics can be selected from the above-described materials. In particular, in order to accommodate a recording sheet with an uneven surface, such as Leathac (registered trademark), soft materials, are preferable. Because the particles 313 are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 311. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine.

Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene)dianiline, 4,4'-(p-phenylenediisopropylidene)dianiline, 2,2'-bis[4-(4-aminophenoxy)phenyl]propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 to 20 parts by weight, more preferably, from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 311. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1,3,1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0]undec-7-ene (DBU). Examples of the tertiary phosphines include, but are not limited to, triphenylphosphine and tri(p-tolyl)phosphine. Examples of the weak acid alkali metal salts include, but are not limited to, phosphates, such as sodium and potassium, inorganic weak acid salts, such as carbonate or stearic acid salt, and organic weak acid salts, such as lauric acid salt.

The amount of the crosslinking promoter is, preferably, in a range from 0.1 to 20 parts by weight, more preferably, from 0.3 to 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure, such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature, at which the crosslinking agent is neither reacted not decomposed.

When heated, the acrylic rubber serves as a crosslinked product. The heating temperature is preferably in a range of 130° C. to 220° C., more preferably, 140° C. to 200° C. The crosslinking time period is preferably in a range of 30 seconds to 5 hours. The heating methods can be chosen from those which are typically used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 to 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight to 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 311 is, preferably, in a range from $1\times10^{8}$ Ω/sq to $1\times10^{13}$ Ω/sq, and the volume resistivity of the elastic layer 311 is, preferably, in a range from $1\times10^{6}$ Ω·cm to $1\times10^{12}$ Ω·cm. In order to obtain high toner transferability relative to an uneven surface of a recording sheet as is desired in image forming apparatuses using electrophotography in recent years, it is preferable to adjust a micro rubber hardness of the elastic layer 311 to 35 or less under the condition 23° C., 50% RH. In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the uppermost layer of the intermediate transfer belt 31 with a relatively low deformation capability as a whole, the micro-hardness decreases. In such a configuration, the intermediate transfer belt 31 with a low deformation capability does not conform to the surface condition of the uneven surface of the recording sheet, thereby impairing the desired transferability relative to the uneven surface of the recording sheet. In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 311 is, preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 311 to sag easily due to its own weight, resulting in unstable movement of the intermediate transfer belt 31 and damage to the intermediate transfer belt 31 looped around rollers. The layer thickness can be measured by observing the cross-section of the elastic layer 311 using a scanning electron microscope (SEM), for example.

Figure 23:
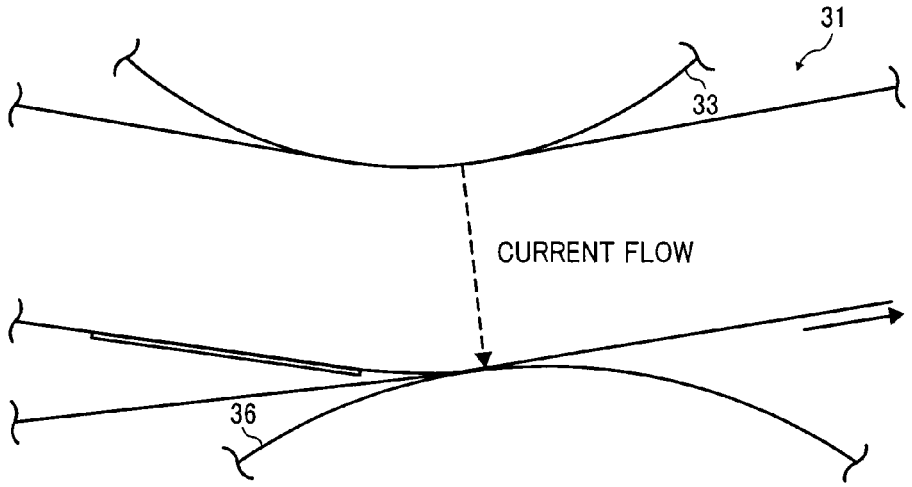
FIG. 23 is an enlarged view of a structure around a secondary transfer nip using a single-layer intermediate transfer belt which is different from that of the image forming apparatus of FIG. 21.

FIG. 23 is an enlarged diagram schematically illustrating a structure around the secondary transfer nip using a single-layer intermediate transfer belt as the intermediate transfer belt 31. In a case in which the single-layer intermediate transfer belt is used as the intermediate transfer belt 31, a secondary transfer current flows between the secondary-transfer opposed roller 33 and the secondary transfer roller 36 in a manner described below. That is, the secondary transfer current is concentrated at the nip center (the center in the traveling direction of the belt) and flows linearly as indicated by arrow in FIG. 24. In other words, the secondary transfer current does not flow much near the nip start portion of the secondary transfer nip and near the nip end portion of the secondary transfer nip. When the secondary transfer current flows in such a manner described above, the time period during which the secondary transfer current acts on the toner is relatively short at the secondary transfer nip. Accordingly, excessive injection of electrical charges having a polarity opposite that of the normal polarity due to the secondary transfer current is suppressed, if not prevented entirely, which prevents overcharging.

Figure 24:
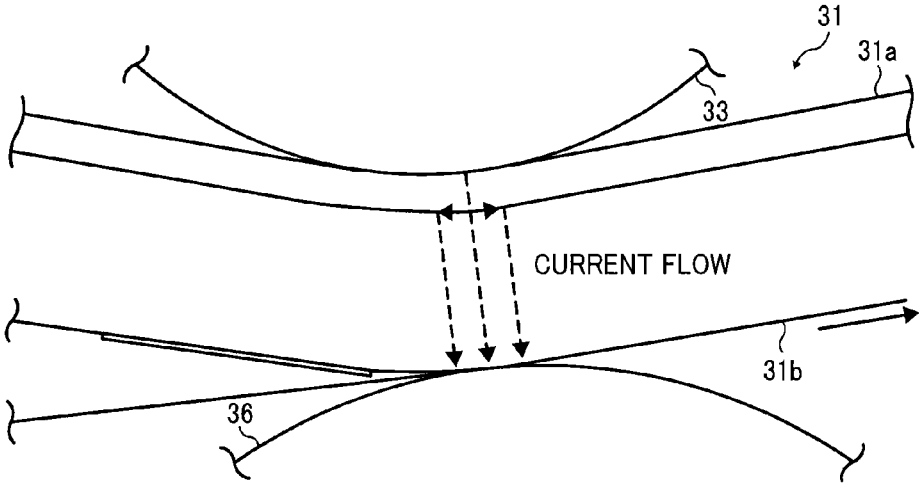
FIG. 24 is an enlarged cross-sectional view of a secondary transfer nip and a surrounding structure according to an embodiment of the present disclosure.

FIG. 24 is a partially enlarged cross-sectional view schematically illustrating the secondary transfer nip and a surrounding structure according to an embodiment of the present disclosure. According to the present embodiment, as described above, a multi-layer intermediate transfer belt is used as the intermediate transfer belt 31. In a case in which the multi-layer intermediate transfer belt is used as the intermediate transfer belt 31, a secondary transfer current flows between the secondary-transfer back surface roller 33 and the secondary transfer roller 36 in a manner described below. When using the multilayer intermediate transfer belt as the intermediate transfer belt 31, the secondary transfer current flows through an interface between the base layer 310 and the elastic layer 311 in the belt thickness direction while the secondary transfer current spreads in the circumferential direction of the intermediate transfer belt 31. As a result, the secondary transfer current flows not only in the center of the secondary transfer nip, but also at the nip start portion and at the nip end portion. This means that the secondary transfer current acts on the toner in the secondary transfer nip for an extended period of time. Thus, electrical charges having a polarity opposite to the normal polarity are easily and excessively injected to the toner due to the secondary transfer current, which results in an overcharging to toner and also results in a reverse charging of the toner, causing secondary transfer failure. As a result, the image density becomes inadequate easily. Not only the two-layer belt such as in the present embodiment, but also the belt having multiple layers including three more layers causes the similar spread of the secondary transfer current, which results in an overcharging and revers charging of the toner. As a result, secondary transfer failure occurs.

Figure 25:
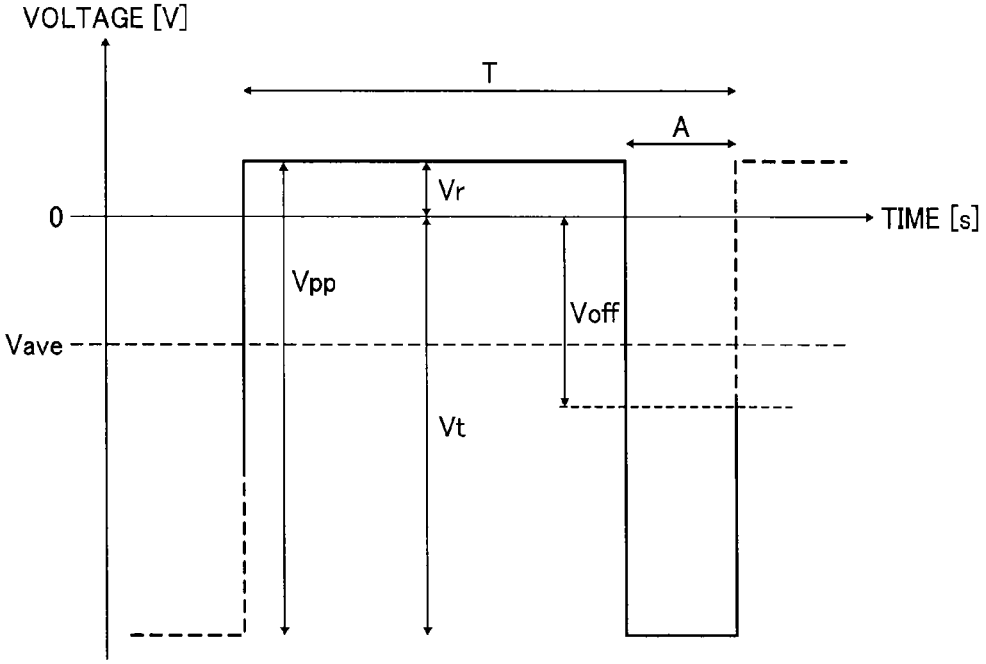
FIG. 25 is a graph of a waveform of a secondary bias output from a secondary transfer power source according to an embodiment of the present disclosure.

FIG. 25 is a waveform chart showing a waveform of a secondary bias output from the power source 39 for the secondary transfer according to an embodiment of the present disclosure. According to the present embodiment, the secondary transfer bias is applied to the secondary-transfer back surface roller 33. In this configuration, in order to secondarily transfer a toner image from the intermediate transfer belt 31 onto a recording sheet P, it is necessary to employ the secondary transfer bias having the characteristics described below. That is, a time-averaged polarity of the secondary transfer bias is similar to or the same polarity as the charge polarity of toner. More specifically, as illustrated in FIG. 25, the secondary transfer bias includes an alternating voltage, the polarity of which is inverted cyclically due to superimposed DC and AC voltages. On time average, the polarity of the secondary transfer bias is negative which is the same as the polarity of the toner. Using the secondary transfer bias having the negative time-averaged polarity, the toner is repelled relatively by the secondary-transfer back surface roller 33, thereby enabling the toner to electrostatically move from the belt side toward the recording sheet side.

In a case in which the secondary transfer bias is applied to the secondary transfer roller 36, the secondary transfer bias having the time-averaged polarity opposite to the polarity of the toner is used. With such a secondary transfer bias, the toner is electrostatically attracted relatively to the secondary transfer roller 36, thereby enabling the toner to electrostatically move from the belt side toward the recording sheet side.

In FIG. 25, T represents one cycle of the secondary transfer bias with the polarity that alternates cyclically. Vr represents a reverse-polarity peak value which is a peak value of a positive polarity, that is, the polarity opposite to the charge polarity of the toner. When the secondary transfer bias has the reverse-polarity peak value Vr, electrostatic migration of the toner from the belt side to the recording sheet side is inhibited. Vt represents a same-polarity peak value which is a peak value of the same negative polarity as the charge polarity of the toner. When the secondary transfer bias has the negative-polarity peak value Vt, electrostatic migration of the toner from the belt side to the recording sheet side is accelerated. Voff represents an offset voltage as a DC component value of the secondary transfer bias and coincides with a solution to an equation (Vr+Vt)/2. Vpp represents a peak-to-peak value.

The secondary transfer bias has a waveform with a duty (i.e. duty ratio) greater than 50% of the cycle T. The duty (duty ratio) is a time ratio based on an inhibition time period during which the electrostatic migration of the toner from the intermediate transfer belt side to the recording sheet side in the secondary transfer nip is inhibited in a first time period and a second time period of the waveform. According to the present embodiment, the first time period is a time period in the cycle T of the waveform from when the secondary transfer bias starts rising beyond the zero line as the baseline towards the positive polarity side to a time after the secondary transfer bias falls to the zero line, but immediately before the secondary transfer bias starts falling from the zero line towards the negative polarity side. The second time period is a time period in the cycle T of the waveform from when the secondary transfer bias starts falling towards the negative polarity side from the zero line to a time after the secondary transfer bias rises to the zero line, but immediately before the secondary transfer bias starts further rising beyond the zero line towards the positive polarity side. In the first time period, the toner is prevented from electrostatically moving from the belt side to the recording sheet P side. In other words, the first time period corresponds to the inhibition time period. Therefore, the duty is the time ratio based on the first time period (during which the polarity is positive) in the cycle T. The duty of the secondary transfer bias of the image forming apparatus is obtained by the following equation: (T−A)/T×100 (%), where A is the second time period.

In FIG. 25, the term "Vave" represents an average potential of the secondary transfer bias and coincides with a solution to an equation "Vr×Duty/100+Vt×(1−Duty)/100". Furthermore, A represents the second time period (i.e., a time period obtained by subtracting the inhibition time period from the cycle T in the present embodiment.) T indicates a cycle of an AC component of the secondary transfer bias.

As illustrated in FIG. 25, in the secondary transfer bias, the time period during which the secondary transfer bias has a positive polarity is greater than half the cycle T. That is, the duty is greater than 50%. With such a secondary transfer bias, the time period, during which electrical charges having the positive polarity opposite to the charge polarity of the toner may possibly be injected to the toner in the cycle T, is shortened. Accordingly, a decrease in the charge amount of toner Q/M caused by the injection of the electrical charges in the secondary transfer nip can be suppressed, if not prevented entirely. With this configuration, degradation of the secondary transfer ability caused by a decrease in the charge amount of toner is prevented, hence obtaining adequate image density. Even when the duty is greater than 50%, the toner image can be secondarily transferred in a manner described below. That is, an area of the positive side of the graph with 0V as a reference is smaller than that of the negative side of the graph so that the average potential has a negative polarity, thereby enabling the toner to electrostatically move relatively from the belt side to the recording sheet side.

Figure 26:
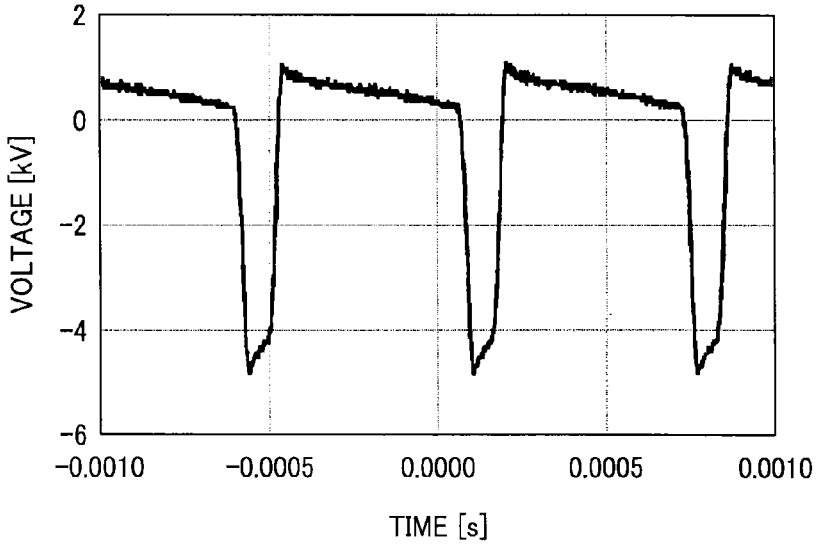
FIG. 26 is a graph of a waveform of a secondary transfer bias with a duty of 85% output from a secondary transfer power source of a prototype image forming apparatus.

FIG. 26 is a waveform chart showing a waveform of the secondary transfer bias output from the power source 39 for the secondary transfer of a prototype image forming apparatus. In FIG. 26, the negative-polarity peak value Vt is −4.8 kV. The positive-polarity peak value Vr is 1.2 kV. The offset voltage Voff is −1.8 kV. The average potential Vave is 0.08 kV. The peak-to-peak value Vpp is 6.0 kV. The second time period A is 0.10 ms. The cycle T is 0.66 ms. The duty is 85%.

The present inventors have performed printing tests with different duties of the secondary transfer bias under the following conditions:

Environment condition: 27° C./80%;
Type of recording sheet P: Coated sheet, i.e., Mohawk Color Copy Gloss 270 gsm (457 mm×305 mm);
Process linear velocity: 630 mm/s;
Test image: Black halftone image;
Width of the secondary transfer nip (the length in the traveling direction of the belt): 4 mm;
The negative-polarity peak value Vt is −4.8 kV;
The positive-polarity peak value Vr: 1.2 kV;
Offset voltage Voff: −1.8 kV;
Average potential Vave: 0.08 kV;
Peak-to-peak value Vpp: 6.0 kV;
Second time period A: 0.10 ms;
Cycle T: 0.66 ms; and
Duty: 90%, 70%, 50%, 30%, and 10%.

Figure 14A:
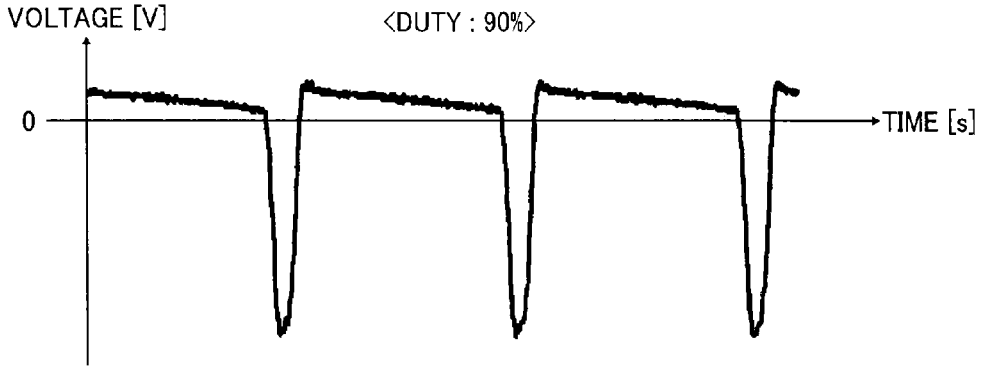
FIGS. 14A through 14E are graphs of waveforms used for a test.
Figure 14B:
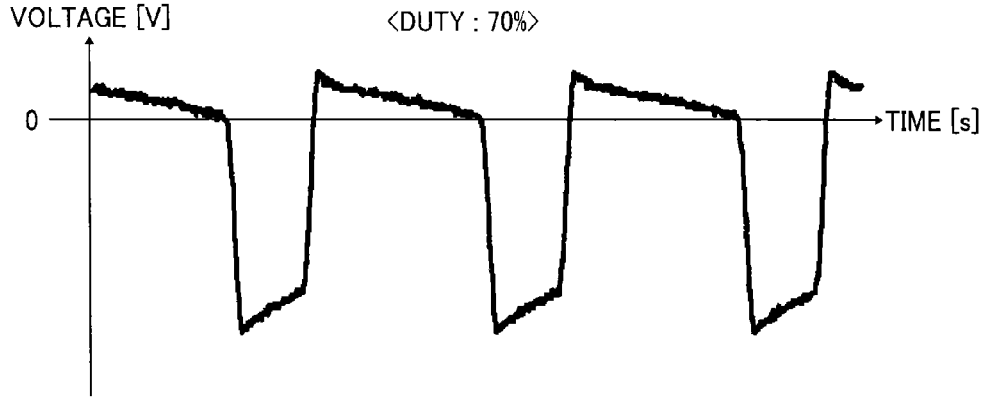
Figure 14C:
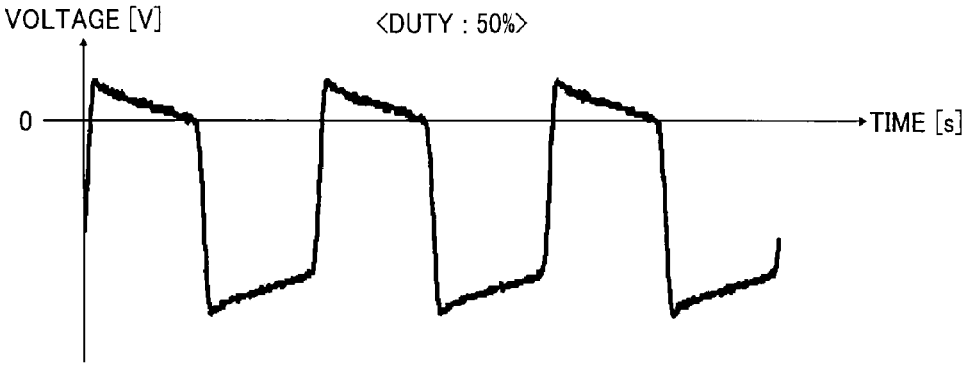
Figure 14D:
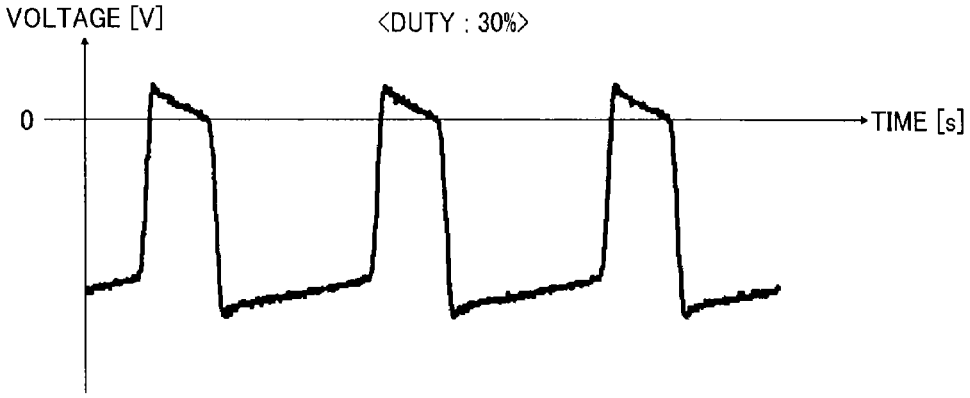

FIG. 14A is a waveform chart showing an actual output waveform of the secondary transfer bias with the duty of 90%. FIG. 14B is a waveform chart showing an actual output waveform of the secondary transfer bias with the duty of 70%. FIG.

Figure 14E:
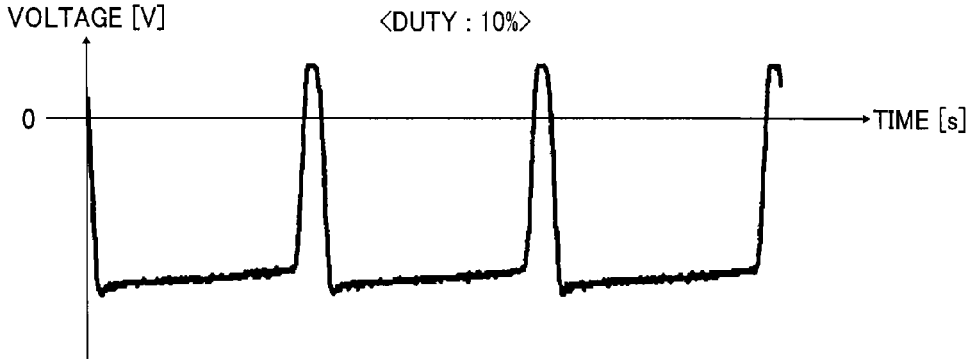

14C is a waveform chart showing an actual output waveform of the secondary transfer bias with the duty of 70%. FIG. 14E is a waveform chart showing an actual output waveform of the secondary transfer bias with the duty of 30%. FIG. 14E is a waveform chart showing an actual output waveform of the secondary transfer bias with the duty of 10%.

The results are shown in Table 1.

TABLE 1

| DUTY (%) | 90 | 70 | 50 | 30 | 10 |
|---|---|---|---|---|---|
| EVALUATION OF TRANSFERABILITY | 5 | 5 | 3 | 1 | 1 |

In Table 1, reproducibility of image density of test images were graded on a five point scale of 1 to 5, with Grade 5 indicating that the density of a halftone test image was adequate. Grade 4 indicates that the density was slightly lower than that of Grade 5, but the density was good enough so as not to cause a problem. Grade 3 indicates that the density was lower than that of Grade 4, and desired image quality to satisfy users was not obtained. Grade 2 indicates that the density was lower than that of Grade 3. Grade 1 indicates that the test image looked generally white or even whiter (less density). The acceptable image quality to satisfy users was Grade 4 or above.

With the duty of 10% and 30%, the time period, during which electrical charges having the opposite polarity may possibly be injected to the toner in the cycle T, was relatively long. Therefore, a toner image is overcharged, resulting in a degradation in the transferability. As a result, as shown in Table 1, the image density was graded as Grade 1, which indicates that the image density was inadequate significantly.

With the duty of 70% and 90%, the time period, during which electrical charges having the opposite polarity may possibly be injected to the toner in the cycle T, was relatively short. Therefore, an overcharge of the toner image is suppressed, thereby upgrading the transferability. As a result, as shown in Table 1, the image density was graded as Grade 5 which indicates that the desired image density was obtained.

As shown in the drawings, with the secondary transfer bias, the polarity of which is inverted between waveforms Vr and Vt, that is, alternately changes in the cycle T, the overcharge due to the injection of reverse electrical charges to the toner can be prevented more reliably. This is because, in this configuration with crossing V0, even when the recording sheet P is charged the electric field having the polarity that prevents the injection of the reverse charges acts relatively in the secondary transfer nip.

The same experiments were performed using regular paper as the recording sheet P, instead of the above-described coated sheets. The experiment conditions are described below.

Environment condition: 27° C./80%.
Type of recording sheet: Normal (regular paper);
Process linear velocity: 630 mm/s;
Test image: Black halftone image;
Width of the secondary transfer nip (the length in the traveling direction of the belt): 4 mm;
The negative-polarity peak value Vt is −4.8 kV;
The positive-polarity peak value Vr: 1.2 kV;
Offset voltage Voff: −1.8 kV;
Average potential Vave: 0.08 kV;
Peak-to-peak value Vpp: 6.0 kV;
Second time period A: 0.10 ms;
Cycle T: 0.66 ms; and
Duty: 90%, 70%, 50%, 30%, and 10%.

The relations between the duty and the evaluation of the transferability were similar to the coated sheet shown in Table 1.

Generally, as illustrated in FIGS. 14A through 14E and FIG. 26, the waveform of the secondary transfer bias consisting of a superimposed bias is not a clean square wave. If the waveform is a clean square wave, a time period from the rise of waveform to the fall of the waveform can be easily specified as the toner-transfer inhibition time period in the one cycle. If the waveform is not such a clean square wave, the inhibition time period cannot be specified. That is, in a case in which a certain amount of time period is required (i.e., when the required time period is not zero) for the wave to rise from a first peak value (for example, the negative polarity peak value Vt) to a second peak value (for example, the positive-polarity peak), or to fall from the second peak value to the first peak value, the above-described specifying process cannot be performed.

In view of the above, if the waveform is not a clean square wave, the duty is defined as follows. That is, among one peak value (e.g., the first peak value) of the peak-to-peak value and another peak value (e.g., the second peak value) in the cyclical movement of the waveform of the secondary transfer bias, whichever inhibits more the electrostatic migration of toner from the secondary transfer belt side to the recording medium side in the secondary transfer nip, is defined as an inhibition peak value. According to the present embodiment, the peak value at the positive side is defined as the inhibition peak value. The position, at which the inhibition peak value is shifted towards the another peak value by an amount equal to 30% of the peak-to-peak value, is defined as the baseline of the waveform. A time period, during which the waveform is on the inhibition peak side relative to the baseline, is defined as an inhibition time period A'. More specifically, the inhibition time period A' is a time period from when the waveform starts rising or falling from the baseline towards the inhibition peak value to immediately before the waveform falls or rises to the baseline. The duty is defined as a ratio of the inhibition time period A' to the cycle T.

Figure 27:
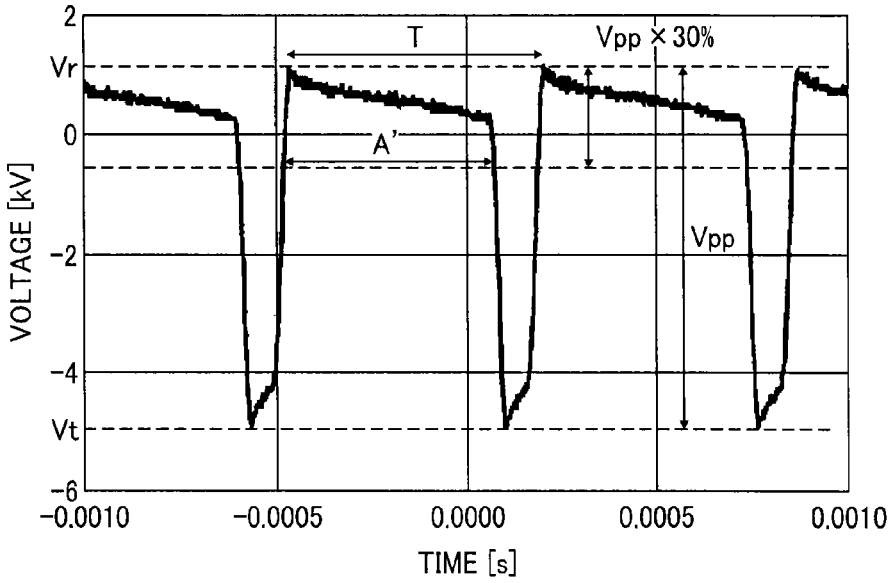
FIG. 27 is a graph for explaining a definition of the duty.

More specifically, a solution of an equation "(Inhibition time period A'/Cycle T)×100%" in FIG. 27 is obtained as the duty. According to the present embodiment, the toner having a negative polarity is used, and the secondary transfer bias is applied to the secondary-transfer back surface roller 33. Thus, the positive-polarity peak value Vr is the inhibition peak value. The inhibition time period A' is a time period from when the waveform starts rising from the baseline towards the positive-polarity peak value Vr to a time after the waveform falls to the baseline, but immediately before the waveform starts falling further towards the negative-polarity peak value Vt. By contrast, in a configuration in which the toner having a negative polarity is used and the secondary transfer bias is applied to the secondary transfer roller 36, the secondary transfer bias having a reversed waveform which is a waveform shown in FIG. 27 reversed at 0V as a reference is used. In this case, the negative-polarity peak value Vt is the inhibition peak value. Thus, the positive-polarity peak value Vr is the inhibition peak value. The inhibition time period A' is a time period from when the waveform starts rising from the baseline towards the positive-polarity peak value Vr to a time after the waveform falls to the baseline, but immediately before the waveform starts falling further towards the positive-polarity peak value Vr.

Figure 28:
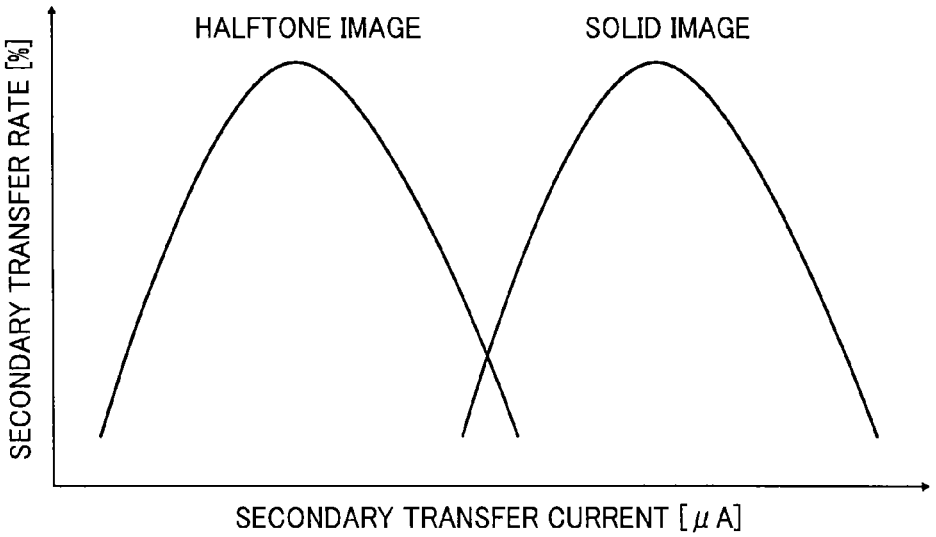
FIG. 28 is a graph of relations between secondary transfer rates and secondary transfer currents.

FIG. 28 is a graph showing relations between a secondary transfer rate and a secondary transfer current. The secondary transfer rate is a ratio of the toner adhesion amount (per unit area) of the toner image on the intermediate transfer belt 31 before entering the secondary transfer nip relative to an amount of transferred toner. More specifically, the amount of transferred toner refers to a toner adhesion amount (per unit area) of the toner image that is secondarily transferred onto a recording sheet P after passing through the secondary transfer nip.

As illustrated in FIG. 28, the graph showing relations between the secondary transfer rate and the secondary transfer current has a parabolic curve, such as in a normal distribution. This indicates that when the secondary transfer current is too much or too little, good secondary transfer ability is not achieved, and in order to maximize the secondary transfer ability there is an optimum secondary transfer current suitable for the maximum secondary transfer ability. As illustrated in FIG. 28, the proper secondary transfer current is lower for the halftone image which generally has a relatively small toner adhesion amount per unit area than for the solid image which generally has a relatively large toner adhesion amount. Among general users, the solid image is output more frequently than the halftone image. If the secondary transfer current is set in accordance with the solid image, upon output of the halftone image the secondary transfer ability cannot be maximized. Because the secondary transfer current flows excessively in the halftone image having generally less toner adhesion amount, the electrical charges having a polarity opposite to the polarity of the toner are injected to the toner. As a result, an inadequate toner adhesion amount Q/M and the reversely charged toner cause the secondary transfer failure. Therefore, especially in the halftone image, the image density becomes inadequate more easily. According to the present embodiment, a high-duty alternating current (AC) transfer is carried out to achieve the transferability of solid images and halftone images together. In the high-duty alternating current (AC) transfer, a superimposed bias with a duty greater than 50% is used as the secondary transfer bias.

Figure 29:
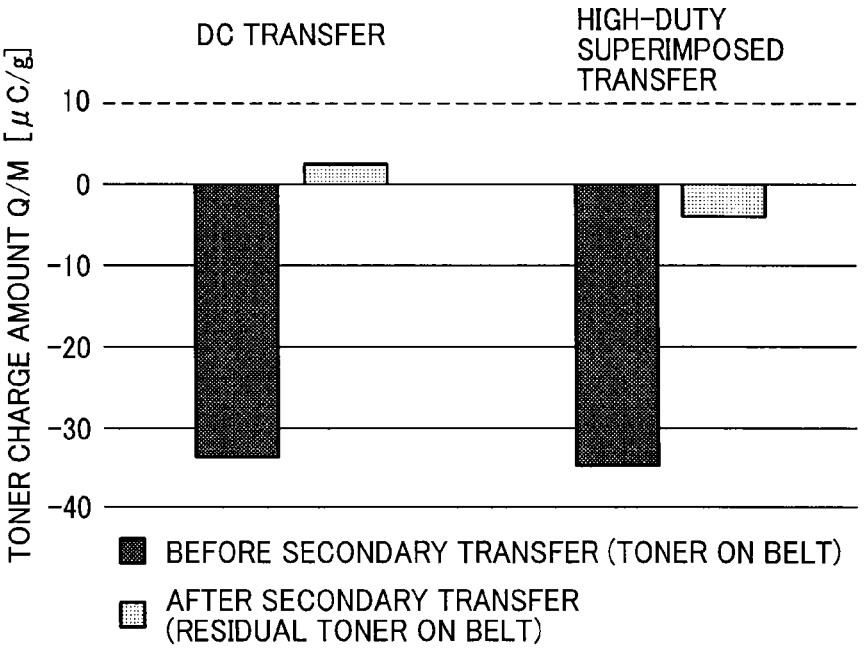
FIG. 29 is a graph of relations between charge amounts of toner Q/M and transfer methods.

FIG. 29 is a graph showing relations between a charge amount of toner Q/M and a transfer method. In direct current (DC) transfer shown in FIG. 29, only a direct current (DC) voltage having a negative polarity is used as the secondary transfer bias. The duty in this case is 0%. In high-duty superimposed bias transfer, a superimposed bias with a duty greater than 50% is used as the secondary transfer bias, similar to the present embodiment. The duty in this case is 85%.

As illustrated in FIG. 18, in the DC transfer using the secondary transfer bias with the duty of 0%, the toner after the secondary transfer is reversely charged, that is, the toner has a positive polarity after the secondary transfer. The electric current having a polarity that enhances electrostatic migration of the toner from the belt side to the sheet side acts on the toner for a relatively long period of time in the secondary transfer nip. Accordingly, a significant amount of electrical charges having a polarity opposite to the polarity of the toner is injected to the toner, resulting in the overcharged toner being reversely charged to have a positive polarity. By contrast, in the high-duty superimposed bias transfer, the polarity of the toner after the secondary transfer remains negative, which is a normal charge of the toner. When the above-described time period is shortened even more by setting the duty to 85%, the amount of injection of electrical charges to the toner is reduced. More specifically, the amount of injection of electrical charges having the opposite polarity is reduced, thus suppressing overcharge. In the high-duty AC transfer, the toner is charged with the negative polarity, thus upgrading the transferability, as compared to the DC transfer in which the toner is reversely charged to have a positive polarity. This is because, a bias having a negative polarity is applied as the transfer bias. With this configuration, using the secondary transfer bias with a high duty, the injection of the reverse electrical charges to the toner is reduced, hence suppressing or preventing secondary transfer failure.

According to the present embodiment, as the intermediate transfer belt 31, a belt with an upper most layer (i.e., the elastic layer 311) in which particles (the particles 313) are dispersed is used. With this configuration, a contact area of the belt surface with the toner in the secondary transfer nip can be reduced, and hence the ability of separation of the toner from the belt surface can be enhanced. The transfer rate can be enhanced. However, when the secondary transfer current flows concentrically between the insulating particles 313 which are arranged regularly, the electrical charges having an opposite polarity get injected easily to the toner. As a result, even when the particles 313 are dispersed to enhance the transfer rate, the secondary transfer rate may decrease. For example, using the AC bias with duty of 50% or less or the DC bias causes the transfer failure for the halftone images. This is because, the secondary transfer current leaks out from spaces between particles 313, thereby overcharging the toner. In view of this, when the particles 313 are dispersed over the surface of the belt, the secondary transfer bias with a high duty is employed to reliably enhance the secondary transfer rate by the particles 313. With this configuration, the ability of separation of the toner from the belt surface can be enhanced and the transfer failure can be reduced as well.

As the particles 313, particles capable of getting oppositely charged to the normal charging polarity of the toner are employed. According to the present embodiment, the particles 313 are constituted of melamine resin particles having a positive charging property. With this configuration, electrical charges of the particles 313 are canceled out with the transfer bias having a significant negative element, suppressing concentration of the secondary transfer current between the particles. Hence, the injection of opposite electrical charges to the toner is further reduced. Using this configuration with a high-duty secondary transfer bias can reliably prevent the image failure due to the overcharged toner.

Alternatively, in some embodiments, particles having charge property of the same charge polarity as the normal charge polarity of the toner are used as the particles 313. For example, silicone resin particles having a negative charge property (i.e., Tospearl (registered trademark)) can be used. In this case as well, using a high-duty secondary transfer bias can prevent the image failure.

In some embodiments, the intermediate transfer belt 31 may include an uppermost layer made of urethane or Teflon (registered trademark). Alternatively, the intermediate transfer belt 31 may include multiple layers made of resins, such as polyimide and polyamide-imide. With either belts, using the secondary transfer bias with a high duty can prevent transfer failure and inadequate image density.

Figure 30:
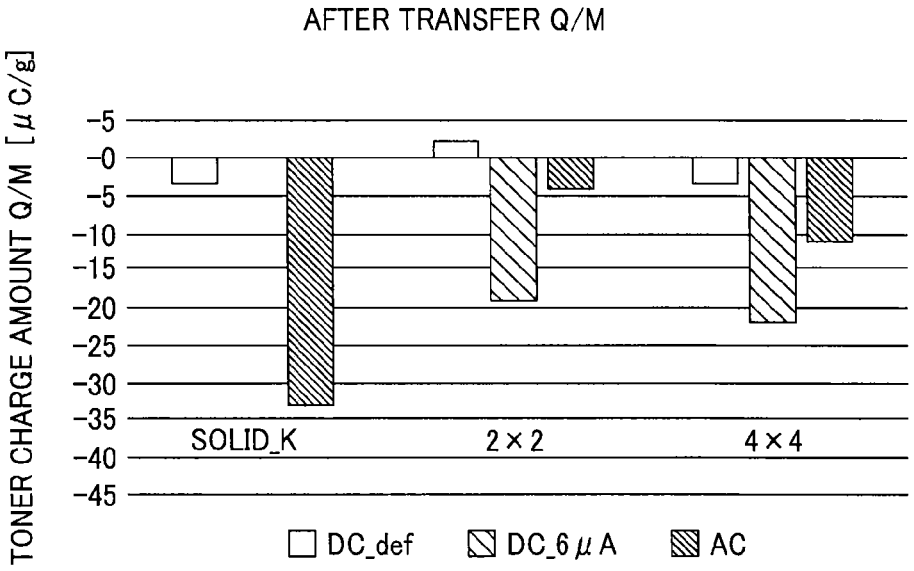
FIG. 30 is a graph of relations between toner charging amounts Q/M of image patterns having respectively transferred onto a secondary transfer portion and three types of secondary transfer bias applied.

FIG. 30 is a graph of toner charging amounts Q/M of image patterns having respectively transferred onto a secondary transfer portion with a superimposed bias, a first DC bias, and a second DC bias with a smaller amount of current than the first DC bias as a secondary transfer bias. The value of the second DC bias is 6 μA.

The values of the superimposed bias and the first DC bias are large sufficient to transfer two-color full solid image. The second DC bias having 6 μA is not capable of transferring the two-color full solid image and a single-color solid image except a 2 by 2 image and 4 by 4 image. Toner before transfer has a charging amount of approximately −30 μC/g.

Referring to FIG. 30, in a case of transferring a 2 by 2 having a low gray scale image with the first DC bias, toner is overcharged in the secondary transfer portion, and residual toner having not transferred is charged with a positive polarity, which is opposite to the normal charging polarity of toner. In the case of the 2 by 2 image, as less amount of residual toner having not transferred remains on the secondary transfer belt 404, decreasing the toner charging amount Q/M to a degree is permissible. However, the untransferred residual toner, which has been oppositely charged with a positive polarity, may hamper electrostatical cleaning of the secondary transfer belt. Further, still referring to FIG. 30, irrespective of types of images, the toner charging amount Q/M after transfer considerably decreases. The untransferred residual toner after transferring of the full solid image is difficult to be removed.

With the second DC bias, the toner charging amounts Q/M after transfer are large for both the 2 by 2 image and 4 by 4 image. However, the second DC bias cannot transfer the full solid image due to the insufficient amount of transfer current. Therefore, the toner charging amount Q/M after transferring the full solid image was not obtained.

With the superimposed bias applied, irrespective of types of images, the toner after transfer has the same polarity as each other. The toner charging amounts Q/M are relatively high except the 2 by 2 image. In the case of transferring the 2 by 2 image, even when the toner charging amount decreased to a degree, the untransferred residual toner, which is not oppositely charged with a positive polarity, can be removed from the secondary transfer belt 404 Thus, with the superimposed bias applied as the secondary transfer bias, the residual toner having not transferred is electrostatically removed from the secondary transfer belt 404. That is, the electrostatical cleaning is possible. Therefore, spherical toner and insufficiently charged toner, which is easily overcharged, are removed through the electrostatic cleaning by applying the superimposed bias.

Figure 31:
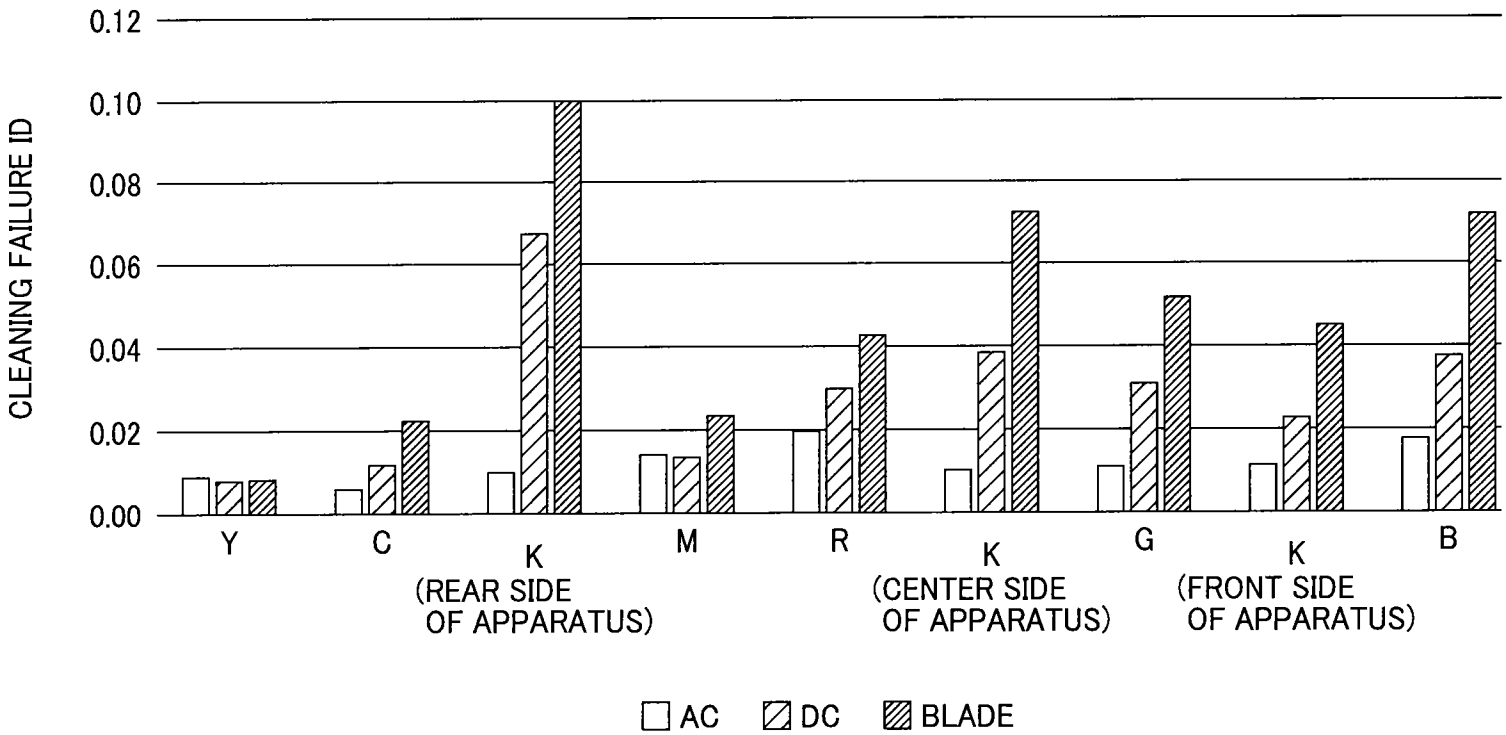
FIG. 31 is a graph of cleaning performance of spherical toner according to three configurations: a configuration of electrostatic cleaning with superimposed bias transfer, a configuration of electrostatic cleaning with direct current bias transfer, and a configuration of blade cleaning.
Figure 32:
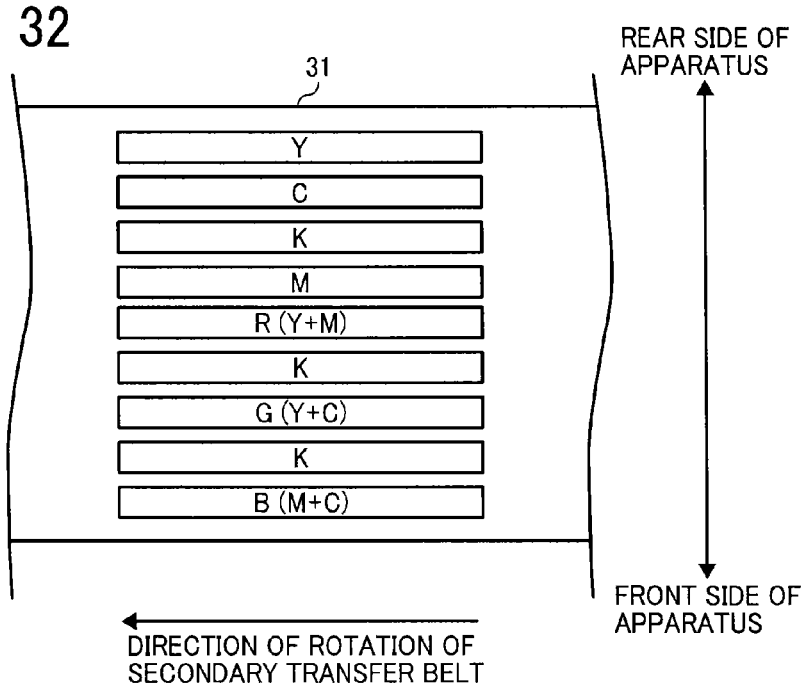
FIG. 32 is a schematic view of charts of respective colors on an intermediate transfer belt.

FIG. 31 indicates data regarding the degree of cleaning failure of a spherical toner having a circularity greater than or equal to 0.96 according to each of three configurations: a configuration that performs the electrostatic cleaning with the superimposed bias transfer applied, a configuration that performs the electrostatic cleaning with the DC bias transfer applied, and a configuration that performs the blade cleaning. In FIG. 31, the vertical axis refers to an index (ID) representing the degree of cleaning failure. More specifically, after passing through a cleaning device, residual toner having not been removed is transferred from the intermediate transfer belt 31 onto a tape. Then, the ID of the tape with residual toner transferred is measured. The ID of the tape is subtracted from the measured ID to quantify the amount of toner that has not been removed by cleaning, i.e., cleaning failure. It should be noted that in the present experiment, when the ID exceeds 0.04, the residual toner having not been removed is visually identified on the recording medium P. Therefore, a determination is made such that with an ID smaller than or equal to 0.04, a successful cleaning performance is exhibited. FIG. 32 is a schematic diagram of charts of the respective colors on the intermediate transfer belt 31 so as to obtain the degree of cleaning failure as indicated in FIG. 31. It should be noted that the charts of the colors in FIG. 32 are arranged in the same order as the order of the colors as illustrated in FIG. 31. In FIG. 31, the sign "Y" (a yellow color) in the leftmost side is disposed on the edge of the rear side of the apparatus, and the sign "B" (a black color) on the rightmost side is disposed on the edge of the front side of the apparatus.

In a case of the blade cleaning, a great amount of toner sneaks through the blade because the toner subject to the cleaning is the spherical toner with a circularity of greater than or equal to 0.96. As compared to the blade cleaning, in the configuration that performs the electrostatic cleaning with the DC bias applied, the cleaning performance is more favorable, but cleaning failure occurs depending on the colors of toner or in-image positions. With the configuration that performs the electrostatic cleaning with the superimposed bias transfer, a favorable cleaning performance is exhibited irrespective of the colors of toner or in-image positions.

Embodiment 7

A description is provided of an electrophotographic color printer as an example of an image forming apparatus according to a seventh embodiment of the present disclosure. The basic configuration of the image forming apparatus according to the present embodiment is the same as the sixth embodiment does. Therefore, the description is omitted. In the image forming apparatus of the present embodiment, a power source 39 outputs a bias including an AC component to a secondary transfer nip while a region between recording media on an intermediate transfer belt 31 passes the secondary transfer nip.

Figure 33:
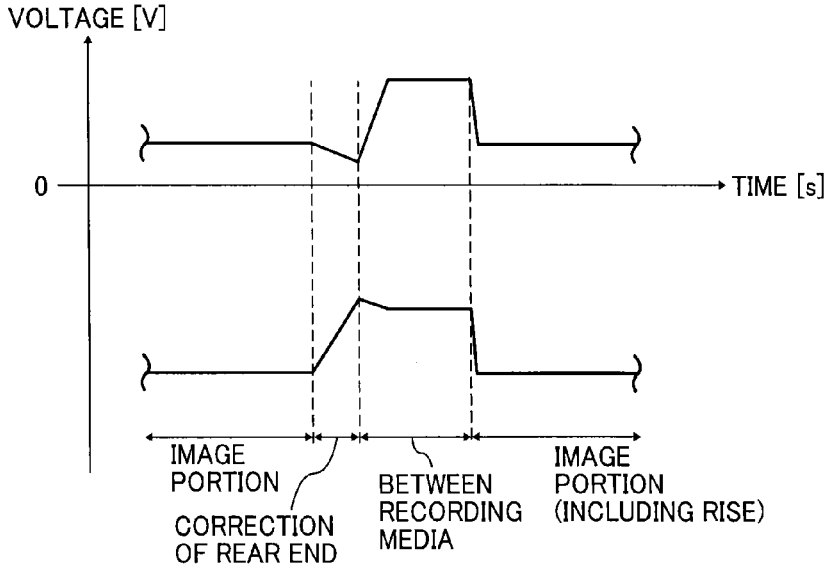
FIG. 33 is a graph of an example of the secondary transfer bias that switches between an image portion and a region between recording media when successively conveying a plurality of recording media to continuously form images.

FIG. 33 illustrates an example of the secondary transfer bias that switches between an image portion and a region between recording media P when successively forming images to convey a plurality of recording media P. In FIG. 33, the secondary transfer bias output is expressed with an envelope connecting the peak values of the positive polarity and with an envelope connecting the peak values of the negative polarity. Referring to FIG. 33, the secondary transfer bias output to the image portions includes the AC component with peak values of +1.2 kV and −5.6 kV, and with a peak-to-peak value of 6.8 kV. When a correction is made on the rear end, which is described below, the secondary transfer bias applied includes the AC component with peak values of +0.56 kV and −3.92 kV, and with a peak-to-peak value Vpp of 4.48 kV that is the lowest. The secondary transfer bias output to the region between the recording media includes the AC component with peak values of +2.1 kV and −4.7 kV, and with a peak-to-peak value Vpp of 6.8 kV.

As illustrated in FIG. 33, the peak-to-peak value Vpp of the secondary transfer bias in the image portion is preferably equal to the peak-to-peak value Vpp of the secondary transfer bias in the region between the recording media. In this case, the surface potential of the intermediate transfer belt 31 does not easily vary between the image portion and the recording medium.

Table 2 below represents values of belt potential of the intermediate transfer belt, which has passed through the secondary transfer nip, for when the secondary transfer bias including the DC bias is applied and for when the secondary transfer bias including the AC bias is applied, respectively. In Table 2, a belt A refers to a laminated belt, and a belt B refers to a single-layer belt. The belt A has a higher volume resistivity than the belt B does.

TABLE 2

| SECONDARY TRANSFER BIAS | BELT A | BELT B |
|---|---|---|
| AC | +200 V | +20 V |
| DC | +1500 V | +380 V |

Typically, the intermediate transfer belt 31, which has passed through the secondary transfer nip, still has a belt surface charged because a high voltage is applied to the secondary transfer nip while the secondary transfer passes there-through. The polarity discharges at portions where the intermediate transfer belt 31 is entrained about and stretched taut around a tension roller (ground roller) except the secondary-transfer back surface roller 33, or naturally discharges into air, thereby dropping polarity. However, depending on devices having a high linear velocity, a layout thereof, and the potential decay property, such as resistance of the intermediate transfer belt 31, subsequent processes, such as cleaning, a primary transfer, and a secondary transfer following thereafter, start before the potential of the belt surface sufficiently drops.

That is, the surface of the intermediate transfer belt 31 facing a belt cleaner 38 is still charged when the intermediate transfer belt 31 reaches the belt cleaner 38. According to the experiment of the present inventor, when a repulsive transfer is performed by applying the DC bias having a negative polarity which is the same as the normal charging polarity of toner to the secondary-transfer back surface roller 33, the front surface of the intermediate transfer belt, which has passed through the secondary transfer nip, is charged with a positive polarity as indicated in Table 2. This is because, the back surface of the intermediate transfer belt has a polarity same as that of the secondary-transfer back surface roller 33, and the voltage drops by the amount of the resistance of the belt in the direction of thickness of the belt. As a result, the back surface of the intermediate transfer belt is charged with a negative polarity, and the front surface of the intermediate transfer belt is charged with a positive polarity. When the front surface, which remains positively charged, of the secondary transfer belt reaches the cleaning device 38, potential difference between the front surface of the belt and the brush roller refers to a difference in potentials between the potential of the brush roller and the potential of the front surface of the belt. Then, a current flows out of the back surface of the belt to the tension roller (earth roller) to obtain a target potential difference. At this time, the negative-charged toner trapped within the brush of the brush roller is attracted to the front surface charged with a positive polarity, thereby causing the toner to burst out (discharge) of the brush to the belt. The toner discharged onto the surface of the intermediate transfer belt 31 is not removed again though the cleaning process, appearing in a subsequent image as toner contamination.

Such a phenomenon is prevented by adjusting the amount of a bias applied to the brush roller of the belt cleaner 38 or by adjusting the potential of the intermediated transfer belt 31 having passes through the secondary transfer nip. However, such an adjustment is difficult to be performed in real time when the AC bias is applied to the image portion while the DC bias is applied to the region between the recording media (non-image portion) in the secondary transfer nip. Accordingly, the AC bias is also applied to the region between the recording media in the secondary transfer nip, resulting in both image portion and the region between the recording media being charged with a polarity same as that of the surface of the intermediate transfer belt 31. As a result, a desired potential difference between the brush roller and the front surface of the intermediate transfer belt 31 is obtained. This configuration allows obtaining the desired potential difference and prevents the toner from bursting out of the brush roller to the front surface of the intermediate transfer belt 31. Further, with the AC bias applied, a bias in a direction is also applied, that cancels out the charging of the front surface of the intermediate transfer belt 31, thereby decreasing the triboelectric potential on the front surface of the belt 31. That is, this configuration with the AC bias applied does not cause the toner to bursting out of the brush roller to the front surface of the belt 31.

To reliably guide a various type recording media differing in the thickness and material to a transfer portion, a guide, such as an entrance guide, is disposed at the upstream from the transfer portion in a direction of conveyance of recording medium, thereby guiding a recording medium to enter the transfer portion. The recording medium having a leading edge entered into the transfer portion has a rear edge portion warped more at a conveyor, such as a conveyance roller pair, or a guide, such as an entrance guide regulating the rear edge, than the leading edge does. When the recording medium passes the conveyor or the guide to have the rear edge free of the regulation by the conveyor or the guide, the rear edge of the recording medium curls up due to the resilience of the warped recording medium.

With the rear edge of the recording medium curled up, an electrical discharge occurs due to the rapid change in the distance between the intermediate transfer belt and the recording medium at the upstream side from the transfer portion in the direction of conveyance of the recording medium. Such an electrical discharge causes toner to be partly absent like white dots in an image corresponding to a toner image portion formed in the transfer portion or at the upstream side in a direction of rotation of the intermediate transfer belt 31 within the transfer portion. That is, a deterioration in image quality, such as rear-end void, occurs. Particularly in a case of a recording medium having a stiffness, such as thick paper, the rear edge of the recording medium vigorously curls up, thereby easily generating the electrical discharge and the rear-end void. It should be noted that such a rear-end void generates because the impact of the generated electrical discharge disturbs the toner image portion. In addition, the polarity of the charged toner constituting the toner image portion is reversed by the electrical discharge, resulting in a negatively-charged toner, which prevents the toner of the toner image portion from being transferred from the intermediate transfer belt onto the recording medium.

To prevent such a rear-end void, a configuration of a conveying device, such as the conveyor and the guide, is optimized such that the rear edge portion of the recording medium is warped less than the leading edge portion does at the downstream side from the transfer portion. However, there is trade-off between reducing the degree of warping and securing a reliable quality of conveyance of various recording media. Therefore, it is difficult to optimize the configuration of the conveying device to prevent the rear-end void while securing the reliable quality of conveyance.

Examples of a method for preventing such a rear-end void include a method for decreasing a transfer bias (a correction is made on the rear edge) after the rear edge of the recording medium released from the regulation of the conveyance device. With the rear edge of the recording medium curled up, an electrical discharge occurs due to the rapid change in the distance between the intermediate transfer belt and the recording medium at the upstream side from the transfer portion in the direction of conveyance of the recording medium. This method prevents the electrical discharge generated after the rear edge portion of the recording medium is released from the regulation of the conveyance device.

In the image forming apparatus of the present embodiment, when a toner pattern for adjustment of image quality in the region between the recording media to adjust image quality, a power source 39 outputs a secondary transfer bias including at least an AC component to transfer the toner pattern for adjustment of image quality from the intermediate transfer belt 31 onto the secondary transfer belt 404. With this configuration, the transferability of the toner pattern from the intermediate transfer belt 31 onto the secondary transfer belt 404 is enhanced, successfully adjusting the image quality more than the DC bias does. Alternatively, in some embodiments, the superimposed bias, in which the AC component is superimposed on the DC component, is applied as the secondary transfer bias to transfer the toner pattern for adjustment of image quality.

With the refresh mode to form a toner consumption pattern in the region between the recording media to adjust image quality, a power source outputs a secondary transfer bias including at least an AC component to transfer the toner consumption pattern from the intermediate transfer belt 31 onto the secondary transfer belt 404. With this configuration, the transferability of the toner consumption pattern from the intermediate transfer belt 31 onto the secondary transfer belt 404 is enhanced more than the DC bias does. Accordingly, the amount of residual toner remaining on the intermediate transfer belt 31 is reduced, thereby improving the cleaning performance of the belt cleaner 38 relative to the intermediate transfer belt 31.

Although the embodiment of the present disclosure has been described above as the sixth embodiment and the seventh embodiment, the present disclosure is not limited to the foregoing embodiments, but a variety of modifications can naturally be made within the scope of the present disclosure.

(Aspect A)

An image forming apparatus includes an image bearer serving as an intermediate transfer belt 31 formed into an endless loop, a toner image forming device serving as a image forming unit 1 to form a toner image on the image bearer, a nip forming device serving a secondary transfer belt 41 to contact a surface of the image bearer to form a transfer nip, a power source serving as a power source 39 for secondary transfer to output a transfer device to transfer the toner image onto a recording medium at the transfer nip, and a cleaner serving as a brush roller 801 disposed at the downstream of the transfer nip in a direction of rotation of the image bearer to electrostatically attract and remove toner from the surface of the image bearer. The transfer bias includes at least an AC component.

In the image forming apparatus including the cleaner to electrostatically remove residual toner, which has not transferred, from the image bearer, cleaning failure occurs. The present inventor found the reasons for the cleaning failure as follows: When a DC bias is applied as the transfer bias, only the charge having a specific polarity continues to be injected to toner. For example, when the DC bias having a polarity opposite to the normal charging polarity of toner is applied as the transfer bias to the transfer device, the charge having an opposite polarity continues to be injected to toner at the transfer nip. Accordingly, the residual toner having not transferred is reversely charged with a polarity opposite to that of the toner before transfer. As a result, the residual toner having not transferred is not electrostatically attracted to the cleaner, degrading cleaning performance.

According to Aspect A, a transfer bias including at least an AC component is applied, preventing injection of charge having a specific polarity into toner at the transfer nip. Further, the residual toner is prevented from having a polarity opposite to the normal charging polarity of toner before transfer. Thus, the residual toner is electrostatically attracted to the cleaner and removed from the image bearer, preventing the cleaning failure.

(Aspect B)

According to Aspect A, a superimposed bias, in which the AC component is superimposed on the DC component, is applied as the transfer bias. With this configuration, transferability is improved, reducing the amount of the residual toner. As a result, cleaning performance is enhanced.

(Aspect C)

According to Aspect A or Aspect B, during a time period in which a plurality of recording media is successively conveyed to form images, the power source outputs the bias including the AC component to the transfer nip when at least one region between the recording media passes the transfer nip. With this configuration, toner trapped by the cleaner is prevented from being electrostatically attracted to the region between the recording media on the image bearer, as described in the embodiment.

(Aspect D)

According to Aspect A, Aspect B, or Aspect C, the image forming apparatus includes a controller, such as a power source controller 300. The controller controls the power source to output a bias with a duty of greater than 50% to transfer the toner image onto the recording medium. In this case, the duty is obtained by the expression: $(T-A)/T\times100\%$ when a duration A of a peak voltage that transfers a toner image from an image bearer side to a recording medium and a duration B of one cycle of the alternating component of the transfer bias applied. With this configuration, a time period, during which the charge having an opposite polarity is injected to toner at the transfer nip, is shorter than a time period, during which toner is not reversely charged, within the one cycle of the transfer bias that cyclically alternates the polarity due to the imposed AC voltage. This configuration prevents a reduction in a charge amount of toner due to the injection of the opposite charge to toner at the transfer nip, thereby successfully transferring a toner image onto a sheet having a smooth surface, such as a coated paper. As a result, inadequate image density is suppressed.

(Aspect E)

According to Aspect A, Aspect B, Aspect C, or Aspect D, the image bearer is a multi-layer belt including a plurality of layers. The plurality of layers includes a base layer, such as a base layer 310, and an elastic layer, such as an elastic layer 311, formed on the base layer. With this configuration, the transferability of the toner image relative to the recording sheet having an uneven surface is enhanced further, as described above.

(Aspect F)

According to Aspect E, the elastic layer includes a plurality of particles 313 dispersed over the surface of the elastic layer. With this configuration, the ability of separation of the toner from the surface of the image bearer is enhanced and the transferability of the toner image is increased.

(Aspect G)

According to Aspect A, Aspect B, Aspect C, Aspect D, Aspect E, or Aspect F, the image forming apparatus another cleaner disposed at the downstream side from the transfer portion in the direction of rotation of the image bearer. Each of the cleaner and the another cleaner includes a brush roller. With this configuration, cleaning performance is improved as described above.

(Aspect H)

According to Aspect G, the image forming apparatus includes two other cleaners disposed along the direction of rotation of the image bearer. The cleaner, such as the first brush roller 801, disposed most upstream in the direction of rotation of the image bearer receives an applied bias having a same polarity as the normal charging polarity of toner. The other cleaners receive an applied bias having a polarity opposite to the normal charging polarity of toner. With this configuration, the cleaning performance is improved as described above.

(Aspect I)

According to Aspect A, Aspect B, Aspect C, Aspect D, Aspect E, Aspect F, Aspect G, or Aspect H, the transfer device includes a an endless belt, which is rotatably wound around a plurality of stretching rollers, and a toner pattern sensor serving as a toner pattern detector to detect a toner pattern for image quality adjustment, which has been transferred from the image bearer onto the transfer device to adjust an image quality. A toner image forming condition of the toner image forming device is adjustable based on the detected toner pattern. The transfer bias power source outputs the transfer bias including the AC component to transfer the toner pattern from the image bearer onto the transfer device. With this configuration, the transferability of the toner pattern from the image bearer to the transfer device is improved, adequately adjusting the formed images.

(Aspect J)

According to Aspect A, Aspect B, Aspect C, Aspect D, Aspect E, Aspect F, Aspect G, Aspect H, or Aspect I, the transfer bias power source outputs the bias including the AC component at a start of image forming operation. This configuration prevents a variation in the surface potential of the image bearer between the image portion and the region between the recording media.

It should be noted that any configuration of the first embodiment through the fifth embodiment may be combined with the configuration the sixth embodiment or the seventh embodiment. For example, the image forming apparatus of the present disclosure may include the following configuration.

An image forming apparatus includes a belt-shaped image bearer to bear a toner image; a transfer device disposed opposing to the image bearer; an opposed device disposed opposing to the transfer device via the image bearer; and a transfer bias power source to apply a transfer bias to a transfer portion where the transfer device contacts the opposed device via the image bearer so as to transfer the toner image onto a recording medium. The image bearer is disposed along an outer circumferential surface of the transfer device at least one of an upstream side and a downstream side of the transfer portion in a direction of conveyance of the recording medium. the transfer bias power source cyclically alternates the transfer bias applied to the transfer portion, between a transfer directional bias in a transfer direction to transfer the toner image from the image bearer onto the recording medium and a reverse directional bias in a reverse direction of the transfer direction. The reverse directional bias is applied during a time period longer than 50% of one cycle of the applied transfer bias in one cycle. With this configuration, an overcharge of toner at transfer portion is prevented, preventing the generation of abnormal images. Further, cleaning failure is suppressed.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a belt-shaped image bearer to bear a toner image thereon;

a transfer device disposed opposing to the image bearer;

an opposed device disposed opposing to the transfer device via the image bearer; and a transfer bias power source to apply a transfer bias to a transfer portion where the transfer device contacts the opposed device via the image bearer so as to transfer the toner image onto a recording medium, wherein the image bearer is disposed along an outer circumferential surface of the transfer device at least one of an upstream side and a downstream side of the transfer portion in a direction of conveyance of the recording medium, the transfer bias power source cyclically alternates the transfer bias applied to the transfer portion, between a transfer directional bias in a transfer direction to transfer the toner image from the image bearer onto the recording medium and a reverse directional bias in a reverse direction of the transfer direction, and the transfer bias power source applies the reverse directional bias during a time period longer than 50% of one cycle of the applied transfer bias in the one cycle.

2. The image forming apparatus according to claim 1, wherein the transfer directional bias and the reverse directional bias have different polarities from each other across a polarity switching baseline, and the time period, during which the reverse directional bias is applied, is a time period during which the transfer bias has a polarity to move toner from the recording medium to the image bearer.

3. The image forming apparatus according to claim 1, wherein the time period, during which the transfer bias power source applies the reverse directional bias, ranges from when the transfer bias reaches a peak voltage in the reverse direction to when the bias starts falling toward a peak voltage in the transfer direction.

4. The image forming apparatus according to claim 1, wherein the time period, during which the transfer bias power source applies the reverse directional bias, is a time period during which the transfer bias is in a reverse direction side relative to a baseline shifted from a peak voltage in the reverse direction toward a peak voltage in the transfer direction by an amount of 30% of a peak-to-peak voltage of the transfer bias.

5. The image forming apparatus according to claim 1, wherein the belt-shaped image bearer is an intermediate transfer body including a plurality of layers.

6. The image forming apparatus according to claim 1, wherein the belt-shaped image bearer includes an elastic intermediate transfer body.

7. The image forming apparatus according to claim 1, wherein the transfer bias includes a direct current bias component that is supplied under constant current control to adjust a target current according to an image area ratio.

8. The image forming apparatus according to claim 1, further comprising a resistance detector to detect a resistance of the transfer portion, wherein the transfer bias includes a direct current bias component that is supplied under constant current control to reduce a target current as an amount of adjustment of the direct current bias component increases according to the detected resistance and to increase the target current as the detected resistance decreases.

9. The image forming apparatus according to claim 8, wherein the resistance detector calculates a resistance based on the direct current bias component supplied to the transfer portion.

10. The image forming apparatus according to claim 1, further comprising a temperature-and-humidity detector to detect temperature and humidity data, wherein the transfer bias includes a direct current bias component, the direct current bias component is supplied under constant current control to reduce a target current as a detection value of the temperature-and-humidity detector increase and to increase the target current as the detection value decreases.

11. The image forming apparatus according to claim 1, further comprising a plurality of rotators, wherein the transfer device includes a secondary transfer belt to contact the image bearer, the secondary transfer belt is would around and rotatably supported by the plurality of rotators.

12. The image forming apparatus according to claim 1, wherein the transfer device is a secondary transfer roller to contact the image bearer.

13. The image forming apparatus according to claim 1, further comprising a controller to control the transfer bias power source to apply the reverse directional bias during the time period longer than 50% of the one cycle of the applied transfer bias in the one cycle.

14. The image forming apparatus according to claim 1, further comprising a cleaner disposed at a downstream side from the transfer portion in a direction of rotation of the image bearer, to electrostatically attract and remove toner from a surface of the image bearer, wherein the transfer bias includes an alternating current component.

15. The image forming apparatus according to claim 14, wherein the transfer bias power source outputs a bias including the alternating current component to the transfer portion when a region between recording media of the image bearer passes the transfer portion during a time period in which a plurality of recording media are successively conveyed to form images.

16. The image forming apparatus according to claim 14, further comprising another cleaner disposed at the downstream side from the transfer portion in the direction of rotation of the image bearer, each of the cleaner and the another cleaner including a brush roller.

17. The image forming apparatus according to claim 14, further comprising an image forming device to form a toner image on the image bearer, wherein the transfer device includes an endless belt, which is rotatably wound around a plurality of stretching rollers, and a toner pattern detector to detect a toner pattern for image quality adjustment, which has been transferred from the image bearer onto the transfer device to adjust an image quality, a toner image forming condition of the image forming device adjustable based on the detected toner pattern, and the transfer bias power source outputs the transfer bias including the alternating current component to transfer the toner pattern from the image bearer onto the transfer device.

18. The image forming apparatus according to claim 14, wherein the transfer bias power source outputs the transfer bias including the alternating current component at a start of image forming operation.

19. The image forming apparatus according to claim 14, further comprising two other cleaners disposed along the direction of rotation of the image bearer, wherein one of the cleaner and the two other cleaners disposed most upstream in the direction of rotation of the image bearer receives an applied bias having a same polarity as a normal charging polarity of toner, and the other cleaners receive an applied bias having a polarity opposite to the normal charging polarity of toner.

* * * * *